US012590449B2

(12) United States Patent
Halloran et al.

(10) Patent No.: US 12,590,449 B2
(45) Date of Patent: Mar. 31, 2026

(54) TOILET

(71) Applicant: Kohler Co., Kohler, WI (US)

(72) Inventors: Daniel N. Halloran, Fredonia, WI (US); Luke Bartel, Milwaukee, WI (US); Diego Alejandro Cuervo Ayala, Sheboygan Falls, WI (US); Megan Joe Hizon Roehl, Sheboygan, WI (US); Wesley Irek, Grafton, WI (US); Robert S. Davis, Grafton, WI (US); William Kuru, Plymouth, WI (US); Paola Alvarez, Kohler, WI (US); Crystel Tershner, Kohler, WI (US); Kenneth A. Kapal, Sheboygan, WI (US); Alan E. Lange, Kiel, WI (US); Cody Wilcox, Cedarburg, WI (US); Andrew van Gorden, Green Bay, WI (US); Yi Liu, Madison, WI (US); Jeffrey T. Laundre, Sheboygan, WI (US); Amber Colleen Resch, Stoughton, WI (US); Amy Dehne, Kohler, WI (US); David Hammer, Kohler, WI (US); Aaron Mitchell, Grafton, WI (US); Ryan Grotegut, Sheboygan, WI (US); Mrudula Y, Sheboygan, WI (US); Jonathan Reik, Cedarburg, WI (US)

(73) Assignee: Kohler Co., Kohler, WI (US)

( * ) Notice: Subject to any disclaimer, the term of this patent is extended or adjusted under 35 U.S.C. 154(b) by 92 days.

(21) Appl. No.: 18/427,081

(22) Filed: Jan. 30, 2024

(65) Prior Publication Data

US 2024/0254750 A1 Aug. 1, 2024

Related U.S. Application Data

(60) Provisional application No. 63/442,306, filed on Jan. 31, 2023.

(51) Int. Cl.
*E03D 9/08* (2006.01)
*E03D 11/16* (2006.01)

(52) U.S. Cl.
CPC ..... *E03D 9/085* (2013.01); *E03D 11/16* (2013.01); *E03D 2201/20* (2013.01)

(58) Field of Classification Search
CPC ..... E03D 2001/20; E03D 11/13; E03D 9/085
(Continued)

(56) References Cited

U.S. PATENT DOCUMENTS 200,563 A * 2/1878 Naulty ..... E03D 9/032 4/232
4,873,730 A * 10/1989 Cuschera ..... E03D 11/16 285/56

(Continued)

FOREIGN PATENT DOCUMENTS

CN 215020754 U 12/2021

*Primary Examiner* — Janie M Loeppke
(74) *Attorney, Agent, or Firm* — Lempia Summerfield Katz LLC

(57) ABSTRACT

A toilet may include a base including a bowl, a rim disposed around a top of the bowl, and a seat rotatably coupled to the rim. The eat may include a top surface configured to support a user and a bottom surface opposite the top surface. In some examples, the top surface is disposed at an incline and the bottom surface is supported by the rim. In some example, a dampener including a softer material than the bowl and disposed within the bowl. In some examples, a bidet wand extends from the base and is configured to selectively change between a position for dispensing a flow of water for washing a user and a position for cleaning a surface of the bowl. In some examples, the toilet includes a floor connector including a channel formed by a first flange and a second flange.

17 Claims, 31 Drawing Sheets

(58) Field of Classification Search
USPC ..... 4/300.3
See application file for complete search history.

(56) References Cited

U.S. PATENT DOCUMENTS

| | | | | |
|---|---|---|---|---|
| 7,032,256 | B2 * | 4/2006 | Contadini | E03D 5/10 4/406 |
| 10,542,937 | B2 * | 1/2020 | Hall | A61B 10/00 |
| 11,041,292 | B1 * | 6/2021 | Herbert | E03D 9/00 |
| 2022/0346608 | A1 * | 11/2022 | Gill | A47K 13/24 |
| 2022/0408988 | A1 * | 12/2022 | Baines | E03D 9/002 |
| 2023/0193612 | A1 * | 6/2023 | Ogles | E03D 9/00 4/300.3 |

* cited by examiner

TOILET

CROSS-REFERENCE TO RELATED APPLICATIONS

This application claims priority benefit of Provisional Application No. 63/442,306 filed on Jan. 31, 2023, which is hereby incorporated by reference in its entirety.

FIELD

The present disclosure relates generally to toilets. More specifically, the present disclosure relates to toilets having features that improve the cleanliness, maintenance, and use thereof.

BACKGROUND

This application relates generally to the field of cleaning systems for use with toilets, accessibility of toilets, installations of toilets and accessories thereof. More specifically, this application relates to cleaning systems configured to dispense cleaning compounds for use in and around toilets and accessories thereof to improve the cleanliness in and around the toilets.

Overtime from use, scale (e.g., urine scale), minerals, bacteria, and other undesirable deposits (e.g., biofilm) build-up on the surfaces of toilets and, in particular, on the inner surfaces of the bowl and trapway. Moreover, these deposits may become lodged in small imperfections in the inner surfaces of the toilet, which may be a vitreous material. These built-up deposits can lead to undesirable odors and stains, as well as harbor germs and bacteria. It would be advantageous to provide a toilet having cleaning systems (e.g., internal, external) that provide improved cleanliness to address the aforementioned problems, such as prohibiting or reducing scale and/or providing odor abatement.

BRIEF DESCRIPTION OF THE DRAWINGS

Objects, features, and advantages of the present disclosure should become more apparent upon reading the following detailed description in conjunction with the drawing figures, in which:

FIG. 1 illustrates a toilet including a tank and FIG. 2 illustrates a non-skirted toilet according to another exemplary embodiment of the present disclosure.

The figures illustrate certain exemplary embodiments of the present disclosure in detail. It should be understood that the present disclosure is not limited to the details and methodology set forth in the detailed description or illustrated in the figures. It should be understood that the terminology used herein is for the purposes of description only and should not be regarded as limiting.

DETAILED DESCRIPTION

Figure 1:
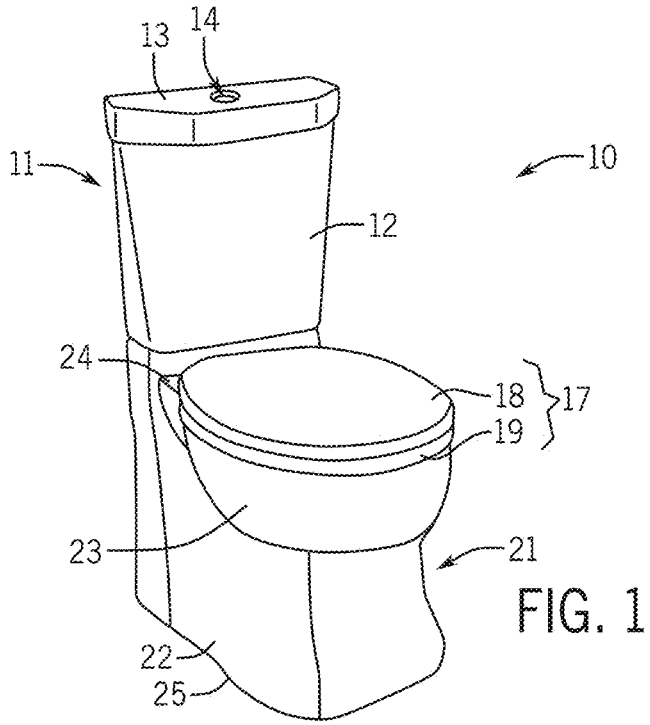
FIGS. 1 and 2 illustrate perspective views of exemplary embodiments of toilets according to the present disclosure. Specifically.
Figure 2:
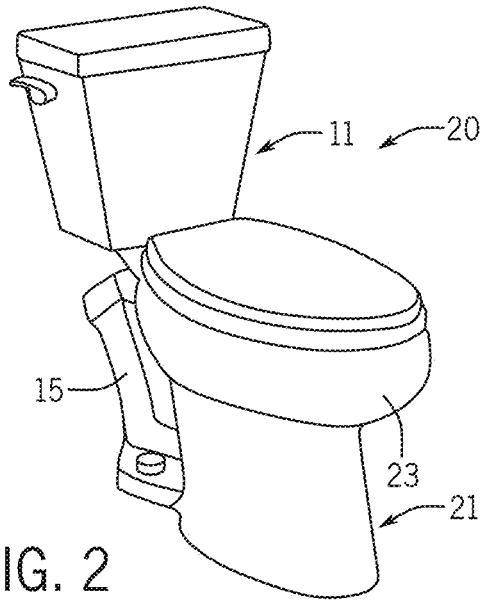

FIGS. 1 and 2 illustrate toilets according to exemplary embodiments of the present disclosure. FIG. 1 illustrates an exemplary embodiment of a skirted toilet 10 that includes a tank 11, a pedestal 21 (or base), a seat assembly 17 and a coupling or mounting assembly. The tank 11 may include a reservoir 12 for storing the water used during operational (or flushing) cycles, a lid (or cover) 13 for providing selective access into the reservoir 12, and an actuator 14 that is configured to initiate an operational cycle when activated. The actuator 14 or flush mechanism may be a button configured to activate when depressed (or pulled) a predetermined distance or when touched, a lever configured to activate when rotated a predetermined angular travel, or any suitable device configured to activate based upon an input manipulation by a user.

It should be noted that the shapes and configurations of the tank, pedestal, seat assembly, and the internal components (including the trapway and other features) may vary from the embodiments shown and described herein, and that the embodiments disclosed herein are not intended as limitations. It should be noted that various components of the toilet may be made of vitreous china. It should be noted that various components of the toilet may be polymeric and/or over molded or otherwise fixed to the toilet. It should be noted, for example, that although the exemplary embodiment of the toilet 10 is shown configured with the tank 11 formed separately from the pedestal 21 and later coupled to the pedestal, the tank may be integrally formed with the pedestal as a one-piece design. In other words, the toilet may be a one-piece design, a two-piece design, or have any suitable configuration. The toilet disclosed herein may have a wide variety of skirted toilet configurations, and all such configurations are intended to be encompassed herein. The following description of various toilet features is therefore intended as illustration only of one possible embodiment, and it should be understood by those reviewing the present description that similar concepts or features may be included in various other embodiments.

The tank 11 may include an inlet opening configured to receive water from a coupled water supply, such as from a hose (e.g., line, tube). The tank 11 may also include an inlet valve assembly or other device configured to control the flow of water from the water supply into the tank through the inlet opening. Within the tank 11 may be provided a float device for controlling the inlet valve assembly, such as by opening the valve to refill the reservoir 12 of the tank 11 after an operational cycle and closing the valve when the water in the reservoir 12 reaches a preset volume or height. The tank 11 may also include an outlet opening configured to transfer (e.g., conduct) the water stored in the reservoir 12 of the tank to the pedestal 21 upon activation of the actuator 14. The pedestal 21 may include toilet bowl 23. The tank 11 may include an outlet valve assembly or other device configured to control the flow of water from the tank into the pedestal 21 through the outlet opening.

The pedestal 21 (or base) of the toilet 10 may include a wall 22 having any suitable shape that is configured to form a bowl 23 having an opening formed by an upper rim at the top of the opening. The pedestal 21 may also be configured to include a plurality of walls having varying shapes that together form a bowl having an opening formed by a rim. The wall 22 of the pedestal may extend downward and/or rearward from the bowl 23 to form a lower portion 25 configured to support the pedestal 21 and the toilet 10. The lower portion 25 may be formed by the end (e.g., lower rim) of the wall 22, or may include a member that extends generally in a horizontal plane from one or more than one end of the wall. The pedestal 21 may also include a top member 24 that extends between two sides of the wall 22 (or between two opposing walls) and is provided rearward (or behind) the bowl 23, wherein the top member 24 forms a plateau for supporting the tank 11, such as the bottom surface of the reservoir 12 of the tank 11. The top member 24 may include an inlet opening that may be aligned with the outlet opening of the tank 11, such as when the tank 11 is coupled to (or resting above) the pedestal 21, wherein water is selectively transferred (e.g., conducted) from the tank 11 through the outlet opening of the tank to the pedestal 21 through the inlet opening of the pedestal 21, when the toilet is activated through the actuator 14. The outlet valve assembly may control the flow of water from the tank to the pedestal. The toilet may also include a gasket or seal that is provided between the tank 11 and the pedestal 21 to prohibit leaking. For example, a gasket may be provided between the outlet opening of the tank and the inlet opening of the pedestal to prohibit leaking between the tank and the pedestal.

The plateau formed by the top member 24 of the pedestal 21 may also provide for coupling of the seat assembly 17 to the pedestal 21 of the toilet 10. For example, the top member 24 may include one or more than one opening, wherein each opening is configured to receive a fastening device (e.g., bolt, screw, etc.) to couple (e.g., attach) the seat assembly 17 to the top member 24 of the pedestal 21. As another example, the top member 24 may include one or more than one fastening device (e.g., bolts, recessed nuts, etc.) integrally formed therein (i.e., already provided connected or coupled to the pedestal 21), wherein the fastening device may be used to couple or secure at least a portion of the seat assembly 17 to the pedestal 21.

The bowl 23 of the pedestal 21 may be configured to include a receptacle (e.g., sump) and an outlet opening, wherein the water and waste is collected in the receptacle until being removed through the outlet opening, such as upon activation of the actuator 14. The pedestal 21 may also include a pedestal internal passageway, such as a trapway, that connects the outlet opening or discharge outlet of the bowl 23 to a drain or soil pipe. The passageway, or trapway, generally includes a first portion, a second portion, and a weir separating the first and second portions. The first portion of the passageway may extend from the outlet opening of the bowl 23 at an upwardly oblique angle to the weir. The second portion of the passageway may extend from the weir downwardly to the exiting device, such as the drain or soil pipe.

Between operational cycles (e.g., flush cycles) of the toilet 10, the water (and waste) is collected in the first portion of the trapway (in addition to the receptacle of the bowl), such that the weir prohibits the water from passing past the weir and into the second portion of the trapway. A flushing cycle may begin upon activation of the actuator 14. Upon activation of the actuator, additional water (e.g., fresh water and or grey water) may be discharged into the bowl 23 of the pedestal 21, resulting in the flushing action and waste removal through the soil pipe. The flushing cycle may include generation of a siphon to assist the flushing action and waste removal.

The seat assembly 17 may include a cover member 18 (e.g., lid), a seat member 19 (e.g., ring member), and a hinge. The seat member 19 may be configured to include an annular member that encircles an opening, wherein the annular member provides a seating surface for the user of the toilet 10. The seat member 19 may also be pivotally coupled (e.g., attached) to the hinge, wherein the seat member may rotate (or pivot) about the hinge, such as between a first lowered or seated position and a second raised or upright position. The cover member 18 may be configured to be round, oval, or any other suitable shape. Typically, the profile or shape of the outer surface of the cover member will be configured to match (i.e., to be substantially similar) to the profile of the outer surface of the seat member to improve the aesthetics of the seat assembly and toilet. The cover member 18 may also be coupled to the hinge, wherein the cover member may rotate (or pivot) about the hinge, such as between a first down lowered or down position and a second raised or upright position. The cover member 18 may be provided above the seat member in the down position to thereby cover the opening of the seat member 19, as well as to conceal the inside of the bowl 23 of the pedestal 21. The cover member 18 may be configured to rest against the outside surface of the tank 11, when the cover member 18 is in the upright position, such that the cover member 18 remains in the upright position in order for a user to sit upon the seat member 19.

FIG. 2 illustrates a non-skirted toilet 20 according to another exemplary embodiment of the present disclosure. The internal components, including the trapway 15, are visible in the pedestal 21 of non-skirted toilet 20. It should be noted that the devices, methods, and systems described herein may include and/or be used with both skirted and non-skirted toilets. It should further be noted that devices, methods, and systems described herein may include or be used with both toilets including tanks and tankless toilets. A waterline may supply a tankless toilet with water during a flush cycle.

Referring generally to FIGS. 3-6, devices, systems, and methods for improving toilet accessibility are illustrated. The following devices, systems, and methods may advantageously improve the ease and comfort with which a variety of users are able to use a toilet. The following devices, systems, and methods may assist handicapped individuals, the elderly, and children in accessing the toilet. Additionally, the following devices, systems, and methods may improve comfort and a use experience for individuals of varying shapes and sizes (e.g., height, weight, and the like).

Figure 3:
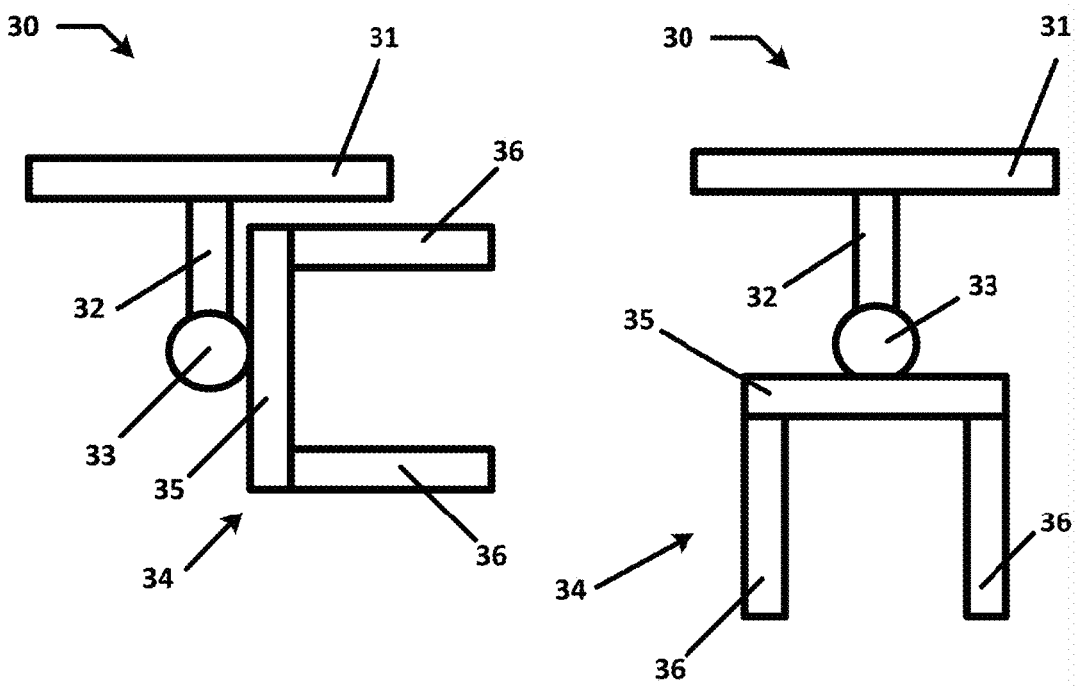
FIG. 3 illustrates an apparatus for moving an individual from a wheel chair to a toilet according to an exemplary embodiment of the present disclosure.

Referring to FIG. 3, an apparatus 30 for moving an individual from a seated position such as an individual in a wheel chair to a toilet is illustrated. The apparatus 30 may include a mounting bracket 31, an offset arm 32, a hinge 33, and a lift portion 34 having a lift frame 35 and lift arms 36. The apparatus 30 may be configured to lift a user via the lift arms 36 and rotate and/or translate the user to position on a toilet. The apparatus 30 may optionally be mounted to a wall proximate to a toilet. In another example, the apparatus may be secured to a column or stand configured to support the apparatus 30 located proximate to a toilet.

The mounting bracket 31 may be configured to mount or secure the apparatus 30 to a wall proximate to a toilet. For example, the mounting bracket 310 may mount or secure the apparatus 30 to wall located behind a toilet, such that the apparatus 30 is located above the toilet. In some examples, the mounting bracket 31 may mount or secure the apparatus 30 to a wall located behind a toilet such that the apparatus 30 is offset from the toilet (e.g., such that only a portion of the apparatus 30 is disposed above the toilet). The mounting bracket 31 may be composed of metal, plastic, wood or any combination thereof and may be configured to receive one or more fasteners for mounting or securing the mounting bracket to the wall. The mounting bracket 31 may have a shape allowing fasteners to be inserted through the mounting bracket 31 into multiple different mounting points (e.g., studs) in the wall.

The offset arm 32 may extend outward from the mounting bracket 31 and is configured to support the hinge 33 and lifting portion 34. During use, the offset arm is configured to support the weight of an individual in addition to the hinge 33 and lifting portion 34. In some examples, the offset arm 32 may be integrally formed with the mounting bracket 31. In other examples, an end of the offset arm 32 may be fixed, connected, or attached to the mounting bracket 31. The offset arm 32 may extend outward from the mounting bracket 31 such that the offset arm 32 is perpendicular to the mounting bracket 31 and/or the wall on which the apparatus 30 is mounted. In some examples, the offset arm 32 may be rotatably coupled to the mounting bracket 31 such that an angle between the mounting bracket 31 and offset arm 32 may be changed. The offset arm 32 may be composed of metal, plastic, wood, or any combination thereof. In some examples, the offset arms may be comprised of two or more components; the two or more components may be rotatably coupled together. In some examples, a portion of or the entire offset arm 32 may extend diagonally downward and outward.

The hinge 33 may be located at a distal end of the offset arm 32 opposite the mounting bracket 31. The hinge 33 may rotatably couple or connect the lifting portion 34 to the offset arm 32. The hinge 33 may be configured to allow the mounting portion to rotate relative to the offset arm 32. In some examples, the hinge 33 may be integrally formed with one of the offset arm 32 or the lift frame 35 of the lift portion 34. In some examples, the hinge may include one or more ball bearings.

The lift portion 34 includes a lift frame 35 and lift arms 36 and is configured to move an individual from a wheel chair to a toilet. The lift portion 34 is configured to rotate via the hinge 33 relative to the offset arm 32 and/or the mounting bracket 31. The lift frame 35 may be coupled or connected to the hinge 33. In some examples, the hinge 33 or a portion of the hinge 33 may be integrally formed with the lift frame 35.

The one or more lift arms 36 may be configured to lift or raise a user. In some examples, each of the lift arms 36 may be configured to be held by a user and held on to during lifting and/or movement of the user. In other examples, each of the lift arms 36 may be configured to be positioned in an armpit of the user in order to lift and/or move the user. After the lifting arms 36 have been positioned in the armpits of a user or the user has gripped the lifting arms 36, the offset arm may lift a user. One or more electric motors may be configured to lift the offset arm 32. In some examples, the offset arm 32 may be begin and remain in a horizontal position while the user is lifted. Specifically, the offset arm 32 may translate vertically (e.g., along the mounting bracket 31) while remaining horizontal. In other examples, an end of the offset arm 32 connected to the mounting bracket 31 may remain in the same position and an electric motor may be configured to lift a distal end of the offset arm 32; in a lifted position the offset arm 32 may be disposed at an angle with respect to a horizontal axis.

After a user has been lifted, the apparatus 30 may rotate and/or translate so that a user may be positioned on a toilet. In some examples, as illustrated in FIG. 3, the apparatus 30 may include two lift arms 36. In other examples, the apparatus 30 may include three or more arms. The lifting arms 36 may be secured or connected to the lift frame 35. For example, one lift arm 36 may be secured to each end of the lift frame 35. In some examples, the lift arms 36 may be configured to move along the length of the lift frame 35. For examples, the lift arms 36 may move closer to one another to accommodate a smaller user and/or further away from one another to accommodate a larger user.

Accordingly, the apparatus 30 may be configured to lift a user from seated position (e.g., in a wheel chair) and move or transport them to a toilet. In other examples, an apparatus for moving a user may be mounted on a wall and lift a user while translating along a surface of the wall without rotating. Such an apparatus may include, for example, a track disposed on the wall at an angle with respect to a horizontal axis and the apparats may translate along the track to lift or move a user to a toilet.

Figure 4:
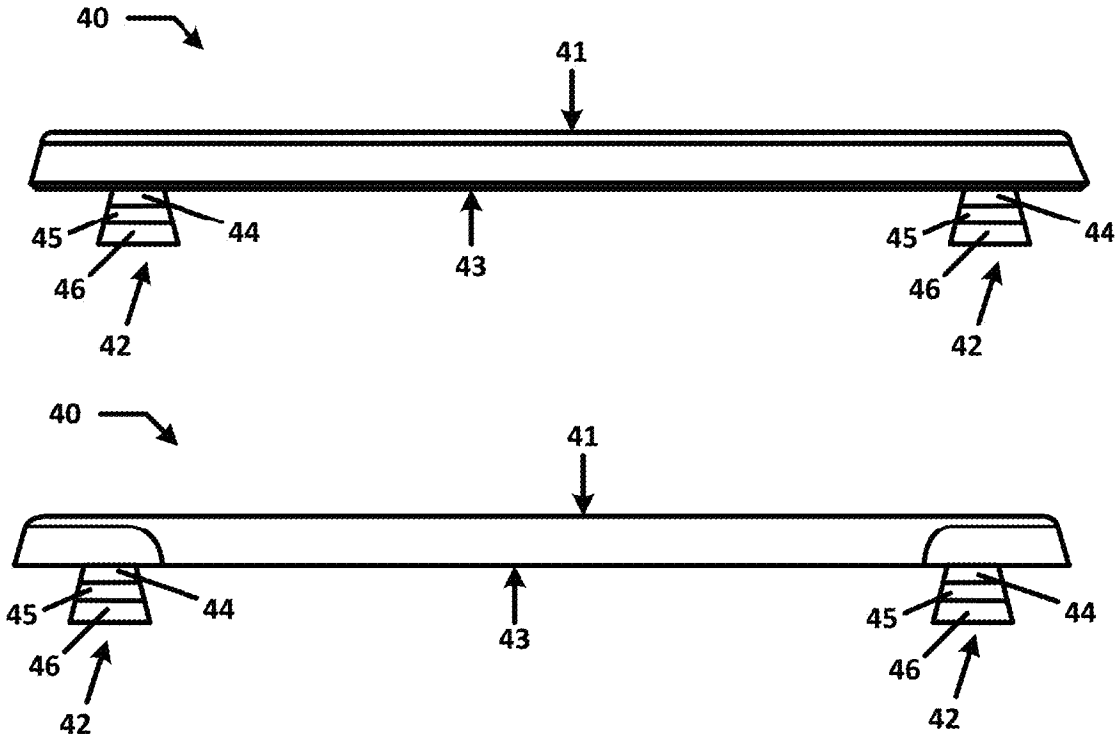
FIG. 4 illustrates an adjustable height toilet seat according to an exemplary embodiment of the present disclosure.

Referring to FIG. 4, an adjustable height toilet seat 40 is illustrated. A position of the toilet seat 40 may be adjusted to improve user comfort and experience for users of different heights. The toilet seat 40 includes a top surface 41 and one or more lifts 42. A hinge or hinge assembly may secure the toilet seat 40 to a base (e.g., 21) of the toilet. The one or more lifts 42 may be secured or attached to the bottom surface 43 of the seat 40. The one or more lifts 42 may be configured to selectively adjust the height of the seat 40, specifically, the top surface 41 of the seat. The one or more lifts 42 may adjust the height of the seat without having to change a hinge or hinge assembly used to secure the seat 40 to the base of the toilet.

Each of the one or more lifts 42 may include one or more telescoping members. For example, as illustrated in FIG. 4, the each of the one or more lifts 42 may include three telescoping members 44, 45, and 46. The shape of the telescoping member 44, 45, 46 may vary. For example, as illustrated in FIG. 4, the telescoping members 44, 45, 46 may have a circular or cylindrical shape. In other examples, the telescoping members 44, 45, 46 may have a rectangular shape. Each of the telescoping members may have a different cross sectional area so that the telescoping members may fit or nest inside one another. For example, the telescoping member 46 may have a larger cross sectional area than the telescoping member 45 so that the telescoping member 45 may fit or nest into the telescoping member 46. Additionally, the telescoping member 45 may have a larger cross sectional area than the telescoping member 44 so that the telescoping member 44 may fit or nest into the telescoping member 45.

The telescoping members 44, 45, 46 may be selectively arranged to either reside or nest inside other telescoping members 44, 45, 46 or protrude from other telescoping members 44, 45, 46. When the telescoping members 44, 45, 46 extend from other telescoping members, as opposed to nesting within them, a total length of the nesting members 44, 45, 46 and thus a height of the lift 42 may be increased. A locking mechanism may be used to maintain a position of each of the telescoping members relative to one another. For example, a clamp, or a twisting lock may be used to maintain a position of the telescoping members 44, 45, 46 relative to one another. Accordingly, the height of a top surface 41 of the seat may be adjusted by changing the orientation of the telescoping members 44, 45, 46 and locking a position of the telescoping members 44, 45, 46 relative to one another.

As illustrated in FIG. 4, the lifts 42 of the toilet seat include three telescoping members 44, 45, 46; however, the present disclosure is not limited thereto, and additional telescoping members may be included. In other examples, one or more stackable toilet seats may be used to increase the height at which a user sits. A bottom surface of a stackable toilet seat may be configured to enclose or surround a top surface or a portion of a top surface of the stackable seat so that the stackable seats may be placed on top of one another without moving. One or more grooves and protrusions may be used to secure a position of the stackable seats. A user may sit on a top surface of the top seat.

Figure 5:
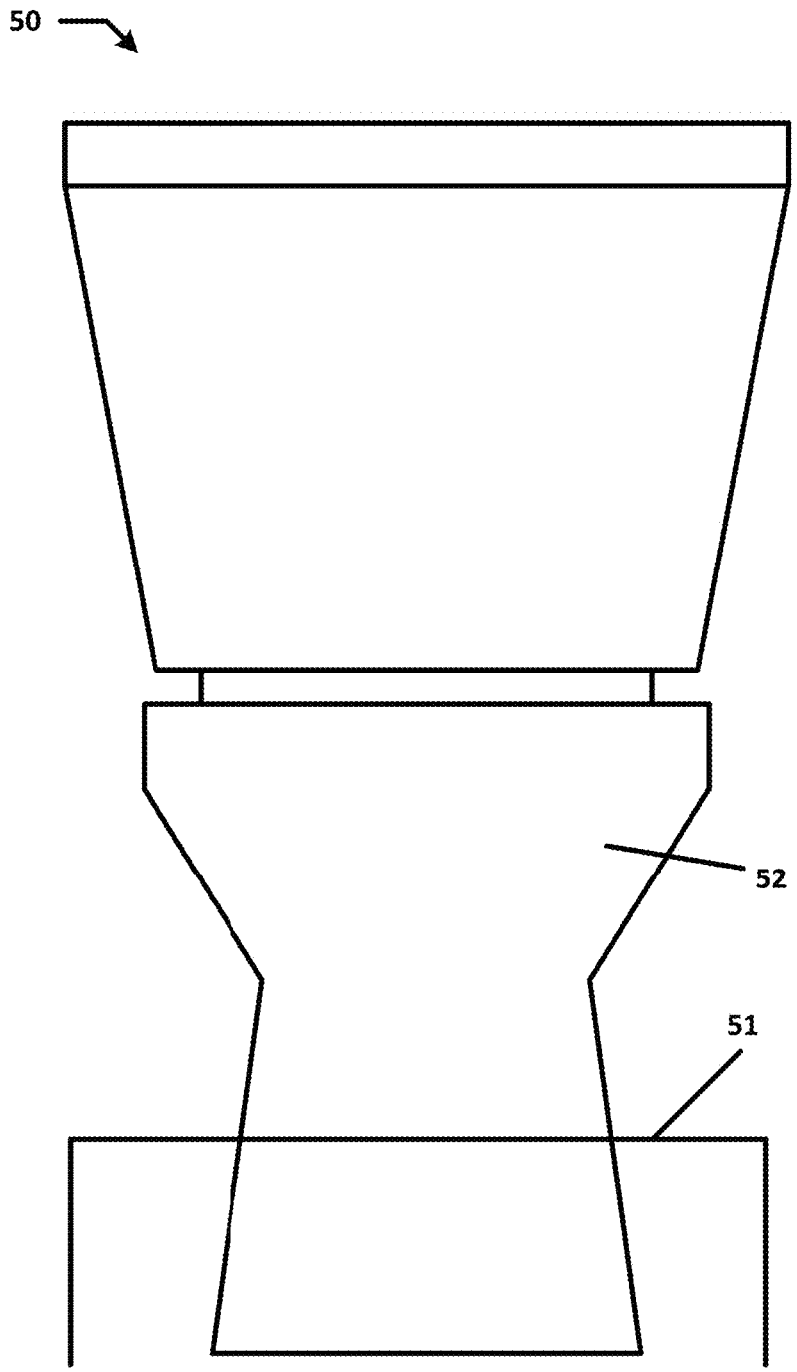
FIG. 5 illustrates a toilet including a ledge according to an exemplary embodiment of the present disclosure.

Referring to FIG. 5, a toilet 50 including a ledge 51 is illustrated. The ledge 51 may allow a small user (e.g., a child) to more easily get on and/or off of the toilet 50. Additionally, a user may place their feet on the ledge 51 to achieve a more comfortable or natural posture while using the toilet 50.

The ledge 51 may extend from a pedestal or base 52 of the toilet 50. The base 52 may be the same as the base or pedestal 21 described above with respect to FIGS. 1 and 2. In some examples, the ledge 51 may be integrally formed with the base 52. In some examples, the ledge 51 may be over onto the base 52. In other examples, the ledge may be attached or connected to the base 52. In some examples, the ledge 51 may be comprised of vitreous china and/or polymeric material. The ledge 51 may be comprised of the same material as the base 52. In other examples, the ledge 51 may be comprised of metal, plastic, or a combination thereof. As illustrated in FIG. 5, the toilet 50 includes one ledge 51; however, the present disclosure is not limited thereto. For example, two or more ledges 51 may be included. In one example, two or more ledges 51 may be included to provide multiple steps allowing a user to reach a seat of the toilet 50.

In some examples, the ledge 51 may be selectively moved between an extended position and a collapsed position. For example, a hinge may rotatably connect one end of the ledge 51 to the base 52 and a support arm may extend upward and outward diagonally to support a second end of the ledge 51. Selectively moving the ledge 51 between an extend position and a collapsed position may allow the ledge 51 to be stored when not in use.

Figure 6:
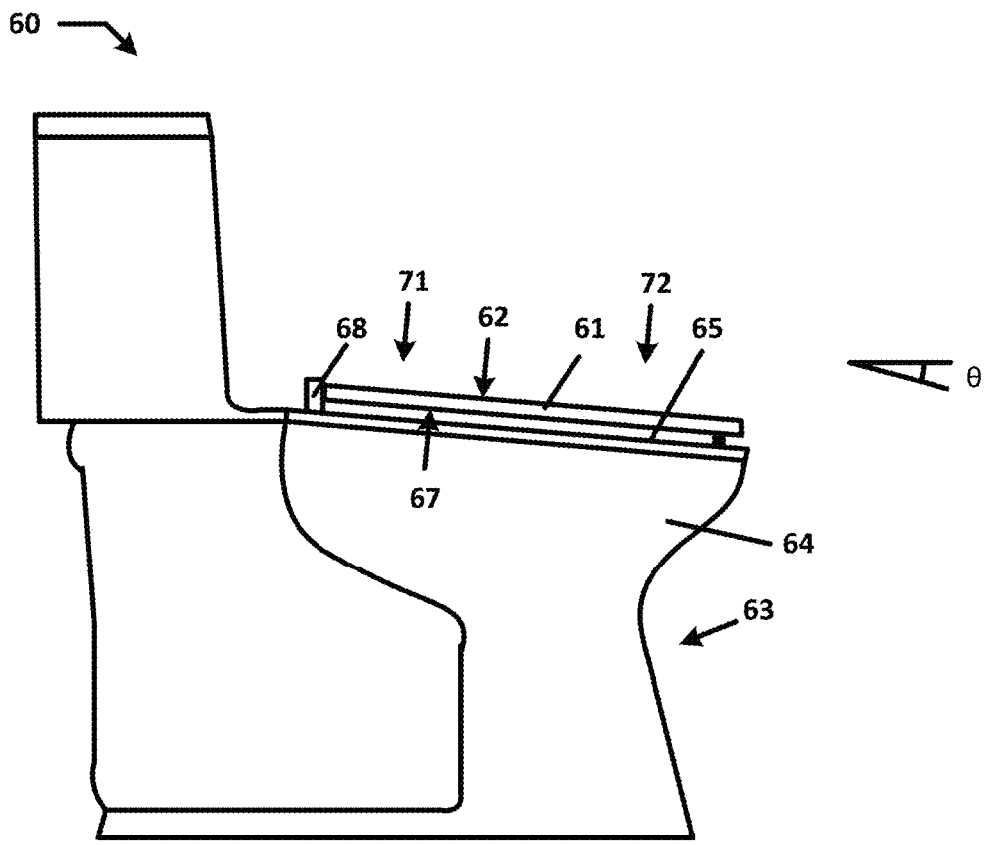
FIG. 6 illustrates a toilet including a seat having an inclined top surface according to an exemplary embodiment of the present disclosure.

Referring to FIG. 6, a toilet 60 including a seat 61 having an inclined top surface 62 is illustrated. As illustrated in FIG. 6, the top surface 62 at a back portion 71 of the seat 61 may be located above the top surface 62 at a front portion 72 of the seat 61. The inclined top surface 62 of the seat may be configured to comfortably accommodate users of various heights. For example, comfort for a relatively short user may be improved when sitting on the relatively low top surface 62 toward a front portion 72 of the seat 61. Conversely, comfort for a relatively tall individual may be improved when sitting on the relatively high top surface 62 toward a back portion 71 of the seat 61.

As illustrated in FIG. 6, the toilet 60 includes a base 63 including a bowl 64 and a rim 65 disposed around a top of the bowl 64. The toilet 60 further includes a seat 61 rotatably coupled to the rim 65 via hinge 68. The base 63 may be the same as pedestal or base 21 as described above with respect to FIGS. 1 and 2. The bowl 64 may be the same as bowl 23 described above with respect to FIGS. 1 and 2. The rim 65 may define an opening of the bowl 64.

The hinge 68 may rotatably couple the seat 61 to the rim 65 of the toilet 60. In some examples, the toilet 60 may further include a cover. The hinge 68 may rotatably couple a cover to the rim 65 of the toilet 60.

The seat 61 includes a top surface 62 configured to support a user and a bottom surface 67 opposite the top surface 62. The seat 61 may be comprised of plastics, such as polypropylene (PP), polyethylene, polycarbonate, or other similar materials. In other examples, the seat may be comprised of other materials. Then the seat 61 is in a lowermost position, the top surface 62 of the seat is disposed at an incline. The top surface 62 may be disposed at an incline such that a top surface 62 of the seat at a back portion 71 of the seat 61 may be disposed above the top surface 62 at a front portion of the seat 61. When the seat 61 is in a lowermost position, the bottom surface 67 of the seat may be supported by the rim 65. One or more elements or components, for example bumpers may be disposed between the bottom surface 67 of the seat 61 and the rim 65 while a bottom surface 67 of the seat is supported by the rim 65.

In some examples, the rim 65 of the toilet 60 may be disposed along or parallel to a horizontal axis. When the rim 65 of the toilet 60 is disposed along or parallel to a horizontal axis, the bottom surface 67 of the seat 61 may also be disposed along or parallel to a horizontal axis when the seat is in a lowermost position. In these examples, a thickness of the seat 61 may vary to achieve an incline along the top surface 62 of the seat 61. Specifically, a distance or height of the seat 61 between the top surface 62 and the bottom surface 67 may increase along the seat 61 from a front or front portion 72 of the seat 61 to the back or back portion 71 of the seat 61.

In other examples, the rim 65 of the toilet 60 may be disposed at an incline. In these examples, a thickness of the seat 61 may be uniform and the top surface 62 and bottom surface 67 of the seat 61 may be parallel to the rim 65 when the seat 61 is in a lowermost position. Specifically, the rim 65 may support the bottom surface 67 of the seat such that both the bottom surface 67 and top surface 62 of the seat are disposed at the same inclination as the rim 65. The base 63 of the toilet 60 may be manufactured to include a rim 65 disposed at an incline.

In some examples, an inclination angle between the top surface 62 of the seat 61 in a lowermost position and a horizontal axis may be between 0 degrees and 30 degrees. In other examples, an inclination angle between the top surface 62 of the seat 61 in a lower most position and a horizontal axis may be between 5 degrees and 25 degrees. In yet other examples, an inclination angle between the top surface 62 of the seat 61 in a lower most position and a horizontal axis may be between 10 degrees and 20 degrees.

In examples where the rim 65 is disposed at an incline, an inclination angle between the rim 65 and a horizontal axis may be between 0 degrees and 30 degrees. In other examples, an inclination angle between the rim 65 and a horizontal axis may be between 5 degrees and 25 degrees. In yet other examples, an inclination angle between the rim and a horizontal axis may be between 10 degrees and 20 degrees.

The top surface 62 of the seat 61 may not be planar. For example, an outer edge of the seat 61 may be disposed above an inner edge of the seat 61. The outer edge of the seat 61 may be an edge furthest from the bowl 64 and the inner edge of the seat may be an edge closest to the bowl 64. Accordingly, in some examples when it is stated that a top surface 62 at a back portion 71 of the seat 61 is above the top surface 62 at a front portion 72 of the seat 61, the entire top surface 62 at a back portion 71 of the seat may not be above the entire top surface 62 at a front portion 72 of the seat 61, but rather an average elevation or height of the top surface 62 at a back portion 71 may be greater than an average height or elevation of the top surface at a front portion 72. In other examples, the entire top surface 62 at a back portion 71 of the seat 61 may be located above the entire top surface 62 at a front portion 72 of the seat 61.

Referring generally to FIGS. 7-13, devices, systems, and methods for reducing splashing or splash back that may occur during use of a toilet are illustrated. The following devices, systems, and methods may improve toilet cleanliness and the cleanliness of surfaces proximate to a toilet by reducing splash back. In some examples, the following devices, systems, methods may reduce the frequency with which the toilet and/or surfaces proximate to the toilet need to be cleaned.

Figure 7:
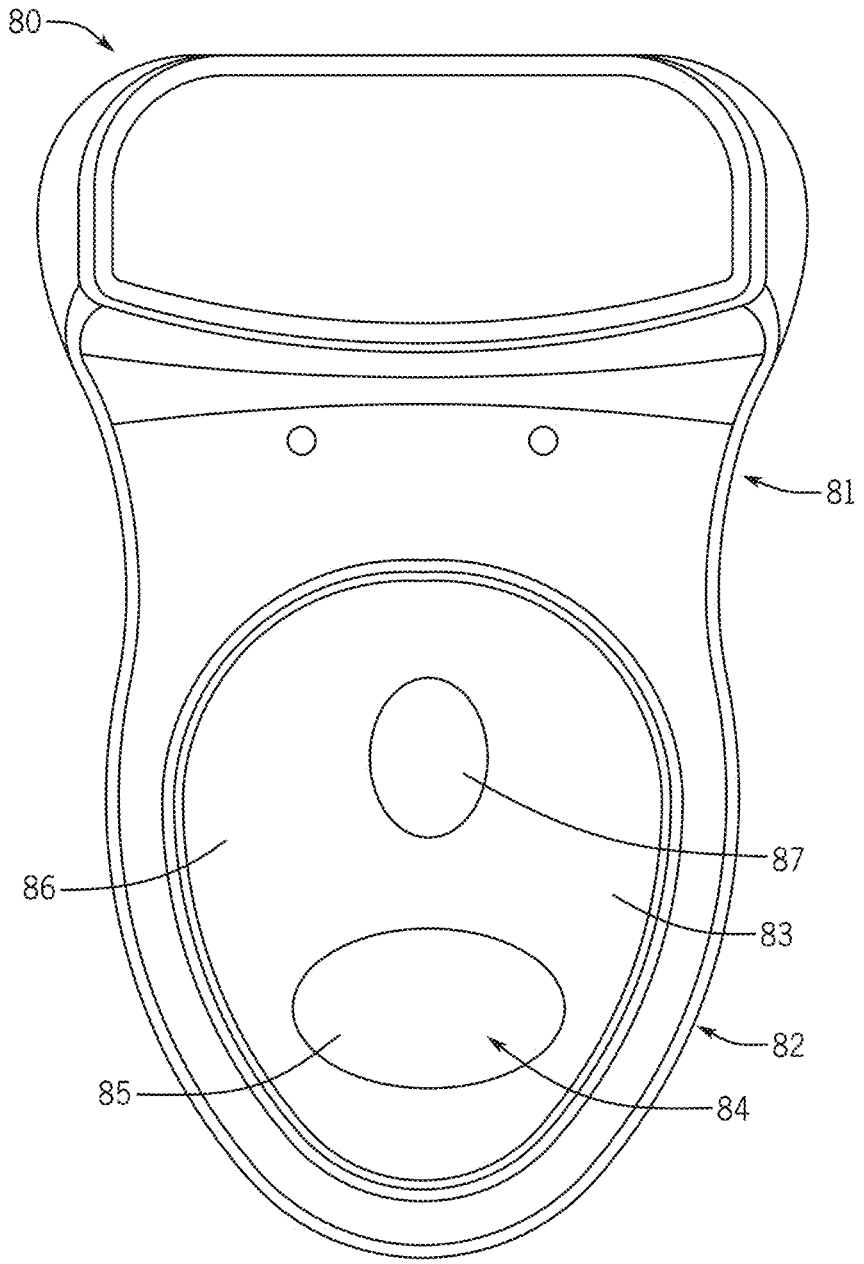
FIG. 7 illustrates a toilet including a dampener according to an exemplary embodiment of the present disclosure.

Referring to FIG. 7, a toilet 80 including a dampener 84 is illustrated. The dampener 84 may be disposed within a bowl structure 82 and be comprised of a softer material than the bowl structure 82. The term "softer" may be defined as a lower hardness as measured by a durometer (e.g., Shore durometer). The dampener 84 may reduce splash back occurring when the toilet 80 is used by softening a portion of the bowl inner surface 86. In some examples, the toilet 80 may include two or more dampeners 84. The dampener 84 may be attached to or integrally formed with the bowl structure inner surface.

The toilet 80 may include a base 81 having a bowl structure 82. The bowl structure 82 may include a bowl structure inner surface 83. The toilet may further include a dampener 84 having a dampener inner surface 85, a bowl inner surface 86 defined by the bowl structure inner surface 83 and the dampener inner surface 85, and a discharge outlet 87. The base 81 may be the same as the pedestal or base 21 as described above with respect to FIGS. 1 and 2.

The bowl structure 82 may include one or more walls (e.g., wall 22) forming a bowl within the base 81 of the toilet. The bowl structure 82 may include a bowl structure inner surface 83. The bowl structure inner surface 83 may be an exposed surface of the bowl structure on an interior of the base 81. In some examples, the bowl structure inner surface 83 may include one or more indentations or recesses. Each of the indentations or recesses may be configured to receive a dampener 84. In some examples, the bowl structure 82 and/or base 81 may be comprised of vitreous china.

In some examples, a toilet (e.g., toilet 80) may include one or more dampeners 84. The one or more dampeners 84 may be integrally formed with the base 81 and/or the bowl structure 82. For example, the dampener 84 may be over molded on to the base 81 and/or the bowl structure 82. In other examples, the one or more dampeners 84 may be formed separately from base 81 and/or bowl structure 82 and attached to the bowl structure 82 by the manufacturer of the toilet. However, it is also envisioned that one or more dampeners 84 may be sold as after-market add-on products capable of being installed on a toilet by a user or technician. The dampener 84 may be configured to be attached to the bowl structure inner surface 83.

The dampener 84 may be comprised of a material that is softer than a material comprising the bowl structure 82. For example, the dampener 84 may have a lower hardness rating on the Mohs hardness scale than the bowl structure 82. The dampener 84 may be comprised of a polymer. For example, the dampener 84 may be comprised of silicone. The size and/or shape of the dampener may vary. For example, the dampener may have a cylindrical shape, an elliptic cylinder shape, a cuboid shape, or the like.

The dampener 84 may be integrally formed with the bowl structure 82, attached to the bowl structure 82, or configured to be attached to the bowl structure 82. The dampener 84 may be attached to the bowl structure 82 using an adhesive or a coupling device. The coupling device may include a snap fit connector, an anchor, or a hook.

The dampener may include a dampener inner surface 85. The dampener inner surface 85 may be an exposed surface of the dampener 84 within the bowl structure 82 when the dampener 84 is integrally formed with or attached to the bowl structure 82. The dampener inner surface 85 may be coextensive with the bowl structure inner surface 83. The shape of dampener inner surface 85 may vary. For example, the dampener inner surface 85 may have a circular shape, elliptic shape, rectangular shape, or the like. Other shapes of the dampener inner surface 85 are possible. Additionally, a thickness of the dampener 84 may vary. Specifically, a distance from the dampener inner surface 85 to a back surface of the dampener 84 may vary.

In some examples, the toilet may include two or more dampeners 84. The position of the dampener 84 in the bowl structure 82 may vary. For example, one or more dampeners 84 may be located on a front portion of the bowl structure 82. For example, one or more dampeners 84 may be located between a front of the bowl structure 82 and the discharge outlet 87. In other examples, one or more dampeners may be located in a back portion of the bowl structure 82. For example, one or more dampeners 84 may be located between the back of the bowl structure 82 and the discharge outlet 87. In other examples, one or more dampeners 84 may be located on either side of the bowl structure 82. For example, one or more dampeners 84 may be located on either the left side or the right side of the discharge outlet 87. One or more dampeners 84 may be located in different positions. For example, one or more dampeners 84 may be located on a front portion of the bowl structure 82 and one or more dampeners 84 may be located on and a back portion of the bowl structure 82.

Figure 8:
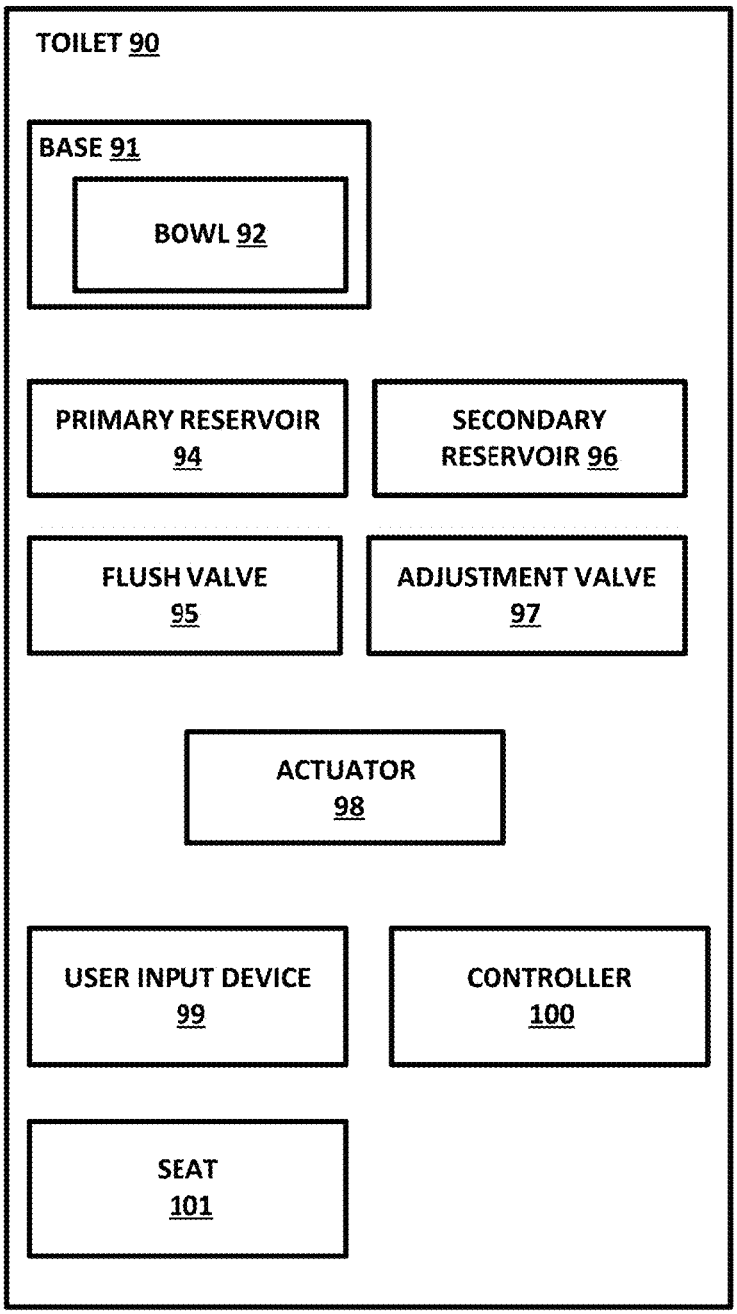
FIG. 8 illustrates an adjustable fill toilet according to an exemplary embodiment of the present disclosure.

Referring to FIG. 8, an adjustable fill toilet 90 is illustrated. The toilet 90 may be configured to selectively increase a water line or water level in the bowl 92 of the toilet without initiating a siphon or flushing sequence of the toilet 90. In some examples, after a flush cycle the toilet 90 may have a relatively low or reduced waterline or head. The relatively low head may advantageously reduce splashing during toilet use; however, having a relatively low head may reduce the waste removal performance of the toilet 90. Accordingly, the toilet 90 may selectively increase the waterline or head in the toilet to selectively attain the advantages of a toilet having a relatively low head or the advantages of a toilet having a relatively high head.

The toilet 90 includes a base 91 having a bowl 92, a primary reservoir 94, a flush valve 95, a secondary reservoir 96, and an adjustment valve 97. In some examples, the toilet 90 may additionally include an actuator 98. In other examples, the toilet 90 may additionally include a user input device 99, a controller 100, and/or a seat 101. The base 91 of the toilet 90 may be the same as the base or pedestal 21 described above with respect to FIGS. 1 and 2. The bowl 92 may be the same as the bowl 23 described above with respect to FIGS. 1 and 2.

In some examples, the primary reservoir 94 may be the same as the reservoir 12 described above with respect to FIG. 1. In some examples, the primary reservoir 94 may be located in a tank (e.g., tank 11) of the toilet 90. The first reservoir 94 may be configured to contain or hold a first water supply. The first water supply may be a water supply used during a flush cycle of the toilet 90. Specifically, during a flush cycle of the toilet 90, the flush valve 95 may be opened and the first water supply may flow from the primary reservoir 94 through the flush valve 95 and into the bowl 92 of the toilet 90. In some examples, the first water supply may trigger a siphon in the toilet 90 as it flows into the bowl 92. During the flush cycle a first portion of the first water supply may travel through and out of the toilet 90 and a second portion of the first water supply may remain and refill the bowl 92. In some examples, additional water, for example, water flowing into the primary reservoir 94 through a refill valve may be included in the first water supply. Accordingly, the second portion of the first water supply remaining in the bowl after a flush cycle may create an initial or first waterline or head in the toilet 90. The volume of the first water supply may variously modified to control a first waterline or head in the bowl 92.

The flush valve 95 may be configured to control a flow of the first water supply from the primary reservoir 94 to the bowl 92. The flush valve 95 may be disposed between the primary reservoir 94 and the bowl 92. The flush valve 95 may be a solenoid valve, a canister flush valve, a flapper valve, a float, or the like.

The secondary reservoir 96 may be configured to contain or hold a second water supply. The secondary reservoir 96 may be separate from the primary reservoir 94 such that the first water supply and the second water supply are maintained separate from one another. In some examples, the secondary reservoir 96 may be disposed in a tank (e.g., tank 11) of the toilet 90. The second water supply may be a water supply configured to change or adjust a waterline or head in the bowl 92. A volume of the second water supply may be variously modified to control a second waterline or head in the bowl 92.

The adjustment valve 97 may be configured to control a flow of the second water supply from secondary reservoir 96 to the bowl 92. The adjustment valve 97 may be disposed between the secondary reservoir 96 and the bowl 92. The adjustment valve may be a solenoid valve, a flapper valve, a float, or the like.

In some examples, the toilet 90 may further include an actuator 98. The actuator 98 may be configured to open the adjustment valve 97 allowing a flow of the second water supply to flow through the adjustment valve 97 and into the bowl 92. The second water supply may not initiate a siphon or a flush cycle of the toilet 90 when the second water supply flows into the bowl 92. When the second water supply flows into the bowl 92 the waterline or head of the bowl may be adjusted or increased from the first waterline to a second waterline. When the second water supply flows into the bowl 92 the head of the bowl may be increased from a first head to a second head.

In some examples, the actuator 98 may be a lever configured to open the adjustment valve 97 when it is rotated by a used to a predetermine angular position. In other examples, the actuator 98 may be a button configured to open the adjustment valve 97 when it is pushed or depressed by a user. The actuator 98 is an actuator for the adjustment valve 97 and may not initiate or influence operation of the flush valve 95. The actuator 98 may be mechanically coupled to the adjustment valve 97. For example, one or more links, such as levers, chains, and the like may mechanically couple the actuator 98 to the adjustment valve 97.

In some examples, the toilet 90 may further include a user input device 99 and a controller 100. In these examples, the adjustment valve 97 be an electrically controlled valve such as a solenoid valve. The user input device 99 may be configured to receive a user input. In some examples, the user input device 99 may be a weight sensor and the user input may be a weight of a user. In other examples, the user input device 99 may be a proximity device, such as a capacitive sensor, and the user input may be a presence of a user. In yet other examples, the user input device may be a button, touch screen, or the like and the user input may be physical contact with the button or touch screen.

The user input device 99 may be electrically connected to the controller 100. The user input device 99 may send a signal to the controller 100 when a user input is received. The controller 100 may send a signal or electric current to the adjustment valve 97, causing the adjustment valve 97 to open in response to the user input. When the adjustment valve 97 opens the second flow of water may flow from the secondary reservoir 96 to the bowl 92, increasing the waterline or head of the toilet from a first waterline to a second waterline.

The controller 100 may receive commands or instructions from a mobile device (e.g., mobile app) such as a cell phone, tablet, smart phone, laptop, or remote control. The mobile device may specify a duty cycle or timing for the adjustment valve. The mobile device may provide configuration settings.

In some examples, the toilet 90 may further include a seat 101. The toilet seat 101 may be the same as the seat member 19 described above with respect to FIG. 1. The seat 101 may be rotatably coupled to the base 91 of the toilet 90. In some examples, the user input device 99 may be a sensor configured to detect the presence of a user on the seat 101. For example, the user input device 99 may be a weight sensor or a proximity sensor, such as a capacitive sensor configured to detect the presence of a user on the seat 101. The user input device 99 may be integrated with or attached to the seat 101. In some examples, a user input of the user input device may be the presence and/or weight of a user on the seat 101.

In some examples, the bowl 92 of the toilet may further include a decal or image indicating an optimal location in the geometry to prevent splash back from occurring. The decal or image may be integrally formed in the bowl 92. For example, the decal may be formed and fired into the bowl 92 during manufacture of the bowl 92.

In some examples, the toilet 90 may further include a dispenser configured to dispense an additive or a cleaning solution into water in the bowl 92. The dispenser may be electrically coupled to the controller 100 and/or the flush valve 95. The dispenser may be configured to dispense the additive or cleaning solution during a flush cycle of the toilet 90. For example, the dispenser may dispense the additive or cleaning solution at an end of the flush cycle. The additive may be a solution configured to increase the viscosity of water in the bowl 92. Increasing the viscosity of water in the bowl 92 may reduce splash back.

Figure 9:
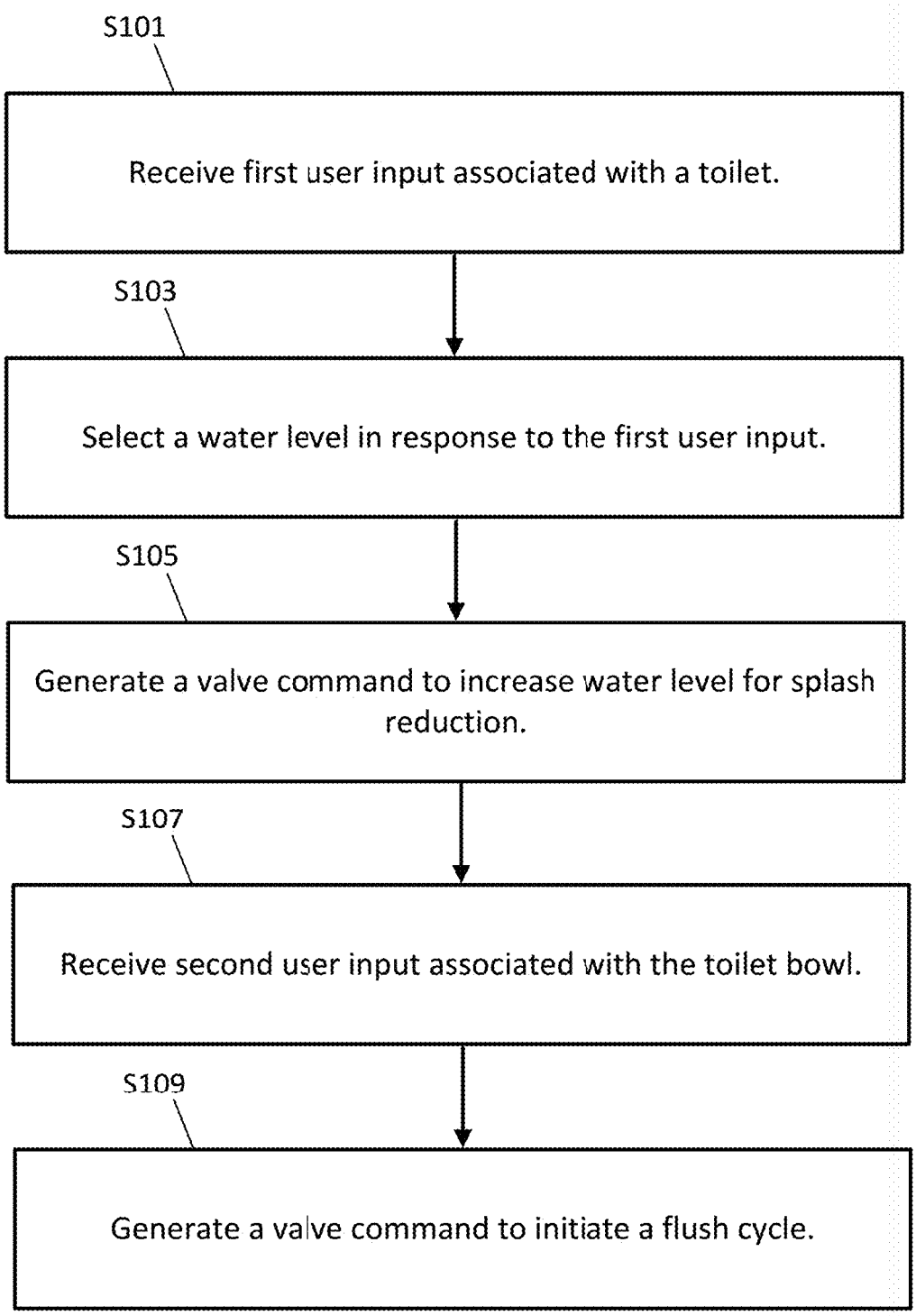
FIG. 9 illustrates a flowchart for operation of the adjustable fill toilet.

Referring to FIG. 9, a flowchart for operating the adjustable water line toilet is shown. The controller 100 may operate the toilet in a first mode, in which the water level in the toilet bowl 92 is adjusted to reduce splashing, and a second mode, where the toilet bowl 92 is flushed. Additional, different, or fewer components may be included.

At act S101, the user input device 99 or the controller 100 receives a user input associated with the toilet bowl 92. At act S103, the controller 100 selects a water level in response to the user input. The user input may include a gesture or a keypress. The user input may originate with a mobile device of the user based on wireless communication between the mobile device and the controller 100. There may be only one alternative water level to select. That is, the controller 100 may select an elevated water level or an anti-splash water level. Alternatively, there may be multiple alternative water levels. For example, multiple users of the toilet may select personalized water level. The controller 100 may identify the user from the user input (e.g., login, mobile device handshake or beacon, face recognition, or a biometric signature). The controller 100 access the user's selected water level in response to the user input.

At act S105, the controller 100 generates a valve command for the adjustment valve 97 in response to the user input. Through opening the adjustment valve 97 a flow of water is provided to the toilet bowl 92 for the selected water level. The increased water level reduces splash in the toilet bowl 92. Splash may be reduced as a result of the reduction in distance that waste falls from the user to the water in the toilet bowl 92. A shorter fall causes less splash.

At act S107, the controller 100 receives a second user input. The second user input could be the user standing up from the toilet bowl 92 or walking away from the toilet bowl 92. The second user input may be sensor data that indicates the user is no longer present (e.g., presence sensor, motion sensor, camera). The second user input may be from sensor data that indicates there is a change in weight on the seat of the toilet bowl 92. That is, when a weight sensor embedded or otherwise associated with the toilet seat provides a measurement below a threshold value, the controller 100 may determine that the user has stood up or left the toilet bowl 92.

At act S109, the controller 100 sends a second valve command to the flush valve 95 to flush the toilet in response to the second user input. In other words, the controller 100 initiates a flush cycle for the toilet after the weight of the user is removed from the toilet seat. In another example, the sequence from the first mode to the second mode not based on sensor data but rather based on a time delay sequence. The controller 100 transitions from adjusting the water level (first mode) to flushing the toilet (second mode) after a predetermined amount of time has passed.

In some examples, an auxiliary mechanism may be needed to maintain an increased water level in the toilet bowl 92. The auxiliary mechanism may increase the height of the weir in the trapway. The auxiliary mechanism may temporarily block or partially block the sump or the trapway in order to prevent water from training from the toilet bowl 92, thereby increasing the water level in the toilet bowl 92.

Figure 10:
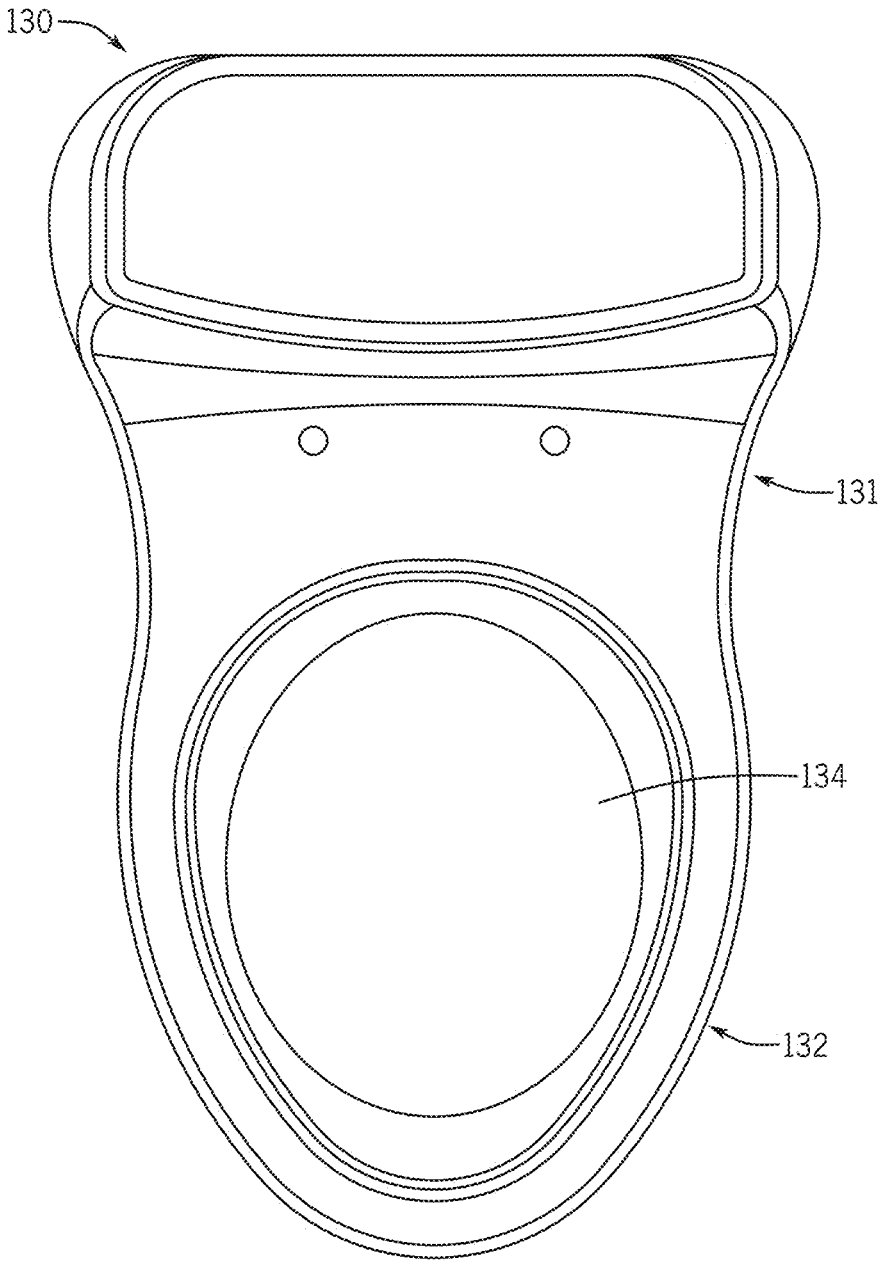
FIG. 10 illustrates a toilet including a water spot cover according to an exemplary embodiment of the present disclosure.

Referring to FIG. 10, a toilet 130 including a water spot cover 134 is illustrated. The water spot cover 134 may be arranged on a top surface of water present in the bowl 132. During use of the toilet 130, waste entering the bowl 132 may make contact with the water spot cover 134 before making contact with water in the bowl 132. The water spot cover 134 may reduce splashing by decreasing a force with which waste entering the bowl 132 contacts water in the bowl 132.

The toilet 130 may include a base 131 including a bowl 132 and water spot cover 134. The base 131 may be the same as the base or pedestal 21 described above with respect to FIGS. 1 and 2. The bowl 132 may be the same as the bowl 23 as described above with respect to FIGS. 1 and 2.

The water spot cover 134 may be disposed on a top surface of water within the bowl 132. In some examples, the water spot cover 134 may float on a top surface of the water in the bowl 132. The water spot cover 134 may be comprised of a biodegradable material. In some examples, the water spot cover 134 may be comprised of paper or another fibrous material. The size and or shape of the water spot cover 134 may vary. For example, the water spot cover 134 may have a circular shape, oval shape, rectangular shape, hexagon shape, or the like. In some examples, the water spot cover 134 may cover a majority of the top surface of the water in the bowl 132. In other examples, the water spot cover may be configured to cover less than half of the top surface of the water in the bowl 132. The water spot cover 134 may be comprised of a material that allows the water spot cover 134 to be flushed down the toilet during a flush cycle of the toilet 130.

Figure 11:
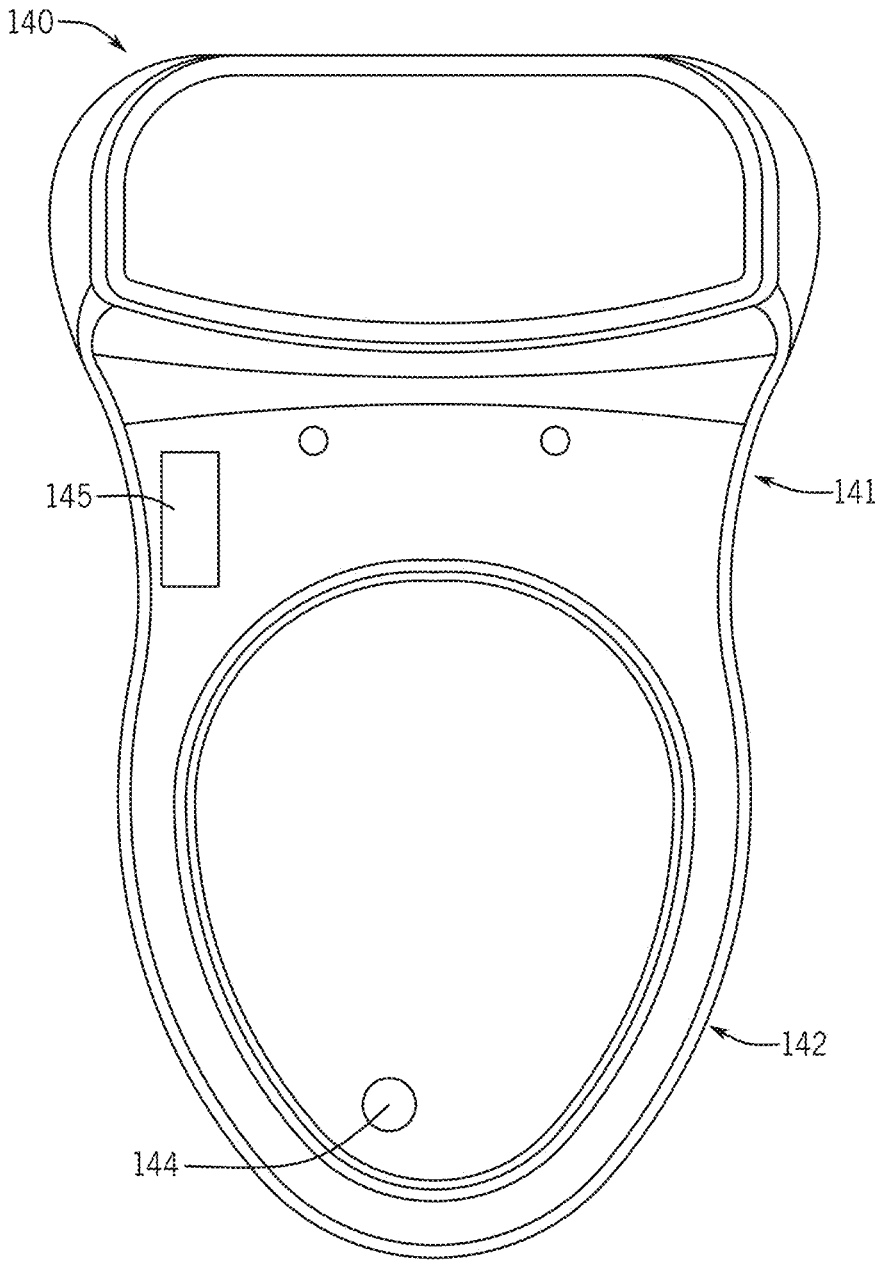
FIG. 11 illustrates a toilet including an aerating opening according to an exemplary embodiment of the present disclosure.

Referring to FIG. 11, a toilet 140 including an aerating opening 144 is illustrated. The aerating opening 144 is an example splash prevention device connected to the bowl 142 of the toilet 140. The aerating opening 144 may introduce air into water in the bowl 142 of the toilet 140. As the air exits the water in the bowl 142 through a top surface of the water, the air may break or otherwise reduce a surface tension of the water, thereby reducing splash back occurring during use of the toilet 140.

The toilet 140 may include a base 141 having a bowl 142, an aerating opening 144, and an air pump 145. The base 141 may be the same as the base or pedestal 21 described above with respect to FIGS. 1 and 2. The bowl 142 may be the same as the bowl 23 as described above with respect to FIGS. 1 and 2.

The aerating opening 144 may be disposed on an inner surface of the bowl 142. The location of the aerating opening 144 may vary. For example, the aerating opening may be located on the inner surface of the bowl at a front portion, back portion, or side portion of the bowl 142. In some examples, the toilet 140 may include two or more aerating openings 144. The aerating opening 144 is configured to introduced air into water disposed in the bowl 142 of the toilet 140. In some examples, the aerating opening 144 may continuously introduce air into the water. In other examples the aerator opening may intermittently introduce air into the water.

The air pump 145 is configured to provide or supply air to the aerator opening 144. The air pump 145 may be an electric air pump. The air pump 145 may be connected to the aerator opening 144 using a hose or conduit. A hose, tube, or conduit connecting the air pump 145 to the aerator opening 144 may be disposes in the base 141. The hose or conduit may be comprised of plastic or another material. In some examples, a single air pump 145 is connected to two or more aerator openings 144. In these examples a hose or conduit may connect the air pump 145 to each aerator opening 144. In some examples, the toilet 140 may include multiple air pumps 145 (e.g., an air pump 145 for each aerator opening 144). In some examples, the air pump 145 may be disposed in the base 141 of the toilet 140. In other examples, the air pump 145 may be attached to base 141.

Figure 12:
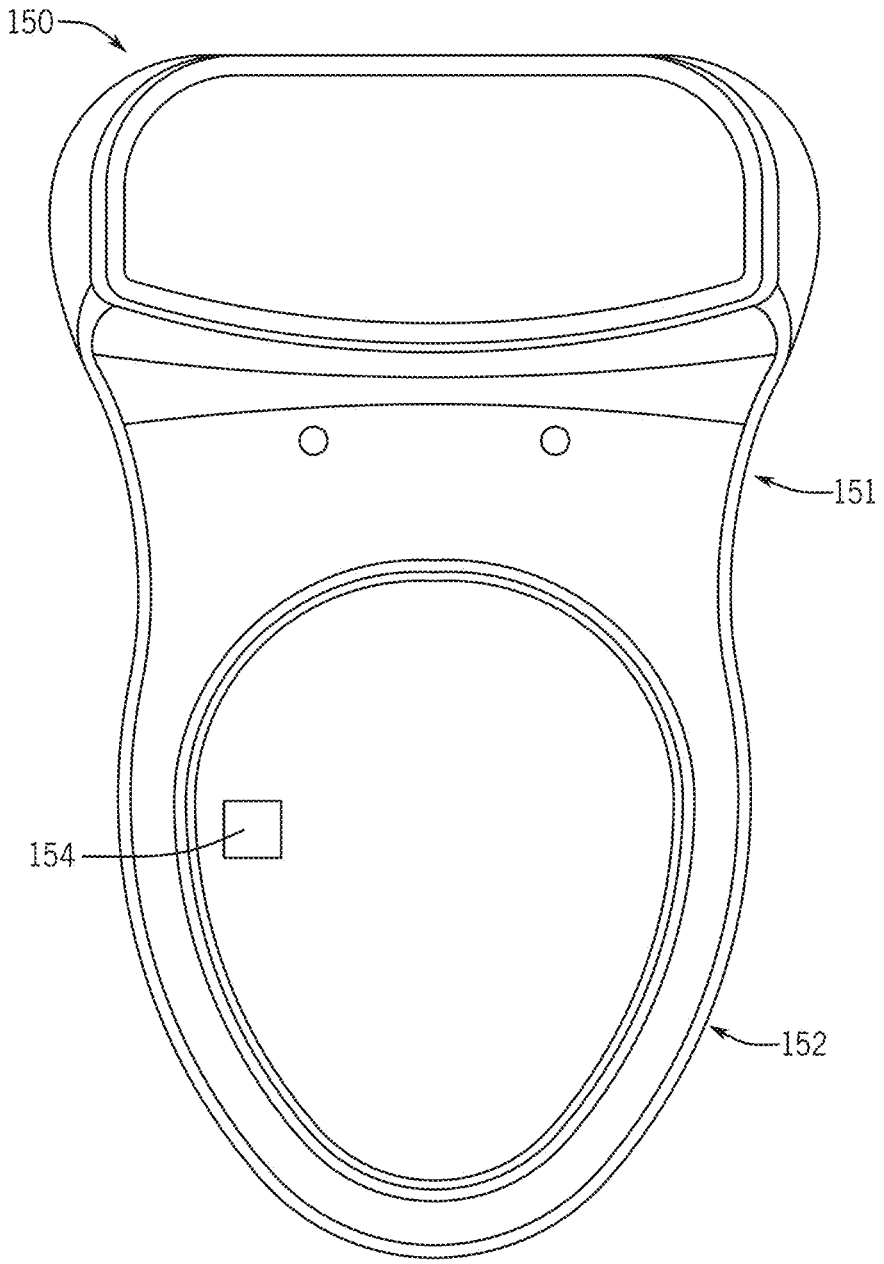
FIG. 12 illustrates a toilet including an agitation device according to an exemplary embodiment of the present disclosure.

Referring to FIG. 12, a toilet 150 including an agitation device 154 is illustrated. The agitation device 154 is an example splash prevention device connected to the bowl 142 of the toilet 140. The agitation device 154 may agitate or disturb water in the bowl 142 of the toilet 150, breaking the surface tension of the water. Accordingly, the toilet 150 may reduce splash back occurring during use of the toilet 150 by breaking the surface tension of the water in the bowl 152.

The toilet 150 may include a base 151 having a bowl 152 and an agitation device 154. The base 151 may be the same as the base or pedestal 21 described above with respect to FIGS. 1 and 2. The bowl 152 may be the same as the bowl 23 as described above with respect to FIGS. 1 and 2.

In some examples, the water agitation device 154 may be a recirculating pump. The recirculating pump may include an inlet port and an outlet port and be configured to agitate water in the bowl 152 by recirculating or continuously pumping a portion of the water in and out of the bowl 152. The recirculating pump may be an electric pump and may be disposed within the base 151. Each of the inlet port and outlet port may be disposed on an inner surface of the bowl 152. The inlet port and outlet port may fluidly connect the recirculating pump to the bowl. In some examples, the recirculating pump may continuously operate to recirculate water in the bowl 152. In other examples, the recirculating pump may operate intermittently.

In other examples, the water agitation device 154 may be a vibration device or vibration generator. The vibration device may include one or more weights and an electric motor. In some examples, the toilet 150 may include two or more vibration devices. The vibration device may be disposed in the base 151 or bowl 152 of the toilet 150. At least one surface of the vibration device may be in contact with water in the bowl 152. While operating (e.g., vibrating), the vibration device may agitate or disturb the water in the bowl 152 breaking a surface tension of the water. In some examples, the vibration device may continuously operate to agitate water in the bowl 152. In other examples, the vibration device may operate intermittently.

In some examples, the water agitation device 154 may be connected to a sensor and/or a button. The sensor and/or button may control operation of the agitation device 154, such that the agitation device 154 only operates when activated by a user. In some examples, a proximity sensor may detect the presence of a user. The proximity sensor may activate the agitation device 154 for a predetermined period of time after a user is detected or for a duration of time that the user is detected. In other examples, a button may activate the agitation device 154. The agitation device 154 may operate for a predetermine period of time after the button is operated (e.g., pushed, depressed, etc.). In some examples, a controller may control operation of the water agitation device 154.

Figure 13:
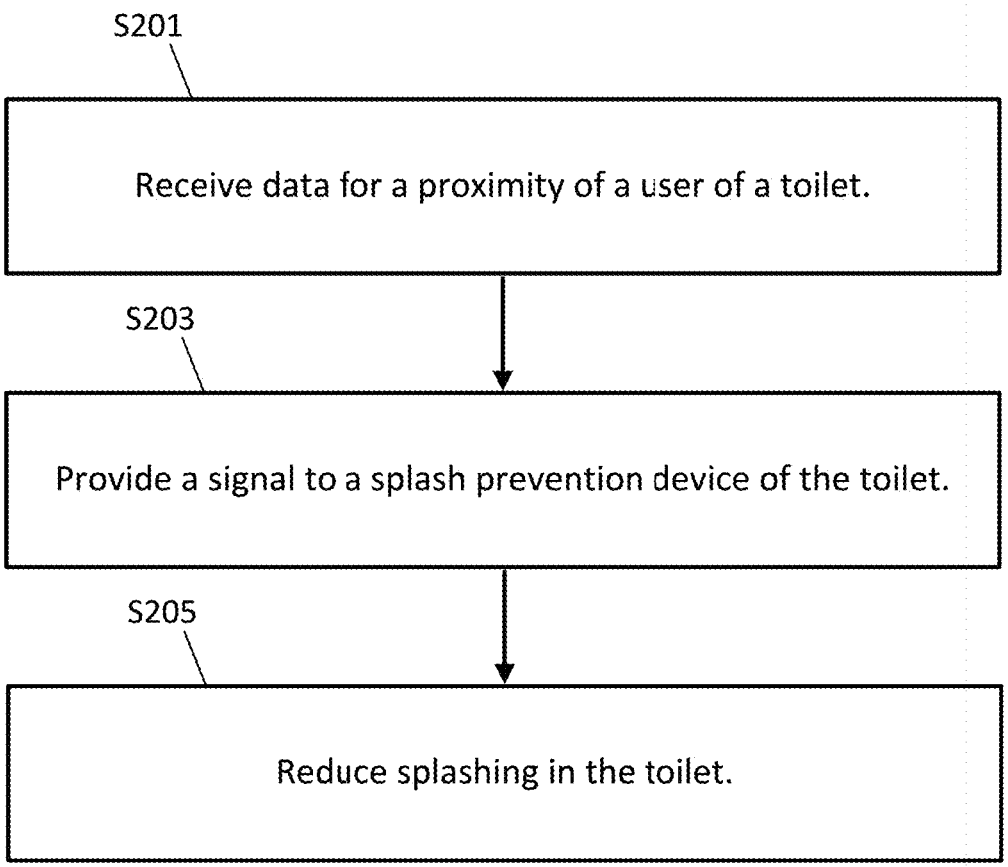
FIG. 13 illustrates a flowchart for operation of the splash prevention devices.

FIG. 13 illustrates a flowchart for the operation of the splash prevention device to reduce the amount of splash when liquid or objects fall to the water in the toilet bowl. Additional, different, or fewer acts may be included.

At act S201, the controller 100 receives sensor data for a proximity of a user from the proximity sensor. In addition or in the alternative, a motion sensor, a camera, or other sensors may detect the present of the user. The controller 100 may receive commands or instructions from a mobile device (e.g., mobile app) such as a cell phone, tablet, smart phone, laptop, or remote control. The mobile device may provide user inputs to activate the splash prevention device.

At act S203, the controller 100 provides a power signal or a command signal to a splash prevention device in response to the sensor data. The splash prevention device may include one or more of the examples described herein.

As act S205, the splash prevention device disturbs the surface of the water, such as by altering the surface tension of the water. Because the surface tension is already broken, subsequent objects or liquids that fall into the water cause a reduced splash.

Figure 14:
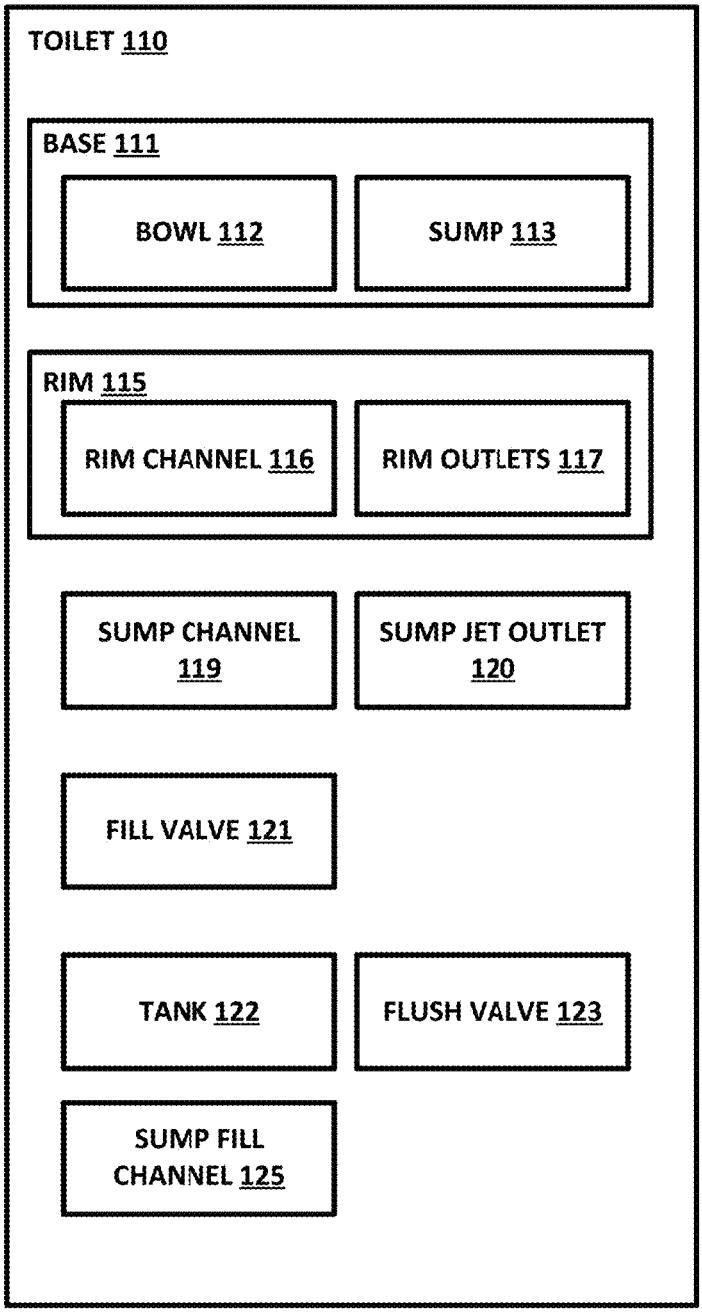
FIG. 14 illustrates a toilet including a fill valve capable of controlling a portion of water provided to a rim channel and a portion of water supplied to a sump channel according to an exemplary embodiment of the present disclosure.

Referring to FIG. 14, a toilet 110 including a fill valve 121 capable of controlling a portion of a supply of water provided to the rim outlets 117 and a portion of the supply of water provided to the sump jet outlet 120 during a fill operation of the toilet 110 is illustrated. The portion of the supply of water provided to the rim outlets 117 may be used to rinse an inner surface of the bowl 112. The portion of the supply of water provided to the sump jet outlet 120 may initiate a siphon and improve waste removal and drain line carry of the toilet 110. Accordingly, controlling the portions of the supply of water provided to the rim outlets 117 and the sump jet 120, respectively, may improve bowl rinse, improve drain line carry, and/or reduce a quantity of water used during a flush cycle.

The toilet 110 includes a base 111 having a bowl 112 and a sump 113 disposed at a bottom of the bowl, a rim 115 having a rim channel 116 and rim outlets 117, a sump channel 119, a sump jet outlet 120, and a fill valve 121. The base 111 may be the same as the base or pedestal 21 as described above with respect to FIG. 1. The bowl 112 may be the same as the bowl 23 described above with respect to FIG. 1. The sump 113 may be disposed at a bottom of the bowl 112. Water may be collected in the sump 113 before exiting through an outlet opening of the bowl 112 during a flush cycle.

The rim 115 may surround a top opening of the bowl 112. The rim 115 may include a rim channel 116 and rim outlets 117. The rim channel 116 may be fluidly connected to each of the rim outlets 117. The rim channel may be configured to supply water to each of the rim outlets 117. The rim outlets 117 may be fluidly connected to the rim channel 116 and the bowl 112, such that water exiting the rim outlets 117 flows onto an inner surface of the bowl 112. In some examples, the rim channel 116 may extend all the way around the rim 115.

The sump channel 119 may be fluidly connected to the rim channel 116. The sump channel 119 may be connected to the rim channel 116 such that water does not always flow from the rim channel 116 to the sump channel 119. For example, the sump channel 119 may be connected to the rim channel 116 at an elevation or height above the rim outlets 117 such that water only flows into the sump channel 119 if a predetermined amount of water is present in the rim channel 116. In another example, the sump channel 119 may be connected to the rim channel 116, for example, at a front of the toilet 110, such that water only flows into sump channel 119 if a flow rate water into the rim channel 116 exceeds a maximum total flow rate through all of the rim outlets 117. Water may only flow from the rim channel 116 to the sump channel 119 if water is supplied to the rim channel 116 faster than it may be outlet by the rim outlets 117. Water may only flow from the rim channel 116 to the sump channel 119 if water is supplied to the rim channel 116 is above a predetermined height or level defined by the rim channel 116 or a junction between the rim channel 117 and rim outlets 117. The sump channel 119 may be fluidly connected to the sump jet outlet 120. Water supplied to the sump channel 119 may flow through the sump channel 119 to the sump jet outlet 120. In another example, water may only flow to the sump channel 119 when at least one of the rim outlets is at capacity. The structure or physical dimensions of the rim outlets may define the capacity of the rim outlets.

The sump jet outlet 120 may be fluidly connected to the sump 113 and the sump channel 119. Water outlet from the sump jet outlet may flow into the sump 113. Water outlet from the sump jet outlet 120 may prime or initiate a siphon in the toilet 110 and assist in waste removal and drain line carry of the toilet 110.

The fill valve 121 may be configured to control a portion of a supply of water provided to the rim outlets 117 and a portion of the supply of water provided to the sump jet outlet 120 during a fill operation of the toilet 110. The toilet 110 may further include a tank 122 and a flush valve 123. The tank 122 may be the same as the tank 11 described above with respect to FIG. 1. The tank 122 may be configured to store water for flushing the toilet 110. When a flush cycle is initiated, the flush valve 123 may open and the stored water may flow through the flush valve 123 into the rim channel 116. Some of the water stored in the tank 122 may flow through the rim outlets 117 and some of the water may flow through the sump channel 119 and the sump jet outlet 120. As the stored water flows through the flush valve 123, a fill operation of the toilet 110 may begin and the fill valve 121 may begin to supply water to the toilet 110. The flush valve 123 may be a solenoid valve, a canister flush valve, a flapper valve, a float, or the like.

The fill valve 121 may supply a first flow of water to the rim channel 116 and a second supply of water directly to the sump channel 119. The fill valve 121 may be configured to control a portion of the supply of water supplied to the toilet provided to the rim channel 116 and the sump channel 119, respectively. The fill valve 121 may split a supply of water between the rim channel 116 and the sump channel 119. For example, the fill valve 121 may control a volume or a percentage of the total supply of water supplied to the toilet 110 provided to each of the rim channel 116 and the sump channel 119. For example, the first flow of water may have a larger volume than the second flow of water. In another example, the second flow of water may have a larger volume the first flow of water. In one example, the first flow may comprise 65% of the water supplied to the toilet during a fill operation and the second flow may comprise 35% of the water provided to the toilet during the fill operation. In another example, the first flow may comprise 35% of the water supplied to the toilet during a fill operation and the second flow may comprise 65% of the water provided to the toilet during the fill operation.

In some examples, the fill valve 121 may supply the first flow of water to the tank 122 and the first flow of water may flow through the tank 122 and the rim channel 116 and out of the rim outlets 117 into the bowl 112. In other examples, the 121 may supply the first flow of water directly to the rim channel 116. A conduit may directly couple the fill valve 121 to the rim channel 116. In some examples, the toilet 110 may further include a sump fill channel 125. The sump fill channel 125 may be directly fluidly coupled to the fill valve 121 and the sump channel 119. The fill valve 121 may supply the second flow of water to the sump fill channel 125.

Figure 15:
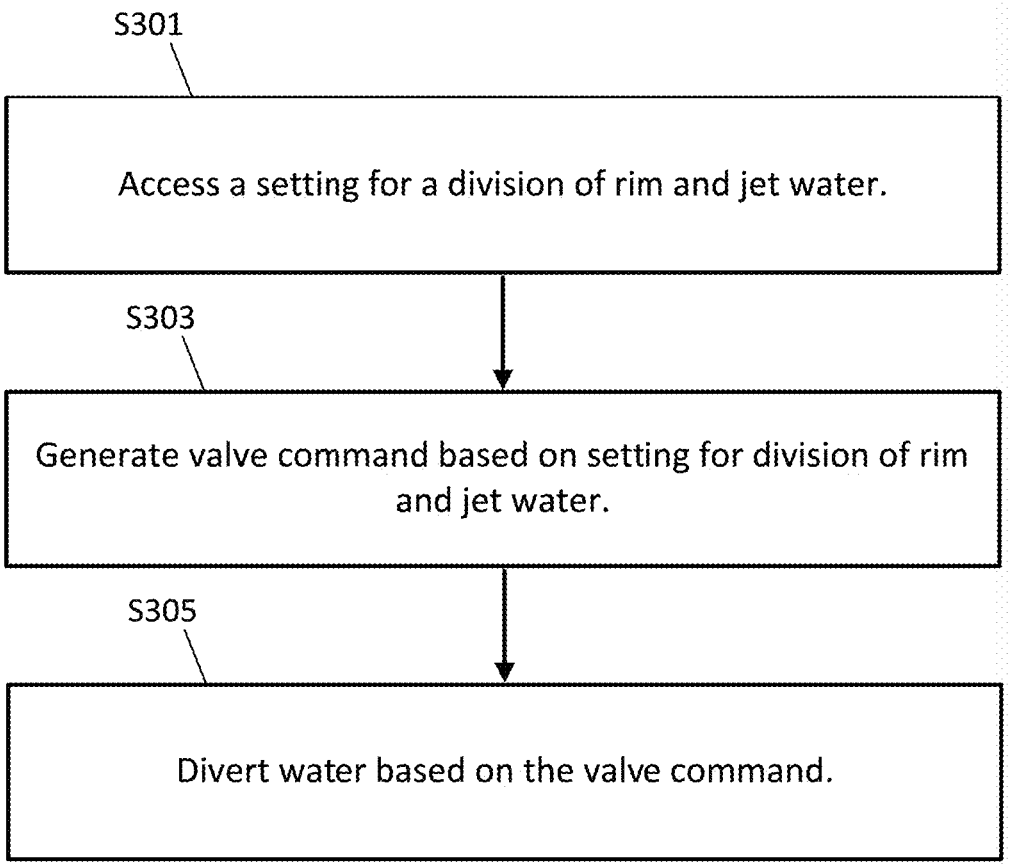
FIG. 15 illustrates a flowchart for operation of the fill valve of FIG. 14.

FIG. 15 illustrates an example flowchart for flushing a toilet in which a set portion of the water is diverted to a sump jet according to electronic control. Additional, different, or fewer acts may be included.

At act S301, the controller 100 receives or accesses a setting for division of rim water and sump water. The setting may be specified by a user. The setting may be a default setting. The controller 100 may determine an identifier for a user. The controller 100 may identify the user from the user input (e.g., login, mobile device handshake or beacon, face recognition, or a biometric signature). The controller 100 may access the user's selected setting for the division of rim water and sump water in response to the user input. Alternatively, the setting may only designate that the division between rim water and sump water will be used.

The controller 100 may receive commands or instructions from a mobile device (e.g., mobile app) such as a cell phone, tablet, smart phone, laptop, or remote control. The mobile device may specify the setting for the division of rim water and sump water.

In another example, the ratio is selected based on the cleanliness of the bowl. Again, in this example, the user may input an indication that the bowl is dirty (e.g., a dirty button). Alternatively, a sensor may be configured to detect cleanliness of the bowl. The sensor may be a camera or other image sensor that detects when there is "streaking" or other waste remains on the bowl. The controller 100 may calculate the ratio between the first supply of water and the second supply of water based on the cleanliness of the bowl (i.e., the level of waste or dirt detect by the sensor).

At act S303, the controller 100 generates a valve command in response to the user input. The valve command may set a ratio between the rim water and the sump water. The ratio may be defined by absolute values between the flow rate of the rim water and the flow rate of the sump water. The ratio may be defined by a first percentage of water from the tank for the rim water and a second percentage of water from the tank for the sump water.

At act S305, sump water is diverted or otherwise divided from the rim water based on the valve command. The controller 100 may also use a feedback system to actively control or adjust the valve command based on the detected flow of water. The controller 100 may communicate with a flow sensor configured to generate sensor data for the first flow of water or the second flow of water. The flow sensor may be mounted or otherwise placed inside or near the sump channel or the rim channel. A flow sensor may be used in each channel. The controller 100 may analysis feedback data from the one or more flow sensors to determine if the predetermined ratio of water flows is being achieved. When the sensor deviates from the predetermined ratio, the controller 100 re-calculates and reimplements the valve command.

Figure 16:
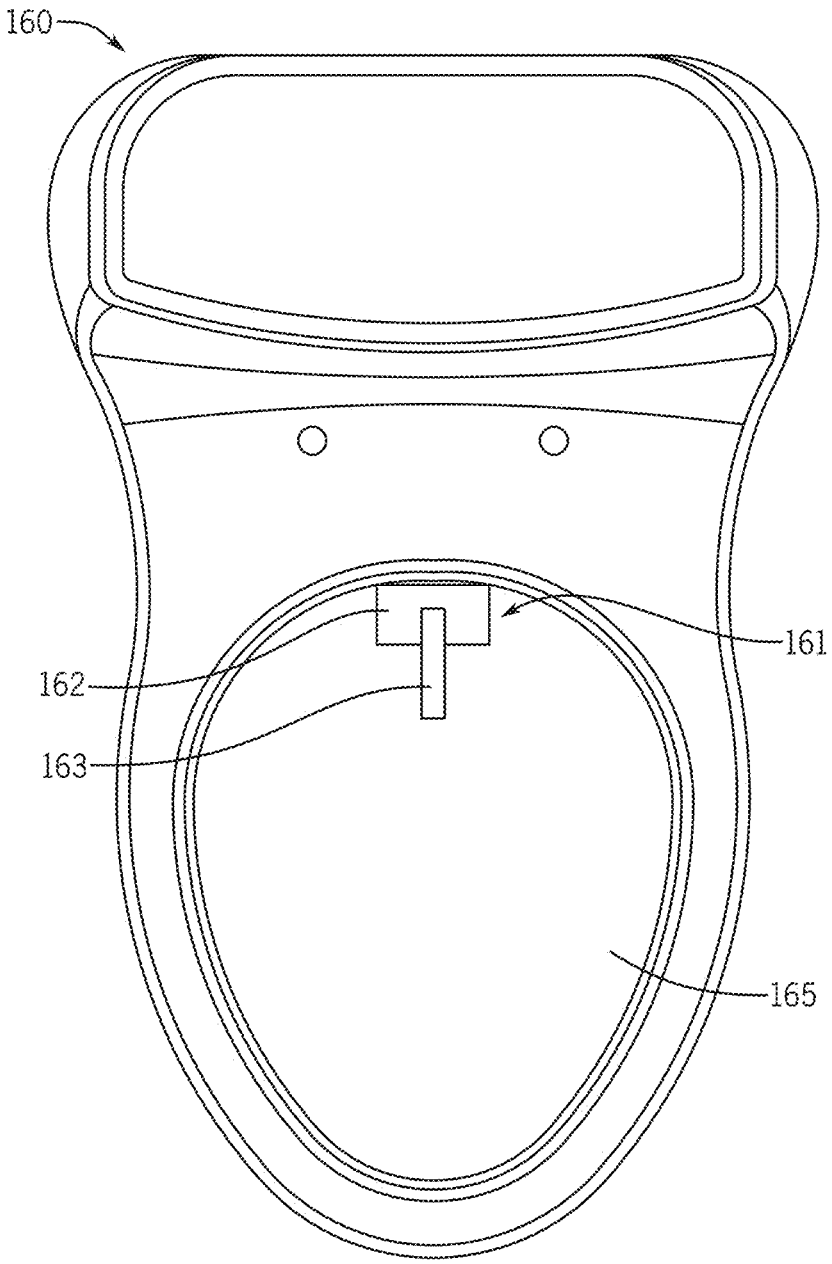
FIG. 16 illustrates a toilet including a bidet according to an exemplary embodiment of the present disclosure.

Referring to FIG. 16, a toilet 160 including an after-market add-on or retrofit bidet 161 is illustrated. The bidet may be sold as an after-market add-on product capable of being installed on the toilet 160 by a party other than the toilet's manufacturer. The bidet 161 may include a base coupled to the toilet 160 and a wand 163 extending or protruding away from the base 162. The base 162 may be attached or secured to a surface of the toilet. For example, the base 162 may be attached to an inner surface of the toilet bowl 165. In another example, the base 162 may be attached to a bottom surface of a toilet seat. The base 162 may be attached or secured to the toilet 160 using an adhesive. In some examples, the base 162 may include a double sided adhesive tape, such as a very high bond (VHB) tape, configured to secure the base to the toilet 160.

The base 162 of the toilet may be comprised of plastic or another material and house various components of the bidet 161. For example, the base 162 may include a conduit or channel extending therethrough. The conduit or channel may direct a flow of water received at an inlet of the base 162 to an outlet of the base. In some examples, the inlet and outlet may be disposed on different sides or surfaces of the base 162. In other examples, the inlet and outlet may be disposed on the same side or surface of the base 162. The base 162 may further include a valve (or valves) disposed therein and configured to control a flow of water through the base 162. For example, a valve may open, allowing a flow of water to flow through base or may close preventing a flow of water from flowing through the base 162. In some examples, the valve may be configured to control a quantity (e.g., volumetric flow rate) of water flowing through the base 162. An inlet of the base 162 may be fluidly coupled to a house configured to supply water to the base 162. The hose may fluidly couple the base 162 to a water supply line (e.g., water distribution network) configured to supply water to the toilet 160. The outlet may be fluidly coupled to the bidet wand 163. In some examples, a hose or conduit may fluidly couple the outlet to the bidet wand 163. In some examples, the base may not include a conduit and one or more valves for controlling a flow of water to the bidet may be disposed outside of the base 162. In these examples, a hose or conduit may directly fluidly couple the bidet wand 163 to a water supply line.

The bidet wand 163 may extend or protrude from the base 162. In some examples, the bidet wand 163 may extend or protrude into the bowl 165 of the toilet 160. The bidet wand 163 is configured to dispense water for cleaning a user of the toilet 160. The bidet wand 163 may be configured to dispense water from a distal end opposite the base 162. A conduit or channel may extend through the bidet wand from an inlet of the bidet wand to an outlet of the bidet wand. In some examples, a valve for controlling a flow of water dispensed from the bidet wand 163 may be disposed within the conduit or channel of the bidet wand.

In some examples, the bidet 161 may be configured to both wash a user of the toilet 160 and clean the bowl 165 of the toilet 160. In some examples, the bidet wand 163 may dispense water for both washing a user and cleaning the bowl 165. In other examples, a discrete cleaning nozzle may be provided in the base of the bidet for cleaning the bowl 165 and the bidet wand 163 may be used for washing a user. Both the bidet wand 163 and cleaning nozzle (when included) may be coupled to the base 162 such that a position or angle (e.g., horizontal and/or vertical) of the bidet wand 163 or cleaning nozzle, respectively, may be changed. In some examples, a gooseneck connects the bidet 161 to the base 162. The user may grip the gooseneck to move the bidet 161 to either the position for dispensing a flow of water for washing a user and/or the position for cleaning a surface of the toilet. The gooseneck may permit other positions for the bidet 161.

One or more motors (e.g., electric motors) may be included in the base 162 to change an angle and/or position of the bidet wand 163 and/or cleaning nozzle. In examples, where the bidet wand 163 dispense water for both washing a user and cleaning the bowl 165, the bidet wand 163 may change position or angles when transitioning between user washing and bowl cleaning operations or functions.

The bidet 161 may further include a bidet actuator configured to initiate and/or control operation of the bidet 161. For example, the bidet actuator may be a lever configured to open or close a valve (e.g., in the base 162 or bidet wand 163) to control a flow of water dispensed by the bidet wand 163 and/or control or change a position of the bidet wand 163 when it is rotated by a user to a predetermined angular position. In other examples, the bidet actuator may be a button configured to open a valve (e.g., in the base 162 or bidet wand 163) when it is pushed or depressed by a user. After being pushed or depressed, the bidet actuator may cause the valve to be opened for a predetermined period of time before closing. In some examples, the bidet actuator may be mechanically coupled to the bidet 161. The bidet actuator may be mechanically connected to the valve (e.g., in the base 162 or bidet wand 163) to open or close the valve controlling a flow of water dispensed from the bidet wand 163. The bidet actuator may be mechanically coupled to the bidet wand 163 to control a position and/or angle of the bidet wand 163. For example, one or more links, such as levers, chains, and the like may mechanically couple the bidet actuator to the bidet 161 (e.g., bidet wand 163, valve in base, valve in bidet wand 163). The bidet actuator may be configured to control a position and/or angle of the bidet wand when performing both a user washing function and/or a bowl cleaning function.

In examples where the bidet 161 includes a cleaning nozzle, the bidet may further include a nozzle actuator configured to initiate and/or control operation of the cleaning nozzle. The nozzle actuator may be a lever configured to open or close a valve configured to control a flow of water dispensed by the cleaning nozzle and/or control or change a position or angle of the cleaning nozzle. In other examples, the nozzle actuator may be a button configured to open a valve configured to control a flow of water dispensed from the cleaning nozzle when it is pushed or depressed by a user. After being pushed or depressed, the valve may remain open for a predetermined period of time before closing. In some examples, the nozzle actuator may be mechanically coupled to the valve configured to control a flow of water dispensed by the cleaning nozzle and/or the cleaning nozzle to control a position or angle of the cleaning nozzle. For example, one or more links, such as levers, chains, and the like may mechanically couple the nozzle actuator to the cleaning nozzle.

The bidet 161 may include a bidet nozzle configured to provide a low pressure flow (e.g., gentle on a user's body) in contrast to the cleaning nozzle configured to provide a high pressure flow (e.g., for washing a surface of the bowl).

A valve may switch the output of the water between the bidet nozzle and the cleaning nozzle. The user may actuate the valve using a switch or lever. The valve may include a Y-connection with two valves that are independently operable (e.g., the user may switch off the bidet nozzle with a first valve and switch on the cleaning nozzle with a second valve, and vice versa). The user may actuate the valve using a rotatable spray nozzle array that both switches the flow and selects the nozzle, as described in more detail below.

In some examples, the bidet 161 may further include a user input device and a controller (e.g., controller 100). The controller may be electrically connected to one or more of the user input device, a valve (e.g., in the base 162 or bidet wand 163) for controlling a flow of water dispensed from the bidet wand 163, a valve for controlling a flow of water dispensed from the cleaning nozzle, a motor or motors for controlling a position or angle of the bidet wand 163, and a motor or motors for controlling a position of the cleaning nozzle. The controller may be configured to send one or more signals and/or electric current to the bidet 161 to control the one or more functions of the bidet 161 in response to a user input received via the user input device. For example, the valve for controlling a flow of water from the bidet wand 163 may be a solenoid valve and the controller may send a signal and/or electric current for controlling opening and/or closing of the valve. In another example, the valve for controlling a flow of water dispensed by the cleaning nozzle may be a solenoid valve and the controller may send signals and/or electric current for controlling opening and/or controlling of the valve. Further, the controller may send signals and/or electric current to the motor or motors for controlling an angle or position of the bidet wand to control or change an angle or position of the bidet wand. Further, the controller may send signals and/or electric current to the motor or motors for controlling an angle or position of the cleaning nozzle to control or change an angle or position of the cleaning nozzle. In some examples, the controller may be located in the base 162 of the bidet 161. In other examples, the controller may be located outside of and/or separately from the base 162. The user input device is configured to receive a user input from a user and transmit the user input to the controller. In some examples, the user input device may be electrically connected to the controller and the user input device may transmit the user input to the controller via a wire or wires. In other examples, the user input device may wirelessly transmit the user input to the controller. In some examples, the user input device may be a touch sensitive display of a mobile device such as a mobile phone or tablet. In some examples, an application installed on a mobile phone or tablet may be used to control the various operations of the bidet 161. In some examples, the controller may be disposed in the mobile phone or tablet and communicate wirelessly with the components (e.g., valves, motors) disposed within the base 162. For example, the controller may communicate wirelessly with components in the base 162 via a Bluetooth low energy (BLE) module or via another network such as the internet. In other example, the controller may be disposed in the base 162 of the bidet and the user input may be transmitted to the controller via a BLE module or another network. In other examples, the user input device may a sensor such as a capacitive touch or proximity sensor. In some examples, the bidet may include a battery or batteries disposed in the base 162 electrically connected to and configured to supply power to the controller, the one or more valves disposed in the base, and/or the one or more motors disposed in the base 162.

In some examples, the bidet 161 may further include a cleanliness sensor disposed in the base 162 and configured to sense or detect the presence of a contaminant (e.g., feces) on a surface of the bowl 165. The sensor may be configured to identify a presence and location of the contaminant and transmit a signal or signals indicating the presence and location of the contaminant to the controller. The cleanliness sensor may be a camera configured to collect image or images of the inner surface of the bowl 165. In some examples, the sensor may perform image recognition to determine the presence of and a location of the contaminant in the bowl 165. In some examples, the controller may perform image recognition to determine the presence of and a location of the contaminant in the bowl 165.

During a cleaning operation of the bidet, which may be initiated via the bidet actuator, cleaning nozzle actuator and/or user interface, the sensor may sense the presence and/or location of a contaminant in the bowl 165 and transmit a signal or signals indicative of the presence and/or location of the contaminant to the controller. The controller may then control (via signals or electric current) the bidet wand 163 or cleaning nozzle such that a position of the bidet wand 163 or cleaning nozzle is changed such that water dispensed from the bidet wand 163 or cleaning nozzle is incident on the location within the bowl which is contaminated. The controller may further control the bidet wand 163 or cleaning nozzle such that water is dispensed onto the location within the bowl including the contaminant. In some examples, the bidet 161 may perform a spot cleaning operation in which water is dispensed only to locations of the bowl 165 which are contaminated. In other examples, a general cleaning operation in which the water is dispensed onto an entire inner surface of the bowl 165 may be performed. The bidet wand 163 or cleaning nozzle may change positions during a cleaning operation of the bowl.

In some examples, a cleaning solution may be dispensed out of the bidet wand 163 or cleaning nozzle during bowl cleaning. The bidet 161 may further comprise a reservoir fluidly coupled to the bidet wand 163 or the cleaning nozzle cleaning reservoir configured to store a cleaning solution. In some examples, a pump in communication with the controller may cause a predetermined quantity or dose of cleaning solution to be dispensed out of the bidet wand 163 or cleaning nozzle during a cleaning operation of the bowl 165. In some examples, the cleaning solution may be dispensed from the bidet wand 163 or cleaning nozzle with water. In other examples, only the cleaning solution may be dispensed from the bidet wand 163 or cleaning nozzle. In some examples, a cleaning operation of the bidet 161 may be performed after use of a toilet but before a flush cycle of the toilet. In other examples, a cleaning operation of the bidet 161 may be performed after a flushing cycle of the toilet.

Figure 17:
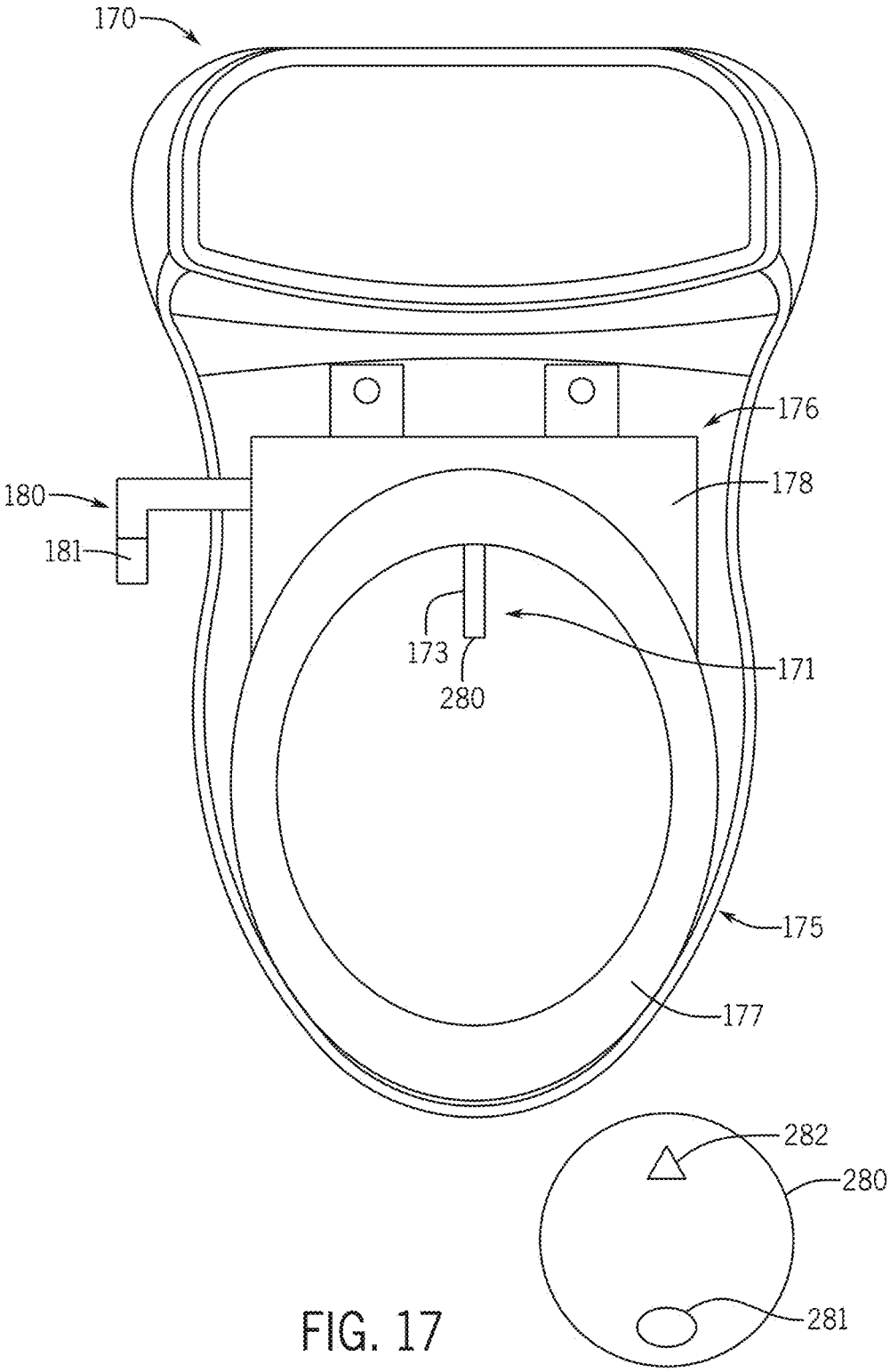
FIG. 17 illustrates a toilet including a bidet and toilet cleaner according to an exemplary of the present disclosure.

Referring to FIG. 17, a toilet seat assembly 176 including a manual bidet 171 is illustrated. The toilet seat assembly 176 may be sold as an after-market add-on product capable of being installed on a toilet (e.g., toilet 170) by a party other than the toilet's manufacturer. The toilet seat assembly 176 includes a base 178 configured to receive one or more fasteners for attaching or securing the toilet seat assembly 176 to a toilet 170 and a seat configured to support the weight of a user rotatably coupled to the base 178.

The toilet seat assembly 176 further includes a manual bidet wand 173 connected to the base 178. The manual bidet wand 173 may be configured to selectively extend from and retract into the base 178. When the manual bidet wand 173 is in an extended position, the manual bidet wand 173 may extend or protrude into the bowl 175 of the toilet 170. The manual bidet wand 173 may be fluidly connected to a water supply line (e.g., water distribution network) configured to supply water to the manual bidet wand 173. A conduit or channel within the base 178 may be configured to direct a flow of water from a base inlet to a base outlet. The base inlet may be fluidly coupled to a hose connected to the water supply line. The base outlet may be fluidly coupled to the manual bidet wand 173. In some examples, a valve disposed in the conduit may be configured to control a flow of water through the base, and thus control a flow of water dispensed from the manual bidet wand. In some examples, the valve may control a quantity (e.g., volumetric flow rate) of water dispensed from the manual bidet wand 173.

The toilet seat assembly 176 further includes a lever 180 extending from the base 178. In some examples, the lever 180 may extend from a side of the base 178 such that a portion of the lever 180 is disposed adjacent to a side of the toilet 170 (e.g., bowl 165). The lever 180 may be mechanically connected to a valve in the base 178 and the manual bidet wand 173 such that a flow dispensed from the manual bidet wand 173 and a position or angle of the manual bidet wand may be controlled by the lever 180. In some examples, a user may rotate an end or end portion of the lever 180 along a first axis causing the manual bidet wand 173 to extend from the base 178 into the bowl 175 and opening a valve in the base 178 allowing flow of water to be dispensed from the manual bidet wand 173. Further, in some examples, a user may rotate the entire lever 180 along a second axis perpendicular to the first axis to change a position and/or angle of the manual bidet wand 173 within the bowl 175. One or more links, such as levers, chains, gears, and the like may mechanically couple the lever 180 to the valve disposed in the base 178 and/or the manual bidet wand 173.

The manual bidet wand 173 may be configured to both wash a user and clean the bowl 175 of the toilet. The lever 180 may be configured to control or change a position and/or angle of the manual bidet wand 173 when performing both a user washing function and/or a bowl cleaning function. In some examples, a user may operate the lever 180 in order to change a position of the manual bidet wand 173 such that the manual bidet wand 173 transitions from a position in which water dispensed from the manual bidet wand would contact a user to a position of the manual bidet wand 173 in which water dispensed impinges on a surface of the bowl 165 or vice versa (transition from bowl cleaning position to user washing position).

In some examples, the toilet seat assembly 176 may further include a reservoir configured to contain or store a cleaning solution. In some examples, the reservoir may be disposed in the base 178. In other examples, the reservoir may be disposed in the seat 177. In some examples, a reservoir valve may selectively fluidly couple the reservoir to the manual bidet wand 173. In some examples, a pump may supply a quantity or dose of the cleaning solution to the manual bidet wand 173. In some examples, the lever 180 may be configured to control a quantity of cleaning solution supplied to the manual bidet wand 173. For example, the pressing of a button or a distinct angular position of the lever 180 or the end of the lever may cause a predetermined quantity of cleaning solution to be supplied to the manual bidet wand 173 (e.g., via operation of a pump for a predetermined time, via opening of a valve for a predetermined period of time). The cleaning solution may be dispensed out of the manual bidet wand with or without water to clean an inner surface of the bowl 165. In some examples, the cleaning solution may include a disinfectant such as bleach.

The bidet lever 181 may perform multiple functions. As a first function the bidet lever 181 may extend the bidet wand 173 to a user cleaning position or a bowl cleaning position or switch between the two positions. This selection may be made by moving the bidet lever 181 between a first rotational position and a second rotational position.

As a second function, the bidet lever 181 may include a switch for switching between nozzles. For example, as shown in FIG. 14, the front face of the bidet wand 173 includes a rotatable spray nozzle array 280. The rotatable spray nozzle array rotates, either directly or via the switch of the bidet lever 181, between a cleaning nozzle 281 and a bidet nozzle 282. As a third function, the bidet lever 181 may include a switch for turning on the water supply to the bidet wand 173. As a fourth function, the bidet lever 181 may be pumped to provide water pressure for moving water through the bidet wand 173 from a reservoir or other water supply.

In some examples, the toilet seat assembly 176 may further include an automatic bidet, such as the bidet 161 as described above with respect to FIG. 13. In some examples, the automatic bidet (e.g., the base 162 of the bidet 161) may be integrated with or disposed within the base 168. Specifically, the toilet seat assembly 176 may additionally include an automatic bidet wand including a controller (e.g., controller 100) and a user interface such that a cleaning operation in which a sensor identifies the presence and location of contaminants within the bowl and the automatic bidet wand changes positions and dispenses water onto the contaminated locations may be implemented. As described above a user interface such as a touch sensitive screen and an application may be used to control operation of the automatic bidet wand. Further, the automatic bidet wand may be fluidly coupled to a reservoir storing a cleaning solution and dispense the cleaning solution as described above.

In some examples, the toilet seat assembly 176 may further include a toilet seat cover rotatably coupled to the base 168. In some examples, the toilet seat cover may include an interior compartment of chamber. One or more fans disposed within the chamber may be configured to draw air through a plurality of openings in a bottom surface of the toilet seat cover and into the chamber. The chamber may further include one or more ultraviolet (UV) lights and a photocatalyst configured to disinfect air drawn into the chamber. The disinfected air may then be expelled from the chamber. In some examples, the chamber may include one or more impactors configured to cause airborne particulate in the air drawn into the chamber to contact a surface of the impactor that is illuminated by ultraviolet light. In some examples, the air drawn into the chamber may be drawn through a mesh or honeycomb structure including a catalyst configured to react with water forming a reactive species of hydroxyl (OH—) and peroxides ($H_2O_2$). In some examples, the chamber may include a device (e.g., corona wire) configured to impart a negative electrostatic charge on particulate matter in the air drawn into the chamber and a positive collection plate configured to collect the negatively charged particulate matter. The collector plate may be illuminated by UV light for disinfection. In some examples, the toilet seat cover may include one or more misters disposed above the toilet seat 177 when the lid is in a closed position. The one or more misters may be fluidly connected to a reservoir (e.g., in the toilet seat cover) and configured to dispense a disinfecting mist onto a surface of the seat and/or into the bowl 165 during flushing of the toilet.

Referring generally to FIGS. 18-21, toilet seats and toilet seat hinge assemblies for improving toilet accessibility and/or comfort are illustrated. Any of the toilet seats and/or hinge assemblies described below with respect to FIGS. 18-21 may be used in combination to improve toilet accessibility, functionality, and comfort.

Figure 18:
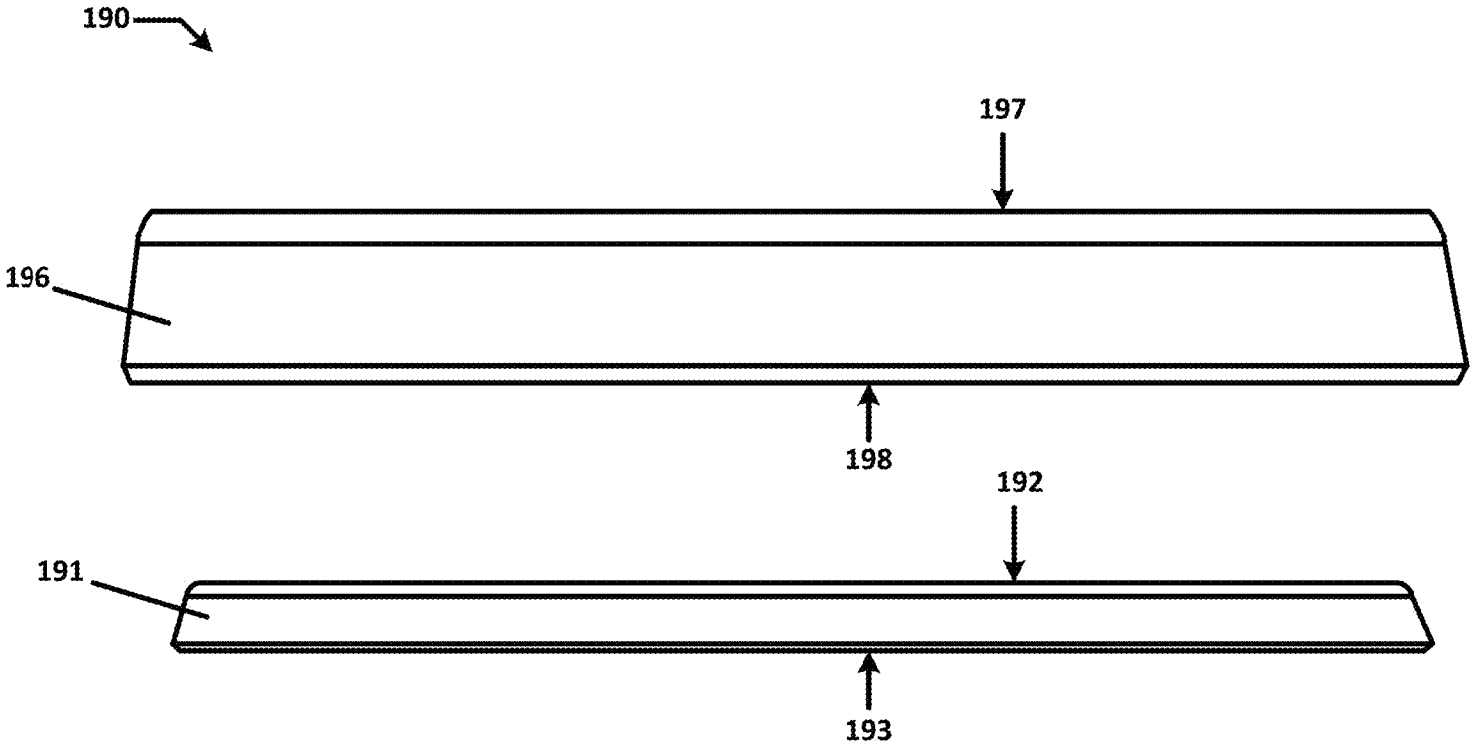
FIG. 18 illustrates a toilet seat assembly.

Specifically, referring to FIG. 18, a modular toilet seat assembly 190 is shown. The toilet seat assembly 190 may include a base seat 191 and an adaptive seat 196. The adaptive seat 196 may change one or more of the height, shape, and size of a surface on which a user sits while using a toilet including the toilet seat assembly 190. The toilet seat assembly 190 may further include a toilet seat cover and a hinge configured to rotatably couple the base seat 191, adaptive seat 196, and/or seat cover to a toilet. The seat cover may be configured to cover the base seat 191 and/or the adaptive seat 196. The hinge may be the same as the hinge discussed above with respect to FIGS. 1 and 2.

The base seat 191 may include a base seat top surface 192 and a base seat bottom surface 193 opposite the base seat top surface 192. The base seat 191 may be rotatably coupled to a toilet (e.g., pedestal) via a hinge. When the base seat 191 is in a down position, the base seat bottom surface 193 may contact or be supported by a rim of a toilet. The base seat 191 may be configured to surround a top opening of the bowl of a toilet. The base seat top surface 192 may be configured to support the weight of a user when the base seat 191 is in a downward position. The base seat 191 includes an outer perimeter or outer edge where the base seat top surface 192 and the base seat bottom surface 193 meet. Additionally, the base seat 191 includes a base seat inner perimeter or inner edge where the base seat top surface 192 and the base seat bottom surface 193 meet. The base seat inner perimeter may define (e.g., a shape, a size) a base seat opening in the base seat 191.

The adaptive seat 196 may include an adaptive seat top surface 197 and an adaptative seat bottom surface 198 opposite the adaptive seat top surface 197. The adaptive seat 196 may be configured to be coupled to the base seat 191. In some positions, the adaptive seat 196 may be disposed on top of or above the base seat 191. For example, the adaptive seat 196 may be rotatably coupled to the base seat 191 via a hinge. The base seat 191 and the adaptive seat 196 may be rotatably to one another and a toilet such that when the base seat 191 and the adaptive seat 196 are in a downward position, the adaptive seat 196 is disposed above or on top of the base seat 191. In other examples, the adaptive seat 196 may be stackable on top of the base seat 101. One or more protrusions and/or recess may be used to lock or secure a position of the adaptive seat 196 relative to the base seat 191.

In some examples, the adaptive seat 196 may include a recess configured to receive the base seat 191. For example, the adaptive seat bottom surface 198 may include a recess extending into the adaptive seat 196 toward the adaptive seat top surface 197. The base seat 191 may be configured to nest inside the recess formed in the adaptive seat 196.

The adaptive seat 196 may be supported by the base seat 191 and/or the toilet (e.g., pedestal) when the adaptive seat 196 is in a downward position or coupled to the base seat 191. The adaptive seat top surface 196 may be configured to support the weight of a user when the adaptive seat 196 is in a downward position or coupled to the base seat 191. The adaptive seat 196 may surround a top opening of the bowl of a toilet. The adaptive seat 196 includes an outer perimeter or outer edge where the adaptive seat top surface 197 and the adaptive seat bottom surface 198 meet. Additionally, the adaptive seat 196 includes an adaptive seat inner perimeter or inner edge where the adaptive seat top surface 197 and the adaptive seat bottom surface 198 meet. The adaptive seat 196 inner perimeter may define (e.g., a shape, size) an adaptive seat opening.

In some examples, the adaptive seat 196 may selectively increase the height at which a user sits on a toilet including the modular toilet seat assembly 190. Specifically, a user may sit on the base seat 191 (e.g., the base seat top surface 192) at a first height (e.g., with respect to the rim, with respect to a floor, etc.) or the adaptive seat 196 (e.g., the adaptive seat top surface 197) at a second height. The second height may be larger than the first height such that a user sits at a higher elevation when using the adaptive seat 196 as compared to the base seat. For example, the first height may be approximately one inch above a rim of the toilet and the second height may be approximately 2-3 inches above a rim of the toilet.

The adaptive seat 196 may be stacked on top of the base seat 191 or rotated downward on top of the base seat 191 to selectively increase the height at which a user sits. Similarly, a user may selectively remove the adaptive seat 196 or rotate the adaptive seat 196 upwards to decrease the height at which a user sits. Accordingly, the modular toilet seat assembly may allow a user to selectively change a sitting height improving toilet accessibility and/or comfort.

In some examples, the adaptive seat 196 may have a different size and/or shape than the base seat 191. For example, the base seat 191 may be designed in consideration of a relatively large user such as an adult and the adaptive seat 196 may be designed in consideration of a relatively small user such as a child. Specifically, the adaptive seat 196 may include an adaptive seat opening that is smaller than the base seat opening. In some examples, an inner portion of the adaptive seat top surface 197 circumscribing the adaptive seat opening may be elevated to provide (a relatively small) surface on which a user may sit. In other examples, the adaptive seat top surface 197 may have a different profile than the base seat top surface 192 in consideration of a user preference and/or the size, shape, and/or weight of a user.

In some examples, the adaptive seat 196 may include integrated grab bars, improving accessibility. For example, grab bar(s) may be integrally formed with the adaptive seat 196 and extend outward from one or both sides of the adaptive seat 196. In some examples, the grab bar(s) may extend outward along a horizontal plane. In other examples, the grab bar(s) may extend upward and outward from the adaptive seat 196. In yet other examples, the grab bar(s) may extend vertically upwards from the adaptive seat 196.

Figure 19:
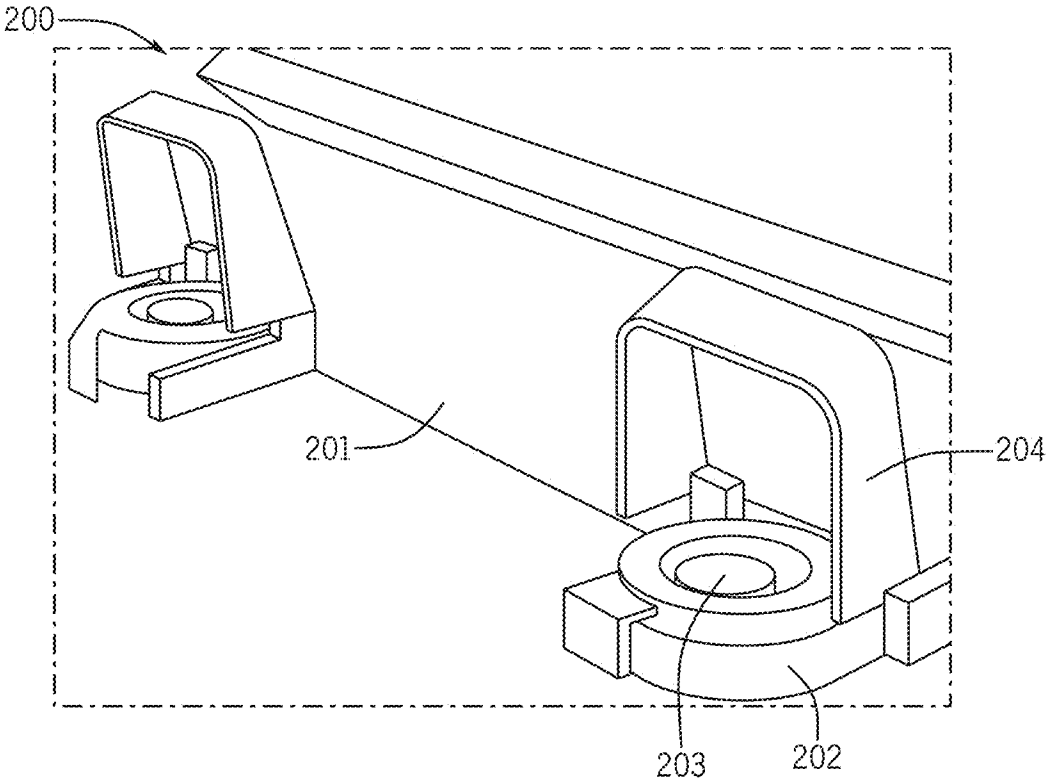
FIG. 19 illustrates a universal toilet seat hinge assembly.

Referring to FIG. 19, a universal toilet seat hinge assembly 200 is shown. The universal seat hinge 200 is configured to be attached to a pedestal of a toilet and is configured to receive or be coupled to one or more different toilet seats and/or seat covers. The universal toilet seat hinge assembly 200 may include a body 201 and one or more shoulders 202 extending from the body 201. For example, the toilet seat hinge assembly 200 may include two shoulders 202. Each of the shoulders 202 may be configured to receive a fastener 203 for attaching the toilet seat hinge assembly 200 to the pedestal of a toilet. In some examples, the toilet seat hinge assembly 200 may include one or more shoulder hoods configured to cover the shoulders 202.

The body 201 includes a hinge for coupling one or more different toilet seats to the body 201. In some examples, the hinge may couple two toilet seats to the body 201. For example, the hinge may couple a base seat 191 and an adaptive seat 196 to the body. In other examples, the hinge may couple a single seat to the body 201. The hinge may be configured such that one or more different toilet seats may be removably coupled to the hinge without having to change or replace the hinge. Accordingly, a plurality of different toilet seats may be interchangeable with the body 201 and hinge of the toilet seat hinge assembly 200.

The toilet seat hinge assembly 200 may advantageously allow a toilet seat or toilet seats to be quickly and easily be interchanged. Accordingly, a seat with a relatively large opening designed in consideration of adults, a seat with a relatively small opening designed in consideration of children, a seat with a relatively high sitting height, and other toilet seats may be quickly and easily interchanged depending on the needs or preferences of a user. Other toilet seats may include toilet seats having a top surface with a varying profile depending on the needs and/or preferences of a user. In some examples, one or more of the toilet seats may include an integrated arm rest and/or grab bar. The hinge may additionally removably couple one of a plurality of toilet seat covers to the body 201.

In some examples, the hinge may be elevated above a top surface of a rim of the toilet. In some examples, a height of the body 201 may allow the hinge to be elevated above a top surface of the rim of the toilet. In other examples, the body 201 and thus the hinge may be coupled to the pedestal of the toilet by one or more hinge towers. The one or more hinge towers may be configured to extend upward vertically from the pedestal and may be configured to receive a fastener for coupling the body 201 to the pedestal.

Figure 20:
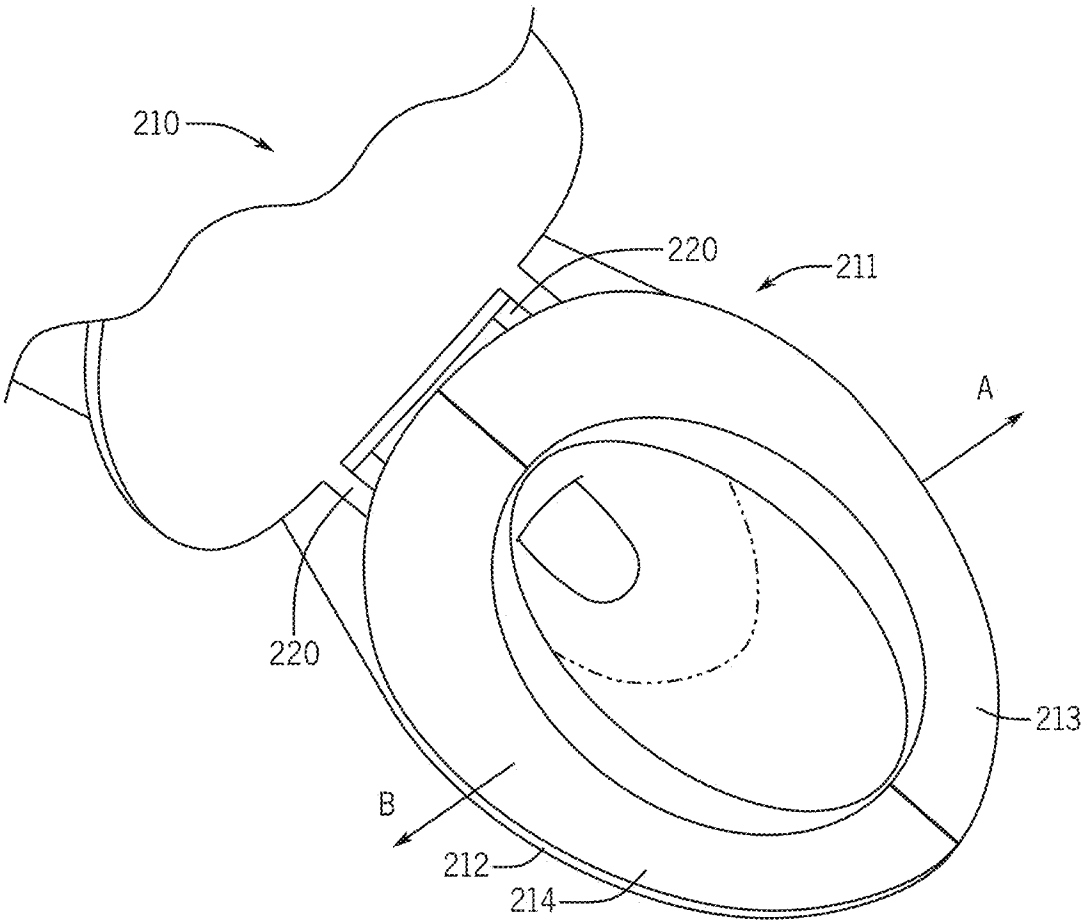
FIG. 20 illustrates an expandable toilet seat.

Referring to FIG. 20, a toilet 210 including an expandable toilet seat 211 is shown. The toilet 210 may include a pedestal 212 including a bowl and a rim surrounding an opening at the top of the bowl. In some examples, the toilet 210 may be one of the toilets 10, 20 described above with respect to FIGS. 1 and 2. The expandable toilet seat 211 may be configured to selectively expand to accommodate large (e.g., wide) and/or heavy users. In some examples, the expandable toilet seat 211 may include one or more supports configured to support and/or maintain a position of the expandable toilet seat 211 during use (e.g., when a user is sitting on the expandable seat 211).

In some examples, the expandable seat 211 may include a first arm 213 and a second arm 214 disposed on opposite side of the pedestal 212. In some examples, the first arm 213 and the second arm 214 may be mirrored or symmetrical to one another about a central axis of the toilet 210. The first arm 213 and the second arm 214 may be configured to selectively expand or move outward to accommodate large and/or heavy users. The first arm 213 and the second arm 214 may move or translate in a horizontal plane. The first arm 213 and the second arm 214 may be configured to expand or move outward in opposite directions. For example, the first arm 213 may move outward in a first direction A and the second arm 214 may move outward in a second direction B. In some examples, a front end and a back end of each of the first arm 213 and the second arm 214 may both move or translate outward (e.g., in directions A and B respectively). In other examples, each of the first arm 213 and the second arm 214 may be fixed to the toilet 210 at a fixed point 220 at or near a back end of the first arm 213 and the second arm 214 respectively. The first arm 213 and the second arm 214 may rotate outwards about their respective fixed points 220. In some examples, as the first arm 213 and the second arm 214 expand or move outward, a contact area between the first arm 213 or the second arm 214, respectively, may increase, increasing an amount of weight the expandable toilet seat 211 is capable of supporting. In some examples, a magnitude of movement of the first arm 213 and the second arm 214 may be the same.

In some examples, the expandable seat 211 may automatically expand outwards in response to the weight of a user. Specifically, one or more elastic members such as springs may maintain the expandable seat in a narrow or unexpanded position when there is no weight on the expandable seat 211. The elastic member may stretch allowing the first arm 213 and the second arm 214 to expand or move outwards in response to the weight of a user. In other examples, a user may manually grab and move the first arm 213 and/or the second arm to move or expand the expandable toilet seat 211.

In some examples, the expandable toilet seat 211 may include one or more supports configured to reinforce or brace the expandable toilet seat 211. The one or more supports may reinforce or brace the expandable toilet seat 211 in an expanded position. In some examples, the one or more supports may be retractable and/or fold out from the expandable seat 211. In some examples, the supports may slide out from the expandable toilet seat 211 (e.g., along a track). The supports may be configured to contact the pedestal 212, a floor, or a wall to reinforce or brace the expandable toilet seat 211. In some examples, the one or more supports may fold out from the expandable seat 211. For example, one or more supports may fold out from a bottom surface of the expandable seat 211. For example, one or more supports may fold out from a bottom surface of the expandable seat to a position in which the supports are disposed at an angle with respect to a horizontal or vertical axis and contact an outer surface of the pedestal 212.

In some examples, the expandable toilet seat 211 may be a secondary or additional toilet seat included in addition to a primary seat. The expandable toilet 211 seat may be rotatably coupled to the toilet 210 (e.g., pedestal 212) via a hinge. The expandable seat may be rotated between an upward (e.g., substantially vertical) position and a downward (e.g., substantially horizontal) position. In a downward position, the expandable toilet seat 211 may be disposed above or on top of the primary seat. The expandable toilet seat 211 may be in a folded or stored position when in the upward position to reduce a size of the expandable seat 211. For example, the first arm 213 and second arm 214 may cross one another forming an "X" shape when the expandable seat 211 is in a stored and vertical position. The expandable seat 211 may unfold or open into a use position as the expandable seat is rotated from an upward position to a downward position. In the use position, the first arm 213 and the second arm 214 may be disposed above opposite sides of the pedestal 212 and mirror one another.

Figure 21:
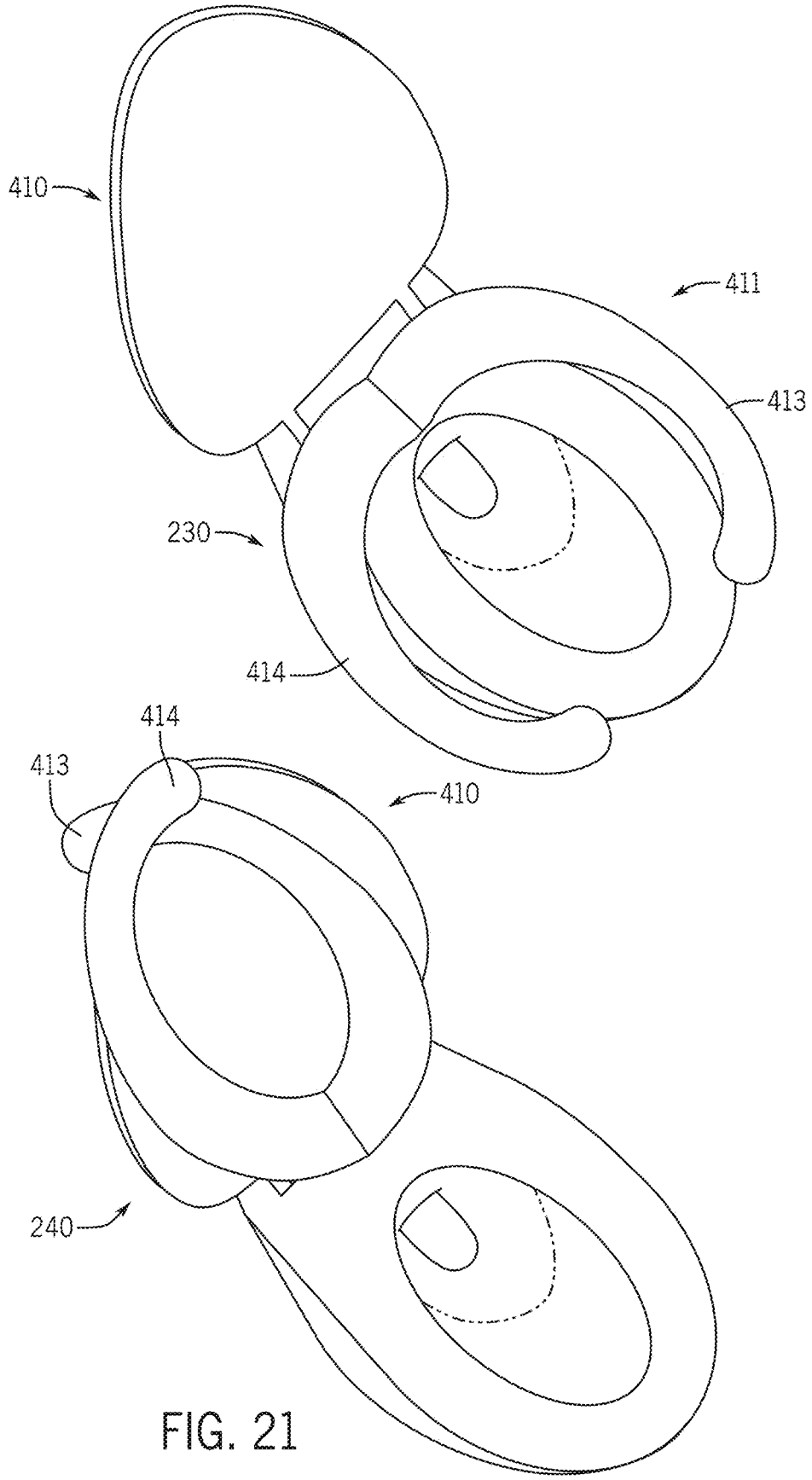
FIG. 21 illustrates a collapsible toilet seat.

FIG. 21 illustrates an example adaptive toilet seat 411 mounted on toilet 410. The adaptive seat 411 does not merely raise or lower into position. The adaptive seat 411 folds inward to a retracted or closed position 240 when it is raised or stowed. When in use, the adaptive seat 411 is in a spread position 230. In this way the adaptive seat 411 may be wider that the toilet bowl itself yet be stowed in a compact manner. Therefore, the adaptive seat 411 provides more support (e.g., holds a greater mass) than other toilet seats.

The adaptive seat 411 is rotatably coupled to the toilet 410 (e.g., to the rim as described herein). The adaptive seat 411 may include a first side portion 413 and a second side portion 414 movable with respect to each other. The first side portion 413 and the second side portion 414 are configured to overlap in a scissor fit. In a scissor fit, the first side position 413 and second side portion 414 overlap when stowed. While not shown, the first side portion 413 and the second side portion 414 may also be stowed in a butterfly position in which the first side portion 413 and second side portion 414 pivot along a common axis or pivot point to effectively stack (e.g., fold together like the wings of a butterfly). Various angles, lines, or locations may be selected for the common axis and/or the pivot point. Multiple folds or pivot points may be used.

Figure 22:
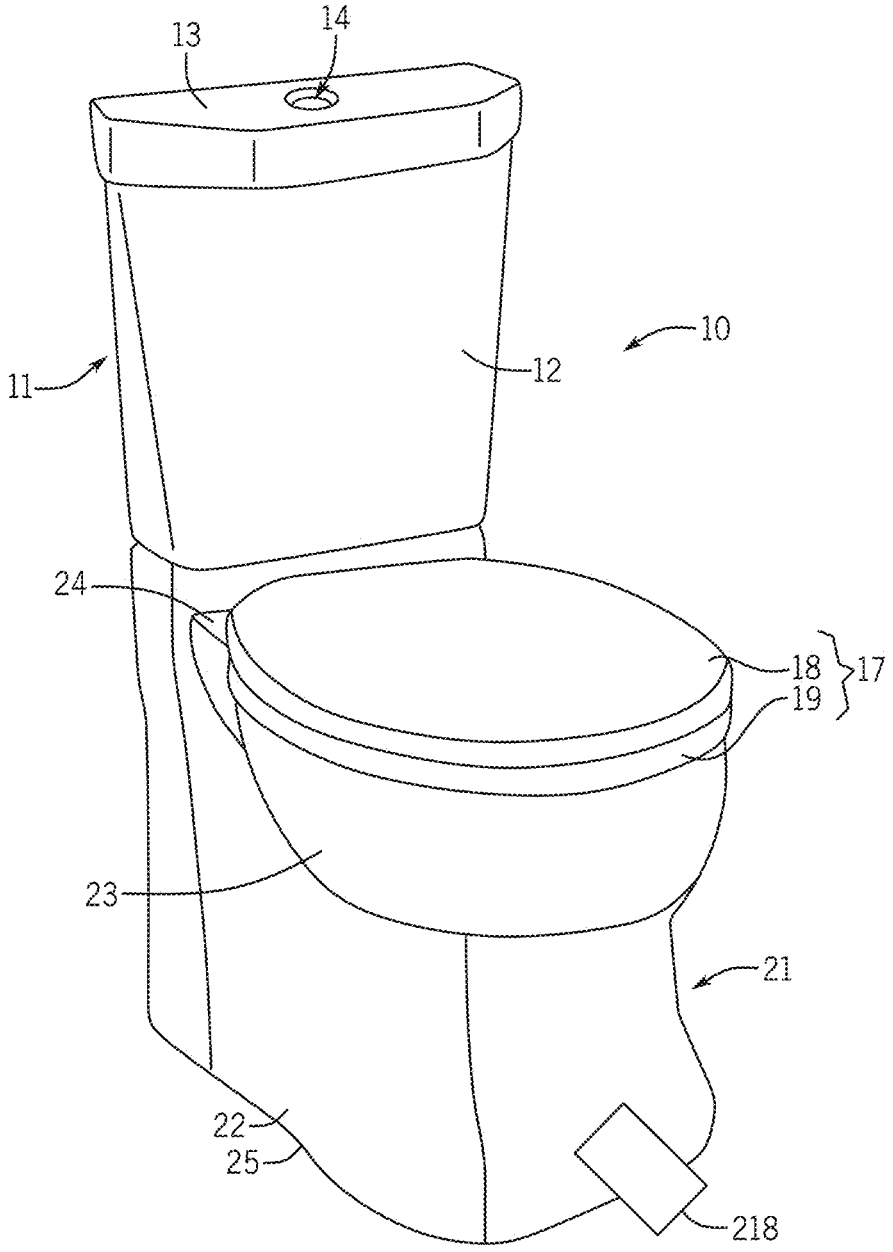
FIG. 22 illustrates a toilet with a flush actuator.

Referring to FIG. 22, a toilet 10 including a foot pedal 218 is illustrated. Specifically, FIG. 19 illustrates a toilet 10 including a foot pedal 218 according to a first example on the front of the pedestal 21. Alternatively, the foot pedal 218 may be located on a side of the pedestal 21. The foot pedal 218 may be disposed at or near a bottom of a pedestal 21 of the toilet 215. The foot pedal 218 may be configured to initiate an operational cycle of the toilet. In some examples, the toilet 10 may include a foot pedal 218 and an actuator, such as actuator 14 described above with respect to FIGS. 1 and 2.

The foot pedal 218 may be a surface or button configured to activate (e.g., initiate an operation cycle) when depressed a predetermined distance. In some examples, the foot pedal 218 may translate vertically when depressed. In other examples, the foot pedal 218 may be a lever configured to activate when rotated a predetermined angle. In some examples, the foot pedal 218 may be a lever configured rotate in a single direction. In other examples, the foot pedal 218 may be configured to rotate in two directions about an axis. Specifically, a first side (e.g., left side) of the foot pedal 218 may be depressed causing the foot pedal 218 to rotate in a first direction. Further, a second side (e.g., right side) of the foot pedal 218 may be depressed causing the foot pedal 218 to rotate in a second direction. In some examples, when the foot pedal 218 is rotated in the first direction, a first flush operation, for example, a low volume flush cycle may be initiated. Further, when the foot pedal 218 is rotated in the second direction, a second flush operation, for example, a high volume flush cycle may be initiated.

The foot pedal 218 may be mechanically coupled to a valve, such as a flush valve, to initiate an operational cycle of the toilet 10. The flush valve may be a solenoid valve, a canister flush valve, a flapper valve, a float, or the like. In some examples, one or more links, such as levers, chains, and the like may mechanically couple the foot pedal 218 to the flush valve. The one or more links, such as levers, chains, and the like may be disposed in the pedestal 21 and/or a tank of the toilet 10.

Figure 23:
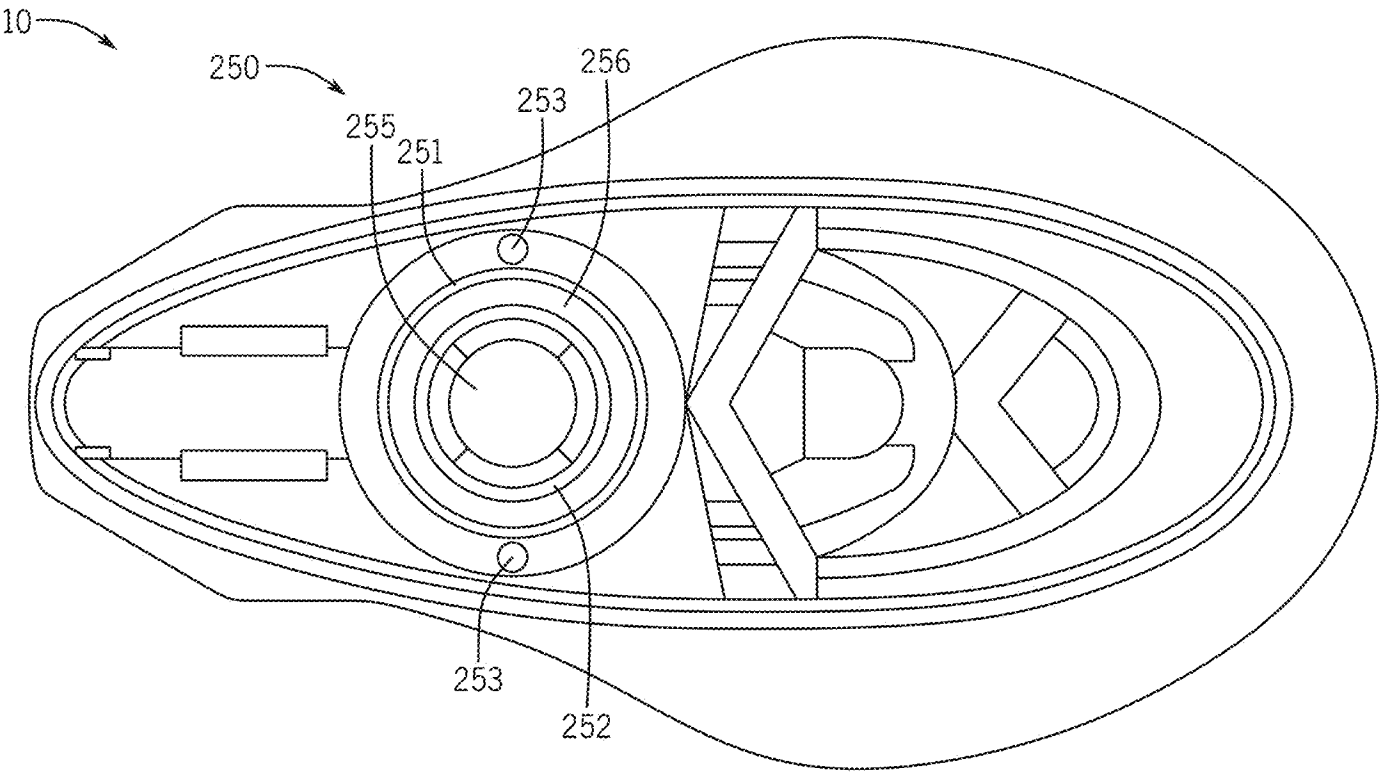
FIG. 23 illustrates a first embodiment of an installation channel on a toilet.
Figure 24:
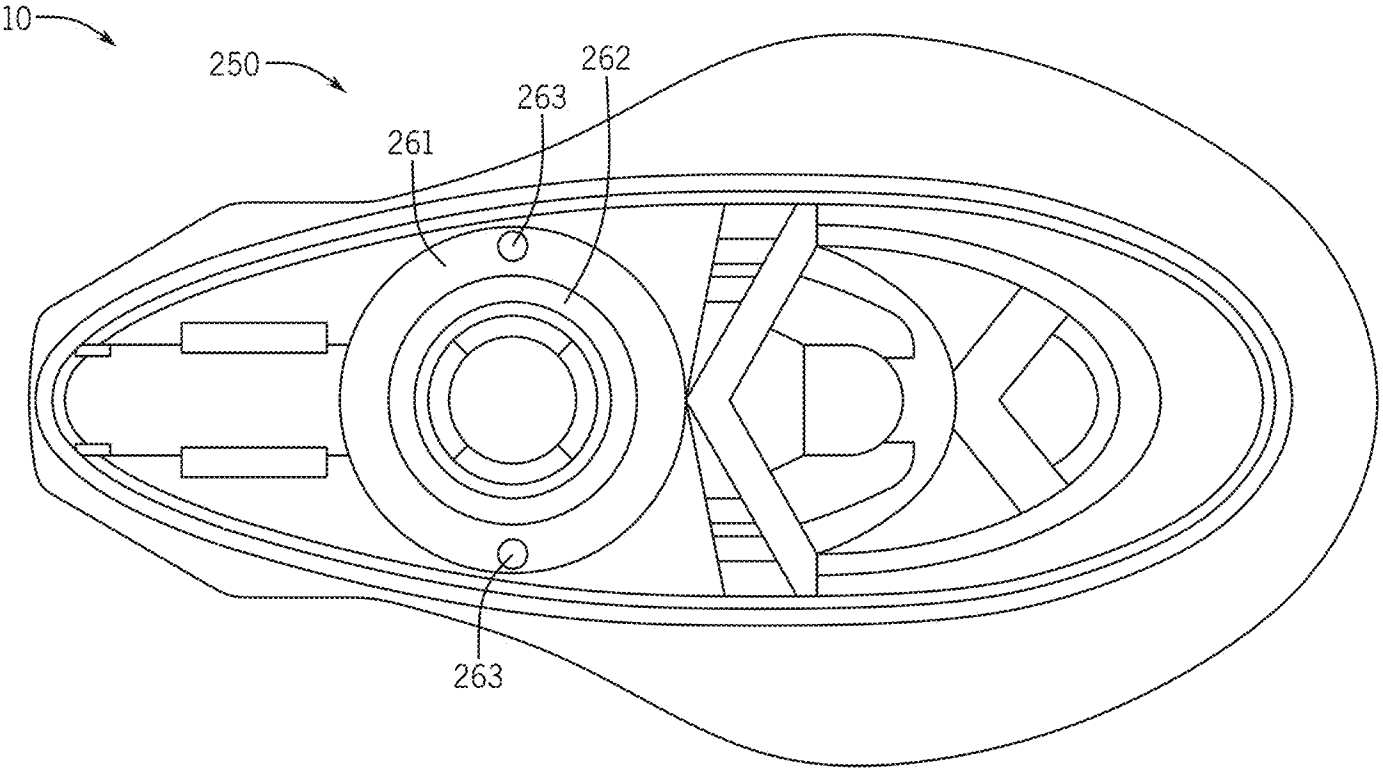
FIG. 24 illustrates a second embodiment of an installation channel on a toilet.

FIG. 23 illustrates another view of toilet 10 (e.g., from the bottom or underside) including a floor mating device 250. The floor mating device 250 may fit against a floor flange. At least one fastener from the floor flange may mate with the floor mating device 250, as well as an alignment device on the floor mating device 250 may guide the floor flange to couple to the toilet. The toilet may include a skirt surrounding the at least one opening as well as the floor mating device 250.

The base of the toilet as shown includes or is attached to the floor mating device. The base may be coupled to the tank, seat assembly, and other components as described herein. It should be noted that the shapes and configurations of the tank, pedestal, seat assembly, and the internal components (including the trapway and other features) may vary from the embodiments shown and described herein, and that the embodiments disclosed herein are not intended as limitations. It should be noted that various components of the toilet may be made of vitreous china, including the base shown in FIG. 23. Additional, different, or fewer components may be used.

The base may also include a bowl with an incorporated sump that leads to an outlet opening 255. The water and waste collected in the sump may travel through a trapway including a generally increasing inclined portion, over a weir or dam, and on to a generally decreasing inclined portion to the outlet opening 255, which opens to a drain or soil pipe. The outlet opening 255 and the drain or soil pipe are connected via the floor mounting device 250. Alternatively, the outlet opening 255 and the installation floor or other surface are connected via the floor mounting device 250. The installation floor may include a floor flange and one or more fasteners.

The floor mating device 250 may include an outer flange (first flange) 251 and an inner flange (second flange) 252 and a seal 256 between the outer flange 251 and the inner flange 252.

The outer flange 251 and the inner flange 252 may be formed from vitreous material. The outer flange 251 and the inner flange 252 may be integrally formed with the base of the toilet. The outer flange 251 and the inner flange 252 may form a channel therebetween. Thus, the cannel may also be formed from vitreous material.

In another example, the outer flange 251 and the inner flange 252 may be joined or coupled to the base of the toilet. For example, the outer flange 251 and the inner flange 252 may be formed from a polymer such as resin or plastic. In this example, because the outer flange 251 and the inner flange 252 form a channel therebetween.

The outer flange 251 and the inner flange 252 may have different heights. The outer flange may have a larger height than the inner flange 252. The outer flange 251 may fit over or around the floor flange. The inner flange 252 may fit within the floor flange. The floor mating device 250 may include at least one (e.g., two, three, or four) openings to receive at least one fastener from a floor flange.

The outer flange 251 and/or the inner flange 252 may serve as a guide with respect to the floor flange. That is, a surface or ridge on the floor mating device 250 may be mated or otherwise pairs with a corresponding component of the floor flange to guide proper centering and installation location of the floor mating device 250 and the floor flange.

The seal may be a wax-less ring. Example wax-less rings may be formed from foam or rubber. The seal may be a wax ring. The seal may be a gasket. The wax ring may be fitted inside the channel before the toilet is installed (e.g., during manufacturing of the toilet).

Figure 25:
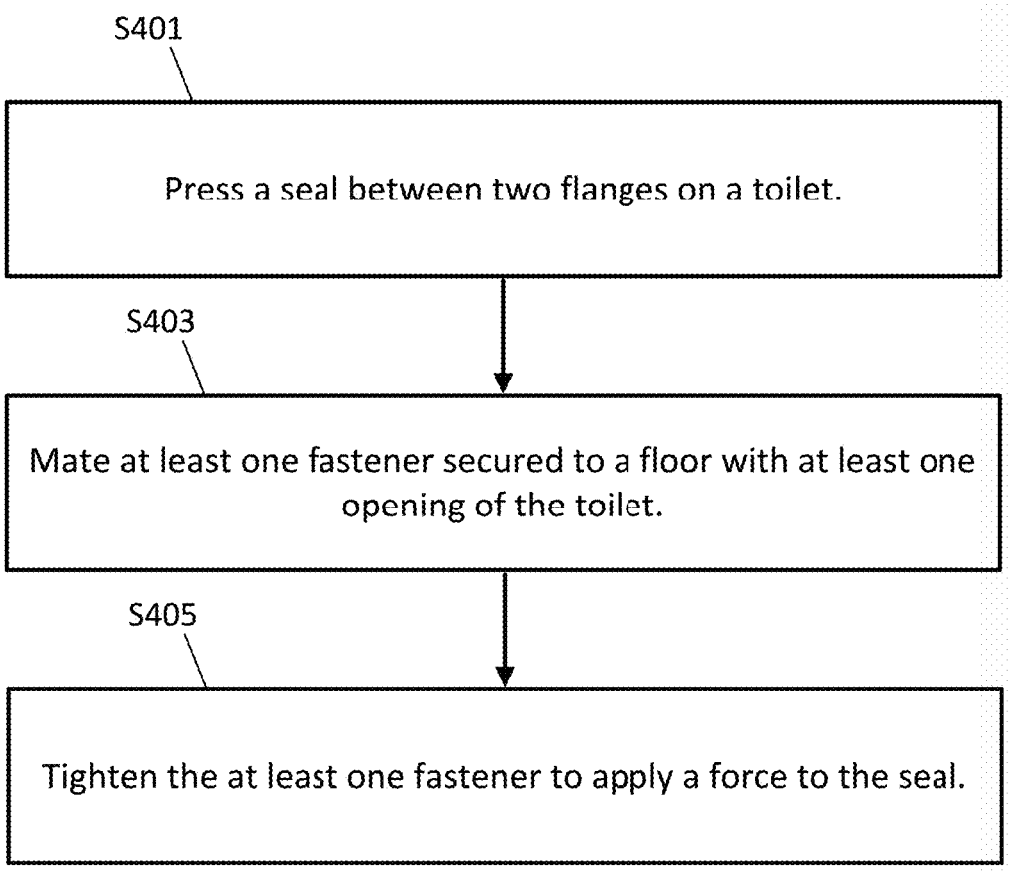
FIG. 25 illustrates a flowchart for installation of a toilet according to FIGS. 23 and 24.

FIG. 25 illustrates a flowchart for the operation of the floor mating device 250 for installation of toilet 10. Additional, different, or fewer acts may be included.

At act S401, a seal is pressed between two flanges on a toilet. The seal may be installed between the flanges manually or automatically by a tool. At act S403, the at least one fastener secured to a floor is mated to at least one opening in the toilet 10. At act S405, the at least one fastener is tightened to apply a force to the seal. A nut may be coupled to the fastener and rotated to apply the force to the seal. The seal may be formed from wax, foam or rubber.

Figure 26:
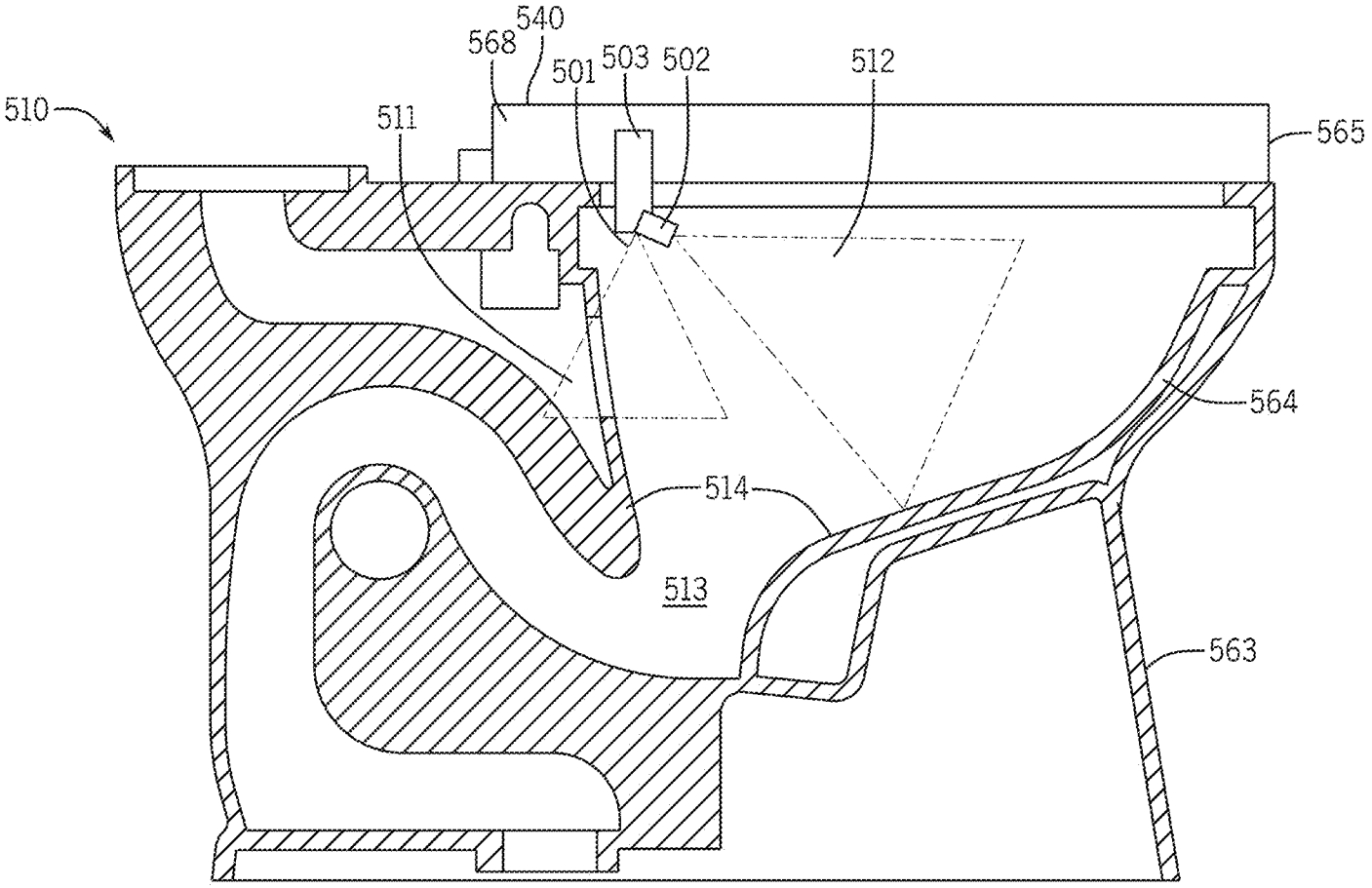
FIG. 26 illustrates a treatment device for a toilet bowl.

FIG. 26 illustrates another example toilet including two or more treatment devices for the toilet 510. The toilet 510 may include a toilet seat assembly 540, which may be coupled to rim 565 via hinge 568 or another coupling mechanism, a bowl 564, and a base 563. Treatment devices including a first sprayer 501 and a second sprayer 502 are coupled to the toilet 510. Additional, different, or fewer components may be included.

As shown, the toilet seat assembly 540 includes or is coupled directly to the treatment devices (e.g., first sprayer 501 and second sprayer 501) such that the water flow passes through the toilet seat assembly 540 to the treatment devices.

The toilet seat assembly 540 includes at least one tube or passage to transport the water through the toilet seat assembly 540 to the treatment devices. The first sprayer 501 may be connected to a first reservoir inside the toilet seat assembly 540. The second sprayer 501 may be connected to a second reservoir inside the toilet seat assembly 540. The reservoirs may be omitted. Water may be provided directly from the water supply through the water delivery holes in the toilet seat assembly 540.

In other examples the treatment devices may be independently mounted to the toilet 510. The treatment devices may be supported by a treatment device assembly, or may be attached to the toilet 510. The treatment device assembly may attach to the rim of the toilet. One or more attachment mechanisms may hold the treatment device assembly to the rim of the toilet 510. The attachment mechanisms may include a pressure plate and a screw or other tensioning member that presses the pressure plate to the rim or side of the toilet 510. The attachment mechanisms may include a spring loaded arm that grips the rim of the toilet 510.

The treatment devices may include a variety of sprayers. The first sprayer 501 is configured to generate a first spray or stream 511 that serves to wash the inside surface of the bowl 564. The second sprayer 502 is configured to generate a second spray or stream 512 that treats the inside surface of the bowl 564. The first sprayer 501 and the second sprayer 502 may be directed at different portions of the bowl 564.

The first sprayer 501 may be pointed toward a sump 513 of the bowl 564, or the area adjacent or surrounding the sump 513 (e.g., one or more ledges 514). The first sprayer 501 may included a first type of nozzle. The first type of nozzle may produce a high pressure stream suitable for removing waste debris or streaking from the toilet bowl 564. The first spray 511 may include water only or may include a soap, detergent, or other compound for cleaning the bowl 564. The compound may be mixed with water in the first reservoir, which is a cleaning fluid reservoir configured to include water and a cleaning substance. A mixing valve may selectively provide water to the first reservoir. The mixing valve may be actuated according to a command signal (e.g., from controller 100). A spraying valve between the first reservoir and the first sprayer 501 for turning on and off the spray 511 may be actuated according to a command signal (e.g., from controller 100). A pump may draw liquid from the first reservoir and provide the liquid under a predetermined pressure or force to the first sprayer 501.

The controller 100 may receive commands or instructions from a mobile device (e.g., mobile app) such as a cell phone, tablet, smart phone, laptop, or remote control. The mobile device may specify the sequence for the first sprayer 501 and the second sprayer 502. The mobile device may independently turn on and off the first sprayer 501 and the second sprayer 502.

The second sprayer 502 may be pointed at the sloped portion of the bowl 564 (e.g., upper portions of the bowl or adjacent to the rim 565). The second sprayer 502 may include a second type of nozzle. The second type of nozzle may produce a low pressure stream such as a fan spray or mist to deliver the spray 512 treatment to the toilet bowl 564. The treatment may be a hard water treatment, a rust treatment, or another compound that coats and/or protects the vitreous of the bowl 564. The treatment may be mixed with water in the second reservoir. A mixing valve may selectively provide water to the second reservoir. One example for the second reservoir includes an acidic treatment reservoir configured to included water and an acidic treatment substance.

The mixing valve may be actuated according to a command signal (e.g., from controller 100). A spraying valve between the second reservoir and the second sprayer 501 for turning on and off the spray 5112 may be actuated according to a command signal (e.g., from controller 100). A pump may draw liquid from the second reservoir and provide the liquid under a predetermined pressure or force to the second sprayer 501.

The first sprayer 501 and the second sprayer 501 may oscillate, be movable, or be stationary according to predetermined angles with respect to the bowl 564. In one example a spraying arm 503 is coupled to both the first sprayer 501 and the second sprayer 502. The spraying arm 503 may be driven by a motor or solenoid to raise and lower the spraying arm 503. The spraying arm 503 may be driven by a motor or solenoid to rotate the spraying arm 503 in a predetermined pattern. In some examples, the first sprayer 501 is rigid and pointed from the spraying arm 503 to the bowl 564 at a first angle with respect to the toilet bowl 564. In some examples, the second sprayer 502 is rigid and pointed from the spraying arm 503 to the bowl 564 at a first angle with respect to the toilet bowl 564. Thus, the spraying arm 503 may simultaneously move both the first sprayer 501 and the second sprayer 502 in a predetermined path. Under the spaying commands from the controller 100 the spray 511 may be turned on during some portions of the predetermined path and the spray 512 may be turned on during other portions of the predetermined path.

In some examples, the first sprayer 501 and the second sprayer 502 may be independently controlled by controller 100. The controller 100 may generate a setting command for each valve independently. The controller 100 may actuate the valves to turn on the water supply for a predetermined sequence.

The controller 100 may operate an oscillator to oscillate the first sprayer 501 and/or the second sprayer 502. The oscillator may cause the first sprayer 501 and/or the second sprayer 502 to follow a repeating path. The path may be linear, circular or another shape. The oscillator may be driven by a motor configured to provide rotational motion to the oscillator. The oscillator may include a mechanical device (e.g., rack or pinion) to convert the rotational motion to linear motion. The motor may be connected to a battery or other power source.

In some examples, the oscillator may oscillate the first sprayer 501 and/or the second sprayer 502 between a substantially upward facing direction (e.g., toward the user) and a substantially downward facing direction (e.g., toward the bowl).

In another example, a third sprayer may be used. The third sprayer may be a bidet or body sprayer pointed upward toward the user. The third sprayer may provide water under direction from the user. The third sprayer may also be coupled to the spray arm 503.

Figure 27:
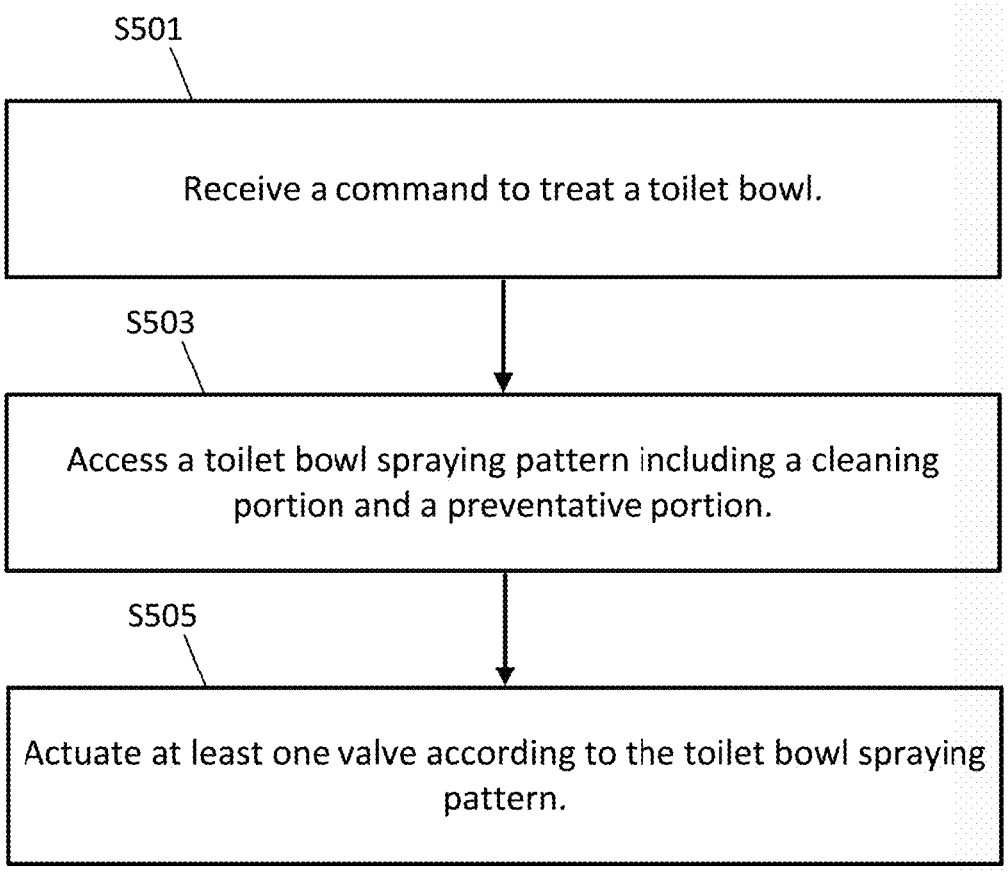
FIG. 27 illustrates a flowchart for treatment of a toilet bowl.

FIG. 27 illustrates a flowchart for treatment of a toilet bowl. The acts of the flowchart may be performed by controller 100. Additional, different, or fewer components may be included.

At act S501, the controller 100 receives a command to treat the toilet bowl. The command may be automatically generated. The command may be part of a flush cycle such that the command is issue at a predetermined time or sequence after a flush is triggered. The command may be based on sensor data such as a presence of the user.

At act S503, the controller 100 accesses a predetermined toilet bowl spraying pattern in response to the command. The spraying pattern may define one or more angles or paths for the sprayers to track or traverse in treating the toilet bowl. Portions of the pattern may correspond to cleaning (e.g., first sprayer 501). Portions of the path may correspond to a preventative treatment (e.g., second sprayer 502).

At act S505, the controller 100 sends commands to actuate the sprayers or valves fluidically coupled to the sprayers in order to realize the spraying pattern, including both the cleaning portions and the preventative treatment portions.

Figure 28:
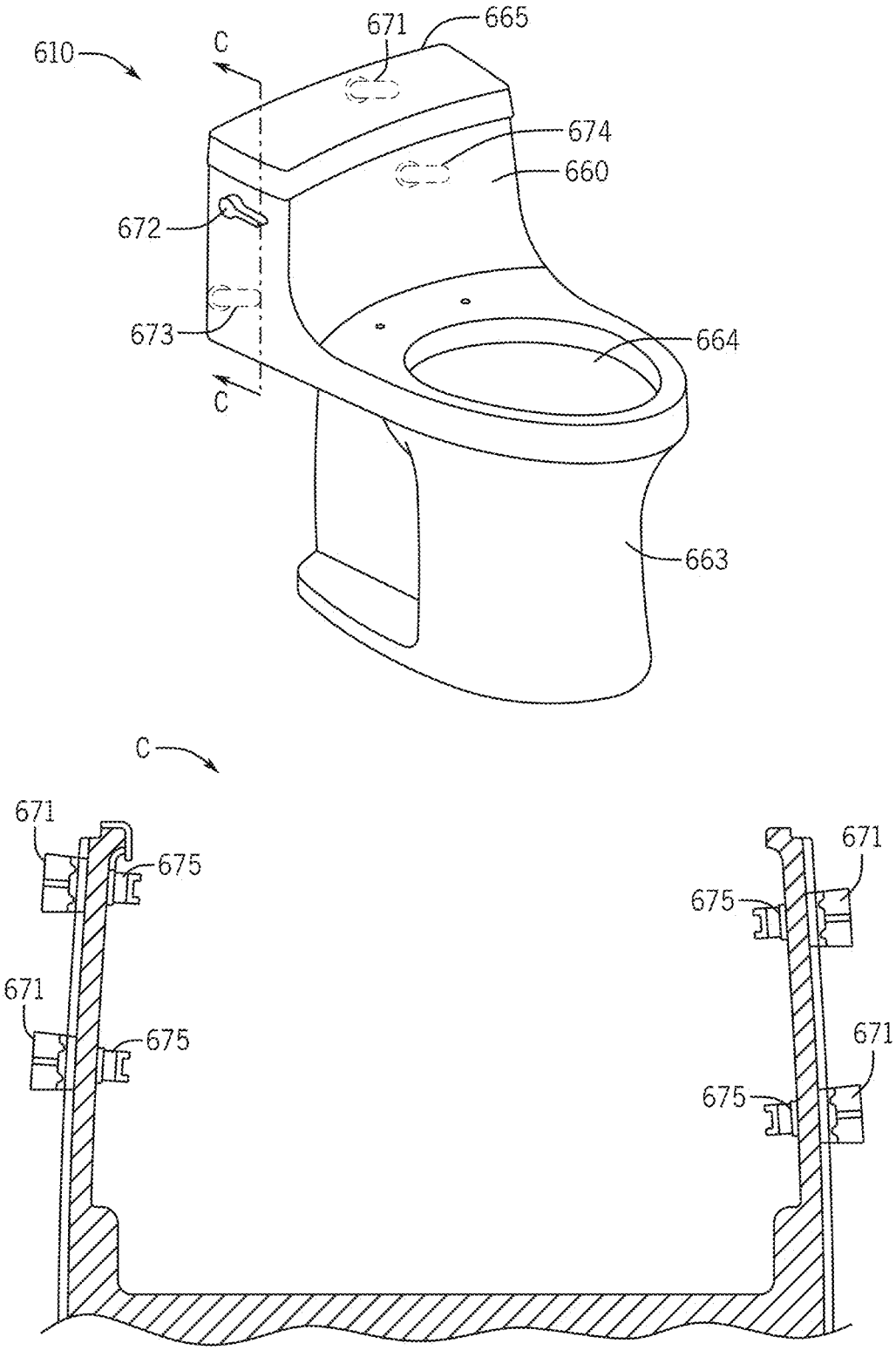
FIG. 28 illustrates a modular flush lever.

FIG. 28 illustrates an example toilet 610 including a tank 660 and a lid 665. The tank 660 may rest on and be coupled to a base 663 including a bowl and a sump disposed at a bottom of the bowl. Additional, different, or fewer components may be included.

The toilet 610 may include multiple positions to attach one or more flush triggers. The flush trigger may include a lever, a button, a touch screen or another user input. Example positions include a traditional top left position 672, a lower left position 673, a front position 674, and a top position 671. Right positions as well as other positions are possible and not illustrated.

The positions may be predetermined. For example, the tank 660 may include an aperture or bracket and multiple positions. For example, a plastic blank may be included in apertures at the multiple positions. The plastic blank is removable and replaced with a flush lever that connects with a fastener to join a flush lever support on the inside of the tank. In other examples, brackets are installed on the multiple positions on the tank 660 and the user may select a location to mount the flush trigger to the bracket.

The positions may be configurable. For example, the flush trigger, such as lever or handle 671, may be held in place by a magnetic anchor 675 inside the tank, as shown by cross-section C. The magnetic anchor 675 may be configured to rotate in response to operation of the handle 671, and the magnetic anchor 675 may be connected to a lever arm attached to a flapper or another type of flush valve. In other examples, the handle 671 may include a wireless transmitter that communicates with a flush valve. The trigger may include a gesture sensor, an accelerometer, or another sensor that detects movement of the handle 671 or user gesture near the handle 671 A wireless signal is sent from the handle 671 to the flush valve based on the sensor data.

The magnetic anchor 675 may be movable within the tank. That is, to move the position of the toilet handle 671, the magnetic anchor 675 could be moved to any location inside the tank and the toilet handle 671 would be attracted to a corresponding position on the outside of the tank.

The handle 671 may be coupled to a flush valve 669 in a variety of techniques. In one example, a cable connects the handle 671 and flush valve 669. The cable may include a cord or metal wire that travels within a sheath. A smaller span of rotation of the handle 671 may be used with the cable. In other examples, a motor corresponding to the handle 671 may be mounted inside thank such that no hole or aperture in the tank is needed for the handle 671. The motor and the handle 671 may be connected with a magnetic trip, wireless communication, an induction loop, or another device where a signal passes through the wall of the tank. In the case of an induction loop, a coil of wire inside the tank may generate a magnetic field that is also detectable by a sensor on the inside of the tank. When the handle 671 is moved, it disrupts the magnetic field (e.g., causes a change in the magnetic field) that is detected by the sensor. The sensor data is analyzed, for example by controller 100, and when the disruption is detected, a command for the motor is generated to cause the motor to wind up the cord of the cable to open the flush valve 669. Other mechanisms may be used between the motor and the flush valve 669.

The handle 167 may also include one or more springs to help bias the handle 167 to a home position. In the examples of magnetic triggered or inductance triggering between the handle 167 and the flush valve 669, there may be little to no magnetic resistance. This may feel odd or broken to the user. The spring applies a force against the action of the user on the handle 167 and also returns the handle 167 to the home position.

Figure 29:
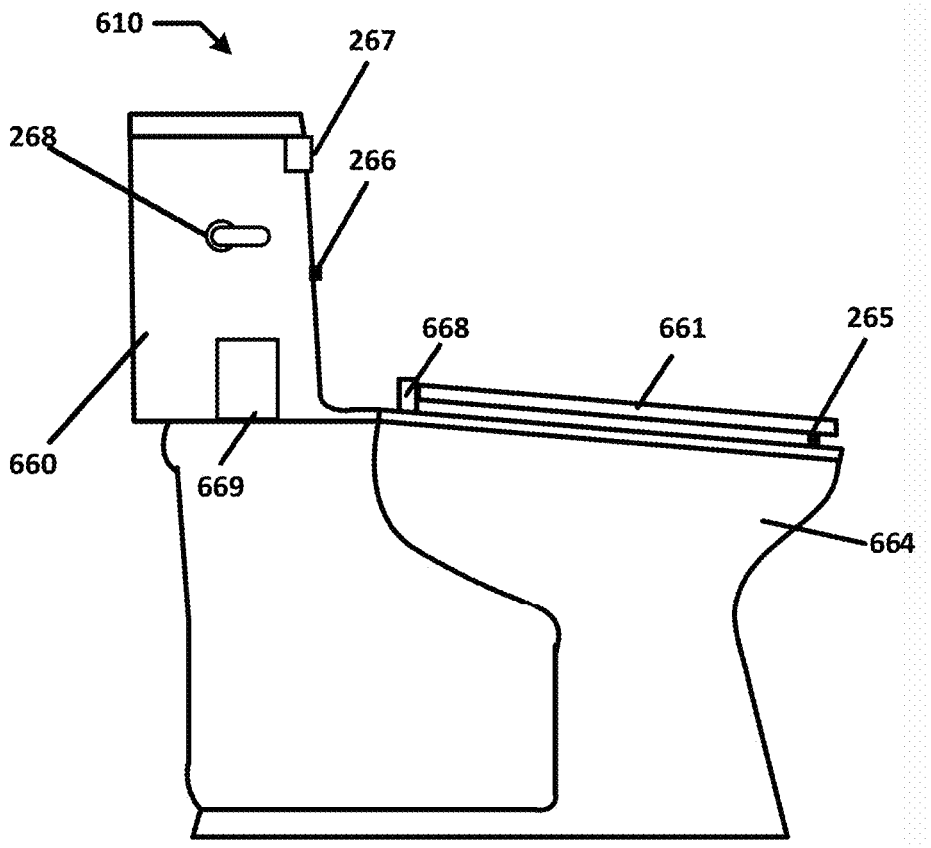
FIG. 29 illustrates a first example tank treatment system for a toilet.

FIG. 29 illustrates additional flush triggers for toilet 610. An example flush trigger 266 may be a pressure sensor, a button, a proximity sensor, or other type of sensor that detects when the lid 661 is in an opened position. When the lid 661 is opened at rests against the tank 660, the flush trigger 266 detects the position of the lid 661. An example flush trigger 265 may be a pressure sensor, a button, a proximity sensor, or other type of sensor that detects when the lid 661 is in a closed position. An example flush trigger 267 may be a gesture sensor, a position sensor, or another sensor that detects the presence of a user or a gesture made by a user. An example flush trigger 268 may be similar to any of the examples flush trigger described in other embodiments.

The controller 100 may access from memory a table that associates the flush triggers with desired flush commands or flush valve commands. The user may specify the associations in the table to program which flush triggers should be associated with various commands. A keypad or touchscreen mounted on the toilet 710, or a mobile device in communication with the controller 100 of the toilet, may specify the associations.

A controller 100 may receive data from one or any combination of the flush triggers. The controller 100 may generate a flush command for the flush valve 669 in response to the data received from the flush triggers. The controller 100 may generate different commands based on the combination of flush triggers that were tripped. A low volume flush command may be generated when only flush trigger 266 is detected. A medium volume flush command may be generated when both the flush trigger 265 and flush trigger 267 are detected. A high volume flush command may be generated when a certain gesture is detected by the flush trigger 267. These types of flush quantities may constitute different flush cycles where the flush valve 669 is actuated for predetermined amounts of time corresponding to the different flush quantities. The controller 100 includes a memory including a selection or a predetermined sequence for the flush triggers to indicate a predetermined flush cycle.

The controller 100 may include a learned model that associated combinations of flush triggers with historical data. For example, the user may sometimes request an additional or second flush. The learn model may determine which combination of flush triggers are associated with the request for an additional search. The controller 100 may access the learned model to automatically determine when the combination of flush triggers associated with the additional search in the future so that adequate flushing is adequately provided. In other scenarios, the user may request that no flushing occurs in certain scenarios of detection from the flush triggers. In this way, the controller 100 determines user specific models to minimize the amount of flushing while still meeting the user's expectations automatically without the need for any specific inputs over time from the user. The learned model associated one or more flush trigger sensors, gestures, or durations with a valve command that includes flush valve durations or flush volumes. The controller 100 receives data for the flush triggers, applies the model, and selects the flush command based on the model.

Figure 30:
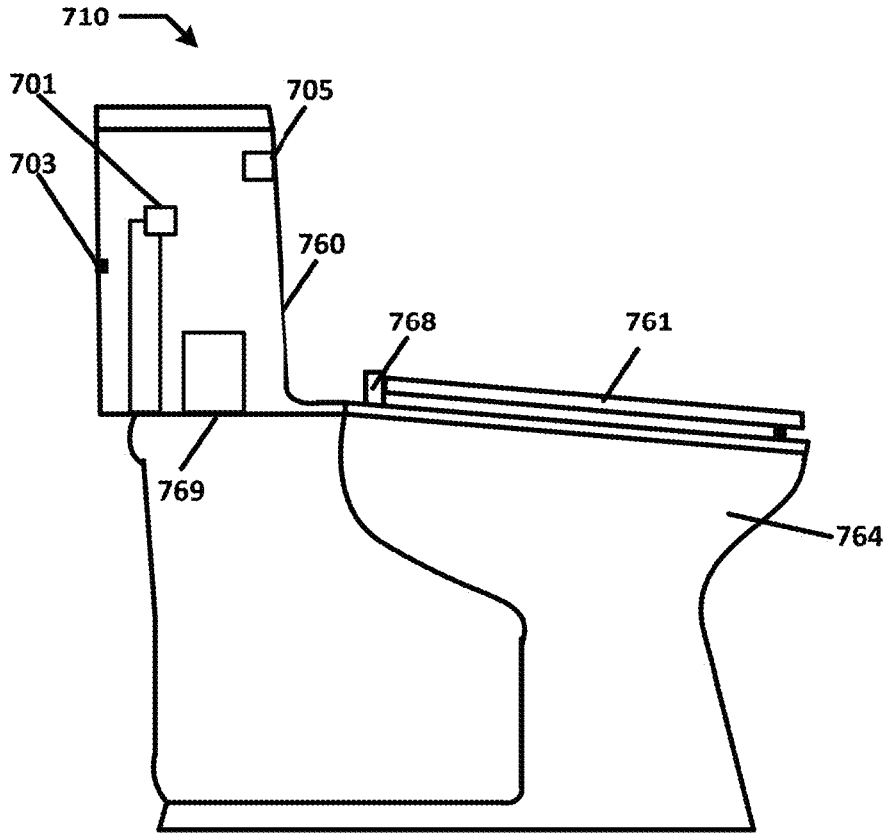
FIG. 30 illustrates a second example tank treatment system for a toilet.

FIG. 30 illustrates an example tank treatment system for a toilet 710. The toilet 710 includes base with bowl 764 supporting a tank 760 and a seat assembly including a seat, a lid 761 and hinge 768. The tank 760 may include a fill valve 701, a detector 703, a treatment device 705, and a flush valve 769. Additional, different, or fewer components may be included.

A controller (e.g., controller 100) may be in communication with one or more components including the fill valve 701, the detector 703, the treatment device 705, and the flush valve 769. The controller 100 is configured to operate the fill valve 701 and the at least one treatment device 705 according to a fill cycle. For example, when the tank empties through actuation of the flush valve 769, the controller 100 may turn on the treatment device 705 to treat the inside of the tank 760. In addition, the controller 100 may delay the operation of the fill valve 701 so that the treatment device 705 has time to apply the treatment and for the treatment to be effective before the tank 760 is refilled. The time delay may be selected according to the type of treatment device 705. Example delays may include 5 seconds, 10 seconds, 30 seconds, or a minute. In some examples, multiple treatments are applied. The time delay may be calculated according to the multiple treatments. The controller 100 may include a timer for determining when the elapsed time is equal to the predetermined time delay. The timer may be started with the flush valve actuation in the flush cycle. The end of the time may cause the controller to actuate the fill valve. In other examples, the treatment device 705 may be applied according to a schedule (e.g., time of day, day of the week, time of night). The user may also provide an independent input for starting the timer for the treatment device 705.

The treatment device 705 may include a delivery system for introducing a chemistry (e.g., a cleaning compound) to the water to thereby reduce, scale, slippery (e.g., slipperiness), and/or sanitation in the toilet or other device that uses the water. The systems and methods of this application may influence other aspects related to cleanliness. For example, scent(s) related to the systems (and the use thereof) may be influenced (e.g., masked, ameliorated, reduced, etc.) by the systems and methods of this application, such as, but not limited to the use of active filters (e.g., hydroxyl, etc.), passive filters (e.g., carbon, gas, etc.), and/or scent(s) applied to or contained within components of the system.

The treatment device 705 may be configured to utilize chemistry to advantageously help clean (e.g., up to a level just below disinfection) or help maintain the cleanliness longer than devices not having the improved chemistry. As non-limiting examples, the chemistries disclosed herein may advantageously help prevent the formation of scale, remove scale that has formed, prevent or remove biofilm, prevent or mask odors, and/or sanitize components of toilets or other devices disclosed in this application. The toilets utilizing the improved chemistry may be able to go for one to six months (e.g., eight weeks) or longer without having to be cleaned (e.g., before the build-up of deposits). More specific examples of chemistry/cleaning compounds are described below in greater detail.

The treatment device 705 may be configured to utilize one or more than one compound/chemistry to improve the cleanliness of the system. In this application, the terms "chemistry," "compound," and "cleaning compound" are used interchangeably to connote the use of a chemical, chemical compound, chemical element, or any combination thereof that is beyond that of mere water. Thus, while the systems described in this application may use water (e.g., to dilute a cleaning compound, for flushing, etc.) and the cleaning compounds may include water, the chemistry/compounds/cleaning compounds include at least one additional chemical (e.g., elements, compounds, etc.) other than water.

Hydrogen peroxide ($H_2O_2$) may be introduced into the tank 760 from the treatment device 705. In addition to $H_2O_2$, chlorines and peracedic acid (PAA) are additional non-limiting examples of chemicals/compounds that may be used. Some additional non-limiting examples of chemicals/compounds that may be used with the systems and methods of this application include (but are not limited to) polyphosphates (e.g., sodium hexametaphosphate (SHMP), tetrapotassium pyrophosphate (TKPP), etc.), low pH acids (e.g., hydrogen chloride (HCL), dihydrogen phosphate ($H_2PO_4$), trisodium phosphate (TSP), ethylenediaminetetraacidic acid (EDTA), and compounds thereof, as well as other acids and/or sequestering agents. These chemicals/compounds may be most beneficial in, for example, preventing and/or removing scale. Yet other examples of chemicals/compounds that may be used with the systems of this application include (but are not limited to) didecyldimethyl ammonium chloride (DDAC), $H_2O_2$, sodium hypochlorite (NaOCl) such as bleach, PAA, triclosan, formic acid, TSP, and compounds thereof, as well as other disinfectants (e.g., quaternary disinfectants) and biocides. These chemicals/compounds may be most beneficial in, for example, preventing and/or removing biofilm. It is noted that other chemicals/compounds may be used in the systems and methods disclosed in this application, and any such chemical/compound disclosed may be used with any system and/or method disclosed.

The treatment device 705 may include a system that generates a chemical/compound, such as one of those disclosed above. For example, a system may include a generator that produces $H_2O_2$, such as from oxygen (e.g., in air) and water or the utility supply. Thus, a chemical/compound generator may be provided within the system, to produce the cleaning compound. According to one example, a generator may be configured to produce a chemical (e.g., $H_2O_2$) that is diluted to a particular range in ppm (parts per million), such as with water or other suitable diluent. According to one example, a generator is configured to produce a chemical that is diluted to a range of 2-4 ppm. In another example, the range is 1-100 ppm.

A non-chemical approach to mitigating (e.g., reducing, removing, etc.) scale and other contaminants may be employed. One such example is the use of beads, which may involve template assisted crystallization (TAC). Certain minerals (e.g., calcium, magnesium, etc.) when in an ionic form (e.g., state) may attach to surfaces (e.g., inner surface of the tank 760), but do not attach to surfaces when crystalized (i.e., in a crystalline form). The beads involving TAC change the mineral(s) from their ionic form to their crystalline form to prevent the minerals from attaching to surfaces of the systems and/or induce the in minerals to become detached from the surfaces.

The treatment device 705 may include an ultraviolet light or far UVC light. The ultraviolet light irradiates the internal walls. The ultraviolet light may have a predetermined frequency or wavelength, which may be a range of wavelengths or frequencies for the light emitted from the light. The germicidal irradiation may be optimized by a wavelength band of 200 to 280 nanometers (nm) other examples may include 200 to 222 nm, 230 to 250 nm, 240 to 315 nm or other ranges. An example wavelength may be 254 nm. The controller 100 may send commands to the light to turn on the light or stop the light. The controller 100 may send commands to the light to set the wavelength of the light. The ultraviolet light disinfects the particles. The ultraviolet light may kill or eliminate living organisms (e.g., bacteria) and/or viruses that are adhered to the inside surface of the cyclone device 102 or otherwise contained in the cyclone device 102 (e.g., in a mist). Ultraviolet light may be run for at least 30 seconds after a user has finished using the hand dryer. In high use cases ultraviolet light may be run continuously. This option may be set up by the building operator, or it may be done by machine learning or other artificial intelligence (AI).

The treatment device 705 may operate a disinfectant dispenser. The treatment device 705 may operate an ultrasonic emitter to provide ultrasonic waves to the inside of the tank 760. The ultrasonic emitter may include an ultrasonic atomizer or transducer that converts high frequency sound waves into mechanical energy that is transferred into standing waves of the sanitizing liquid, causing a mist or fog to be emitted.

The treatment device 705 may generate ozone using a variety of techniques, including corona discharge, ultraviolet light, cold plasma, and other techniques. In corona discharge, a corona discharge tube or an ozone plate is used. For example, a high voltage may be applied to an electrode in discharge tube or on the ozone plate. A corona discharge is an electrical discharge caused by the ionization of air surrounding the conductor carrying the high voltage. The air around the conductor undergoes an electrical breakdown to become conductive (e.g., temporarily) so that charge can leak off of the conductor and into the air. A corona occurs at locations where the strength of the electric field (potential gradient) around a conductor exceeds the dielectric strength of the air.

In another technique, ozone may be produced by ultraviolet light. Such an ozone generator includes a light source that generates a narrow-band ultraviolet light. The narrow-band ultraviolet light may be less than the spectrum of light produced by the sun. Ultraviolet light may produce ozone at a lower concentration (e.g., 1%) than corona techniques. Ultraviolet light ozone generates may exclude both air dryers and oxygen concentrators.

In another technique, ozone may be produced by cold plasma. Such an ozone generator includes a dielectric barrier discharge configured to generate plasma. Pure oxygen gas is supplied to the plasma and the oxygen molecules are split into single atoms, which recombine into groups of three, forming ozone, or $O_3$. Cold plasma techniques may produce high concentrations of ozone (e.g., 5% or greater) using a small amount of space.

In another technique, an electrolytic ozone generate produces ozone by splitting water molecules. Such an ozone generator includes a water electrolysis device that splits water molecules into $H_2$, $O_2$, and $O_3$. The hydrogen gas, $H_2$, may be removed to leave oxygen and ozone as the only products of the reaction. Electrolytic ozone generation may produce at higher concentrations (20-30%) than the corona discharge technique. The electrolytic techniques may also avoid nitrogen gases.

The controller 100 may send commands to the ozone generator. For example, the commands may initiate the generation of ozone. The commands may be triggered by a time schedule (e.g., once every predetermined time period or at certain times of day). The commands may be triggered by a flush cycle. That is, the controller 100 may send a command to the ozone generator to generate ozone when the tank is empty.

Figure 31:
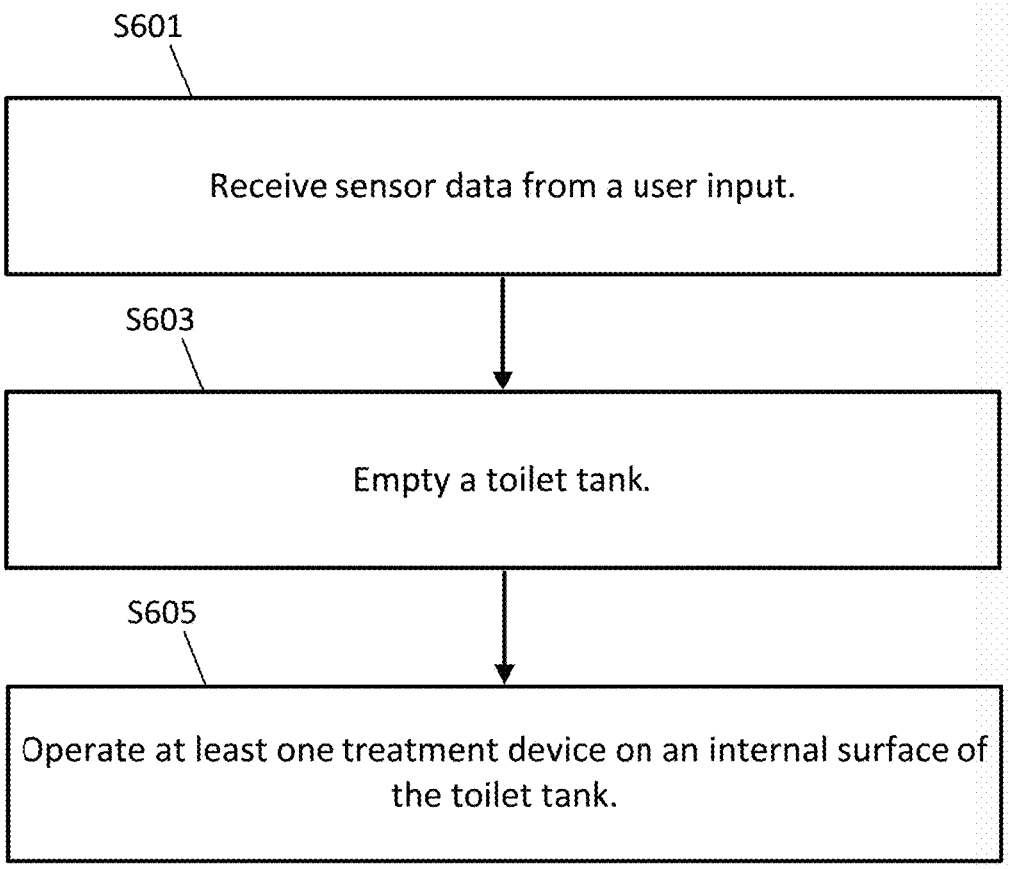
FIG. 31 illustrates a flowchart for the tank treatment system of FIG. 29.

FIG. 31 illustrates a flowchart for the tank treatment system of FIGS. 29 and 30. Additional, different, or fewer acts may be included.

At act S601, the controller 100 receives sensor data for a user input. The controller 100 may receive commands or instructions from a mobile device (e.g., mobile app) such as a cell phone, tablet, smart phone, laptop, or remote control.

At act S603, the controller 100 operates, in response to the user input, a fill valve configured to empty the toilet tank. At act S605, the controller 100 operates, in response to the user input, at least one treatment device to treat the toilet tank.

Figure 32:
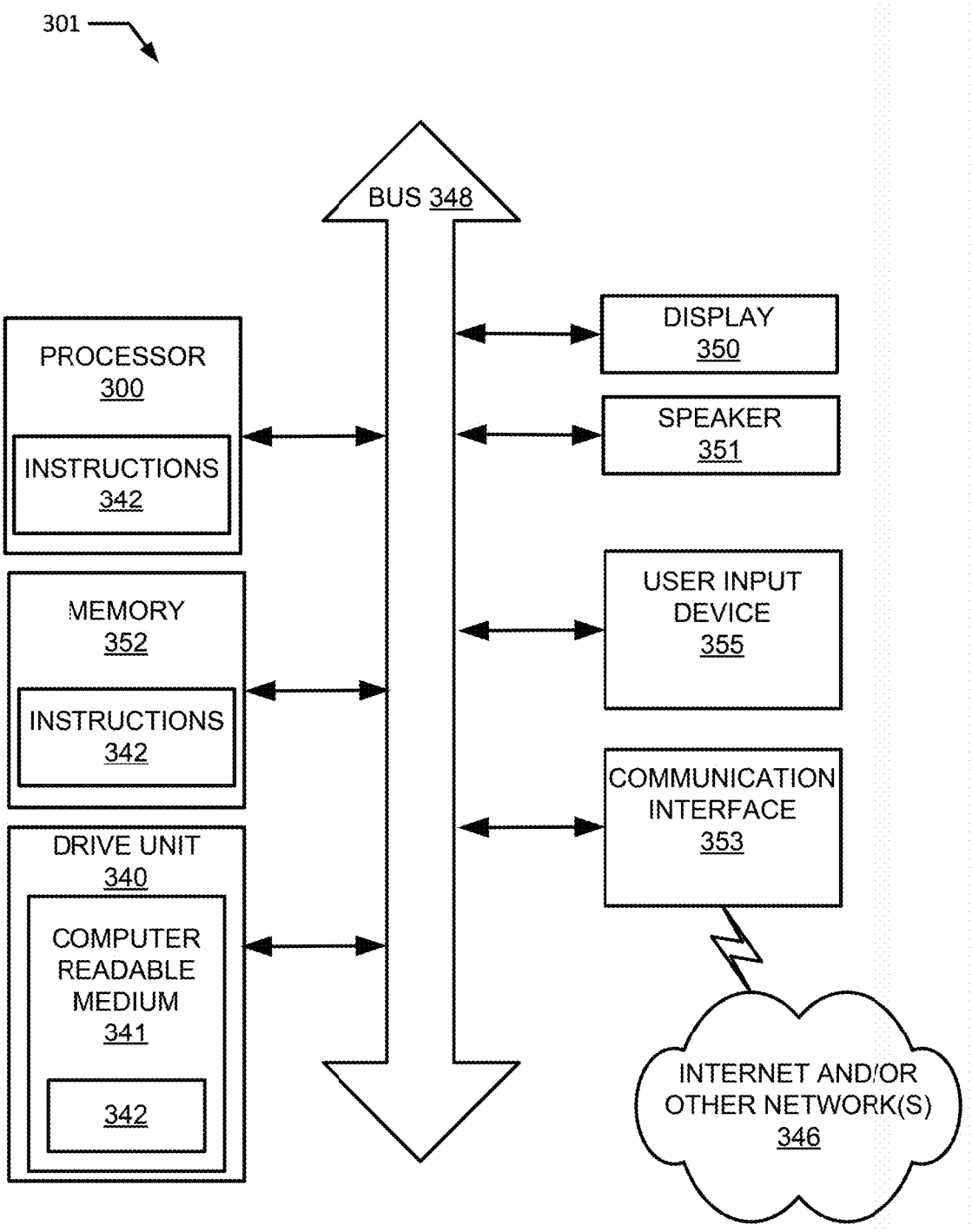
FIG. 32 illustrates an example controller for any of the embodiments in FIGS. 1-31.

FIG. 32 illustrates an example a control system or controller 301, which may be used in any examples herein such as controller 100, for any of the embodiments in FIGS. 1-31. The controller 301 may include a processor 300, a memory 352, and a communication interface 353 for interfacing with devices or to the internet and/or other networks 346. In addition to the communication interface 353, a sensor interface may be configured to receive data from the sensors described herein or data from any source. The components of the control system may communicate using bus 348. The control system may be connected to a workstation or another external device (e.g., control panel) and/or a database for receiving user inputs, system characteristics, and any of the values described herein.

Optionally, the control system may include an input device 355 and/or a sensing circuit 356 in communication with any of the sensors. The sensing circuit receives sensor measurements from sensors as described above. The input device may include any of the user inputs such as buttons, touchscreen, a keyboard, a microphone for voice inputs, a camera for gesture inputs, and/or another mechanism.

Optionally, the control system may include a drive unit 340 for receiving and reading non-transitory computer media 341 having instructions 342. Additional, different, or fewer components may be included. The processor 300 is configured to perform instructions 342 stored in memory 352 for executing the algorithms described herein. A display 350 may be an indicator or other screen output device. The display 350 may be combined with the user input device 355.

Processor 300 may be a general purpose or specific purpose processor, an application specific integrated circuit (ASIC), one or more programmable logic controllers (PLCs), one or more field programmable gate arrays (FPGAs), a group of processing components, or other suitable processing components. Processor 300 is configured to execute computer code or instructions stored in memory 352 or received from other computer readable media (e.g., embedded flash memory, local hard disk storage, local ROM, network storage, a remote server, etc.). The processor 300 may be a single device or combinations of devices, such as associated with a network, distributed processing, or cloud computing.

Memory 352 may include one or more devices (e.g., memory units, memory devices, storage devices, etc.) for storing data and/or computer code for completing and/or facilitating the various processes described in the present disclosure. Memory 352 may include random access memory (RAM), read-only memory (ROM), hard drive storage, temporary storage, non-volatile memory, flash memory, optical memory, or any other suitable memory for storing software objects and/or computer instructions. Memory 352 may include database components, object code components, script components, or any other type of information structure for supporting the various activities and information structures described in the present disclosure. Memory 352 may be communicably connected to processor 300 via a processing circuit and may include computer code for executing (e.g., by processor 300) one or more processes described herein. For example, the memory 352 may include graphics, web pages, HTML files, XML files, script code, shower configuration files, or other resources for use in generating graphical user interfaces for display and/or for use in interpreting user interface inputs to make command, control, or communication decisions.

In addition to ingress ports and egress ports, the communication interface 353 may include any operable connection. An operable connection may be one in which signals, physical communications, and/or logical communications may be sent and/or received. An operable connection may include a physical interface, an electrical interface, and/or a data interface. The communication interface 353 may be connected to a network. The network may include wired networks (e.g., Ethernet), wireless networks, or combinations thereof. The wireless network may be a cellular telephone network, an 802.11, 802.16, 802.20, or WiMax network, a Bluetooth pairing of devices, or a Bluetooth mesh network. Further, the network may be a public network, such as the Internet, a private network, such as an intranet, or combinations thereof, and may utilize a variety of networking protocols now available or later developed including, but not limited to TCP/IP based networking protocols.

While the computer-readable medium (e.g., memory 352) is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the disclosure is considered to include any one or more of a computer-readable medium or a distribution medium and other equivalents and successor media, in which data or instructions may be stored. The computer-readable medium may be non-transitory, which includes all tangible computer-readable media.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

When a component, device, element, or the like of the present disclosure is described as having a purpose or performing an operation, function, or the like, the component, device, or element should be considered herein as being "configured to" meet that purpose or to perform that operation or function.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the system as shown in the various exemplary embodiments is illustrative only. Additionally, any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A toilet comprising:

a base including a bowl structure having a bowl structure inner surface;

a dampener configured to reduce urine splash back and including a dampener inner surface, the dampener comprised of a softer material than the bowl structure and disposed within the bowl structure; and a bowl inner surface defined by the bowl structure inner surface and the dampener inner surface, wherein the dampener is integrally formed with the bowl structure inner surface.

2. The toilet of claim 1, wherein the bowl structure is comprised of vitreous china and the dampener is comprised of silicone.

3. The toilet of claim 1, wherein the dampener is over molded on the bowl structure.

4. The toilet of claim 1, further comprising:

a rim supported by or integrated with the base, wherein the rim is inclined at an acute angle below a horizontal plane.

5. The toilet of claim 1, further comprising:

a bidet wand extending from the base, the bidet wand configured to selectively change between a position for dispensing a flow of water for washing a user and a position for cleaning a surface of the bowl structure.

6. The toilet of claim 1, further comprising:

a floor connector including a channel formed by a first flange and a second flange on a bottom of the toilet.

7. An apparatus comprising:

a base including a bowl structure having a bowl structure inner surface and formed from vitreous china;

a dampener configured to reduce urine splash back and including a dampener inner surface, wherein the dampener comprised of a polymer; and a bowl inner surface defined by the bowl structure inner surface and the dampener inner surface, wherein the dampener is integrally formed with the bowl structure inner surface.

8. The apparatus of claim 7, wherein the dampener is comprised of silicone.

9. The apparatus of claim 7, wherein the dampener is over molded on the bowl structure.

10. The apparatus of claim 7, further comprising:

a rim supported by or integrated with the base, wherein the rim is inclined at an acute angle below a horizontal plane.

11. The apparatus of claim 7, further comprising:

a bidet wand extending from the base, the bidet wand configured to selectively change between a position for dispensing a flow of water for washing a user and a position for cleaning a surface of the bowl structure.

12. The apparatus of claim 7, further comprising:

a floor connector including a channel formed by a first flange and a second flange on a bottom of the toilet.

13. A toilet comprising:

a base including a bowl structure having a bowl structure inner surface and formed from vitreous china;

a rim disposed around a top of the bowl;

a seat rotatably coupled to the rim, wherein when a top surface of the rim is disposed at an incline with respect to a horizontal plane;

a dampener configured to reduce urine splash back and including a dampener inner surface, wherein the dampener comprised of a polymer; and a bowl inner surface defined by the bowl structure inner surface and the dampener inner surface, wherein the dampener is integrally formed with the bowl structure inner surface.

14. The toilet of claim 13, wherein the bowl structure is comprised of vitreous china and the dampener is comprised of silicone.

15. The toilet of claim 13, wherein the dampener is over molded on the bowl structure.

16. The toilet of claim 13, further comprising:

a bidet wand extending from the base, the bidet wand configured to selectively change between a position for dispensing a flow of water for washing a user and a position for cleaning a surface of the bowl structure.

17. The toilet of claim 7, further comprising:

a floor connector including a channel formed by a first flange and a second flange on a bottom of the toilet.

* * * * *